US009719514B2

(12) United States Patent
Santos et al.

(10) Patent No.: US 9,719,514 B2
(45) **Date of Patent: *Aug. 1, 2017**

(54) COMPRESSOR

(71) Applicant: HICOR TECHNOLOGIES, INC., Houston, TX (US)

(72) Inventors: Pedro Santos, Houston, TX (US); Jeremy Pitts, Boston, MA (US); Andrew Nelson, Somerville, MA (US); Johannes Santen, Far Hills, NJ (US); John Walton, Cambridge, MA (US); Mitchell Westwood, Boston, MA (US); Harrison O'Hanley, Ipswich, MA (US)

(73) Assignee: HICOR TECHNOLOGIES, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/264,559

(22) Filed: Sep. 13, 2016

(65) Prior Publication Data

US 2017/0067468 A1 Mar. 9, 2017

Related U.S. Application Data

(60) Continuation of application No. 14/994,964, filed on Jan. 13, 2016, which is a division of application No.
(Continued)

(51) Int. Cl.
*F03C 2/00* (2006.01)
*F03C 4/00* (2006.01)
(Continued)

(52) U.S. Cl.
CPC ..... *F04C 29/042* (2013.01); *F04C 18/00* (2013.01); *F04C 18/356* (2013.01);
(Continued)

(58) Field of Classification Search
CPC .. F04C 23/008; F04C 18/356; F04C 18/3564; F04C 18/3562; F04C 18/3568;
(Continued)

(56) References Cited

U.S. PATENT DOCUMENTS 2,324,434 A 7/1943 Shore
2,800,274 A 7/1957 Makaroff et al.
(Continued)

FOREIGN PATENT DOCUMENTS

CH 223597 9/1942
DE 74152 C 2/1893
(Continued)

OTHER PUBLICATIONS

Brown, Royce N., RNB Engineering, Houston, Texas, "Compressors: Selection and Sizing", Gulf Professional Publishing, 3rd Edition, 2005 Elsevier Inc.
(Continued)

*Primary Examiner* — Theresa Trieu
(74) *Attorney, Agent, or Firm* — Pillsbury Winthrop Shaw Pittman LLP

(57) ABSTRACT

A positive displacement rotary compressor is designed for near isothermal compression, high pressure ratios, high revolutions per minute, high efficiency, mixed gas/liquid compression, a low temperature increase, a low outlet temperature, and/or a high outlet pressure. Liquid injectors provide cooling liquid that cools the working fluid and improves the efficiency of the compressor. A gate moves within the compression chamber to either make contact with or be proximate to the rotor as it turns.

17 Claims, 32 Drawing Sheets

Related U.S. Application Data

13/782,845, filed on Mar. 1, 2013, now Pat. No. 9,267,504, which is a continuation-in-part of application No. 13/220,528, filed on Aug. 29, 2011, now Pat. No. 8,794,941, and a continuation-in-part of application No. PCT/US2011/049599, filed on Aug. 29, 2011.

(60) Provisional application No. 61/485,006, filed on May 11, 2011, provisional application No. 61/378,297, filed on Aug. 30, 2010, provisional application No. 61/770,989, filed on Feb. 28, 2013.

(51) Int. Cl.

| | |
|---|---|
| ***F04C 18/00*** | (2006.01) |
| ***F04C 29/04*** | (2006.01) |
| ***F04C 29/12*** | (2006.01) |
| ***F04C 18/356*** | (2006.01) |
| ***F04C 29/02*** | (2006.01) |
| ***F04C 27/00*** | (2006.01) |
| ***F04C 29/00*** | (2006.01) |
| *F04C 23/00* | (2006.01) |

(52) U.S. Cl.

CPC ..... *F04C 18/3562* (2013.01); *F04C 18/3564* (2013.01); *F04C 18/3568* (2013.01); *F04C 27/001* (2013.01); *F04C 29/005* (2013.01); *F04C 29/0007* (2013.01); *F04C 29/026* (2013.01); *F04C 29/12* (2013.01); *F04C 23/008* (2013.01); *F04C 2210/24* (2013.01); *F04C 2240/20* (2013.01); *F04C 2240/30* (2013.01); *F04C 2240/60* (2013.01); *F04C 2270/052* (2013.01); *F04C 2270/19* (2013.01); *F04C 2270/22* (2013.01)

(58) Field of Classification Search

CPC .. F04C 27/009; F04C 27/001; F04C 29/0007; F04C 29/0021; F04C 29/026; F04C 29/042; F04C 29/12; F04C 2240/20; F04C 2240/30; F04C 2240/60; F04C 2210/24; F04C 2270/052; F04C 2270/19; F04C 2270/22; F04C 18/00; F01C 21/0845; F01C 21/0836

USPC ..... 418/60, 63, 97, 104, 151, 270

See application file for complete search history.

(56) References Cited

U.S. PATENT DOCUMENTS

| | | | |
|---|---|---|---|
| 3,795,117 | A | 3/1974 | Moody, Jr. et al. |
| 3,820,350 | A | 6/1974 | Brandin et al. |
| 3,820,923 | A | 6/1974 | Zweifel |
| 3,850,554 | A | 11/1974 | Zimmern |
| 3,934,967 | A | 1/1976 | Gannaway |
| 3,936,239 | A | 2/1976 | Shaw |
| 3,936,249 | A | 2/1976 | Sato |
| 3,939,907 | A | 2/1976 | Skvarenina |
| 3,941,521 | A | 3/1976 | Weatherston |
| 3,941,522 | A | 3/1976 | Acord |
| 3,945,220 | A | 3/1976 | Kosfeld |
| 3,945,464 | A | 3/1976 | Sato |
| 3,947,551 | A | 3/1976 | Parrish |
| 3,954,088 | A | 5/1976 | Scott |
| 3,976,404 | A | 8/1976 | Dennison |
| 3,981,627 | A | 9/1976 | Kantor |
| 3,981,703 | A | 9/1976 | Glanvall et al. |
| 3,988,080 | A | 10/1976 | Takada |
| 3,988,081 | A | 10/1976 | Goloff et al. |
| 3,994,638 | A | 11/1976 | Garland et al. |
| 3,995,431 | A | 12/1976 | Schwartzman |
| 3,998,243 | A | 12/1976 | Osterkorn et al. |
| 4,005,949 | A | 2/1977 | Grant |
| 4,012,180 | A | 3/1977 | Berkowitz et al. |
| 4,012,183 | A | 3/1977 | Calabretta |
| 4,018,548 | A | 4/1977 | Berkowitz |
| 4,021,166 | A | 5/1977 | Glanvall et al. |
| 4,022,553 | A | 5/1977 | Poole et al. |
| 4,025,244 | A | 5/1977 | Sato |
| 4,028,016 | A | 6/1977 | Keijer |
| 4,028,021 | A | 6/1977 | Berkowitz |
| 4,032,269 | A | 6/1977 | Sheth |
| 4,032,270 | A | 6/1977 | Sheth et al. |
| 4,033,708 | A | 7/1977 | Weatherston |
| 4,035,114 | A | 7/1977 | Sato |
| RE29,378 | E | 8/1977 | Bloom |
| 4,048,867 | A | 9/1977 | Saari |
| 4,050,855 | A | 9/1977 | Sakamaki et al. |
| 4,057,367 | A | 11/1977 | Moe et al. |
| 4,058,361 | A | 11/1977 | Giurlando et al. |
| 4,058,988 | A | 11/1977 | Shaw |
| 4,060,342 | A | 11/1977 | Riffe et al. |
| 4,060,343 | A | 11/1977 | Newton |
| 4,061,446 | A | 12/1977 | Sakamaki et al. |
| 4,068,981 | A | 1/1978 | Mandy |
| 4,071,306 | A | 1/1978 | Calabretta |
| 4,072,452 | A | 2/1978 | Sheth |
| 4,076,259 | A | 2/1978 | Raimondi |
| 4,076,469 | A | 2/1978 | Weatherston |
| 4,086,040 | A | 4/1978 | Shibuya et al. |
| 4,086,041 | A | 4/1978 | Takada |
| 4,086,042 | A | 4/1978 | Young |
| RE29,627 | E | 5/1978 | Weatherston |
| 4,086,880 | A | 5/1978 | Bates |
| 4,099,405 | A | 7/1978 | Hauk et al. |
| 4,099,896 | A | 7/1978 | Glanvall |
| 4,104,010 | A | 8/1978 | Shibuya |
| 4,105,375 | A | 8/1978 | Schindelhauer |
| 4,112,881 | A | 9/1978 | Townsend |
| 4,118,157 | A | 10/1978 | Mayer |
| 4,118,158 | A | 10/1978 | Osaki |
| 4,127,369 | A | 11/1978 | Eiermann et al. |
| 4,132,512 | A | 1/1979 | Roberts |
| 4,135,864 | A | 1/1979 | Lassota |
| 4,135,865 | A | 1/1979 | Takada |
| 4,137,018 | A | 1/1979 | Brucken |
| 4,137,021 | A | 1/1979 | Lassota |
| 4,137,022 | A | 1/1979 | Lassota |
| 4,144,002 | A | 3/1979 | Shibuya et al. |
| 4,144,005 | A | 3/1979 | Brucken |
| 4,150,926 | A | 4/1979 | Eiermann |
| 4,152,100 | A | 5/1979 | Poole et al. |
| 4,174,195 | A | 11/1979 | Lassota |
| 4,174,931 | A | 11/1979 | Ishizuka |
| 4,179,250 | A | 12/1979 | Patel |
| 4,181,474 | A | 1/1980 | Shaw |
| 4,182,441 | A | 1/1980 | Strong et al. |
| 4,196,594 | A | 4/1980 | Abom |
| 4,198,195 | A | 4/1980 | Sakamaki et al. |
| 4,206,930 | A | 6/1980 | Thrane et al. |
| 4,209,287 | A | 6/1980 | Takada |
| 4,218,199 | A | 8/1980 | Eiermann |
| 4,219,314 | A | 8/1980 | Haggerty |
| 4,222,715 | A | 9/1980 | Ruf |
| 4,224,014 | A | 9/1980 | Glanvall |
| 4,227,755 | A | 10/1980 | Lundberg |
| 4,235,217 | A | 11/1980 | Cox |
| 4,236,875 | A | 12/1980 | Widdowson |
| 4,239,467 | A | 12/1980 | Glanvall |
| 4,242,878 | A | 1/1981 | Brinkerhoff |
| 4,244,680 | A | 1/1981 | Ishizuka et al. |
| 4,248,575 | A | 2/1981 | Watanabe et al. |
| 4,249,384 | A | 2/1981 | Harris |
| 4,251,190 | A | 2/1981 | Brown et al. |
| 4,252,511 | A | 2/1981 | Bowdish |
| 4,253,805 | A | 3/1981 | Steinwart et al. |
| 4,255,100 | A | 3/1981 | Linder |
| 4,274,816 | A | 6/1981 | Kobayashi et al. |
| 4,275,310 | A | 6/1981 | Summers et al. |
| 4,279,578 | A | 7/1981 | Kim et al. |
| 4,295,806 | A | 10/1981 | Tanaka et al. |

(56) References Cited

U.S. PATENT DOCUMENTS 4,299,547 A 11/1981 Simon
4,302,343 A 11/1981 Carswell et al.
4,306,845 A 12/1981 Gunderson
4,311,025 A 1/1982 Rice
4,312,181 A 1/1982 Clark
4,330,240 A 5/1982 Eslinger
4,331,002 A 5/1982 Ladusaw
4,332,534 A 6/1982 Becker
4,336,686 A 6/1982 Porter
RE30,994 E 7/1982 Shaw
4,340,578 A 7/1982 Erickson
4,342,547 A 8/1982 Yamada et al.
4,345,886 A 8/1982 Nakayama et al.
4,355,963 A 10/1982 Tanaka et al.
4,362,472 A 12/1982 Axelsson
4,362,473 A 12/1982 Zeilon
4,367,625 A 1/1983 Vitale
4,371,311 A 2/1983 Walsh
4,373,356 A 2/1983 Connor
4,373,880 A 2/1983 Tanaka et al.
4,373,881 A 2/1983 Matsushita
4,383,804 A 5/1983 Budzich
4,385,498 A 5/1983 Fawcett et al.
4,385,875 A 5/1983 Kanazawa
4,388,048 A 6/1983 Shaw et al.
4,389,172 A 6/1983 Griffith
4,390,322 A 6/1983 Budzich
4,391,573 A 7/1983 Tanaka et al.
4,395,208 A 7/1983 Maruyama et al.
4,396,361 A 8/1983 Fraser, Jr.
4,396,365 A 8/1983 Hayashi
4,397,618 A 8/1983 Stenzel
4,397,620 A 8/1983 Inagaki et al.
4,402,653 A 9/1983 Maruyama et al.
4,403,929 A 9/1983 Nagasaku et al.
4,408,968 A 10/1983 Inagaki et al.
4,415,320 A 11/1983 Maruyama et al.
4,419,059 A 12/1983 Anderson
4,419,865 A 12/1983 Szymaszek
4,423,710 A 1/1984 Williams
4,427,351 A 1/1984 Sano
4,431,356 A 2/1984 Lassota
4,431,387 A 2/1984 Lassota
4,437,818 A 3/1984 Weatherston
4,439,121 A 3/1984 Shaw
4,441,863 A 4/1984 Hotta et al.
4,445,344 A 5/1984 Ladusaw
4,447,196 A 5/1984 Nagasaku et al.
4,451,220 A 5/1984 Ito et al.
4,452,570 A 6/1984 Fujisaki et al.
4,452,571 A 6/1984 Koda et al.
4,455,825 A 6/1984 Pinto
4,457,671 A 7/1984 Watanabe
4,457,680 A 7/1984 Paget
4,459,090 A 7/1984 Maruyama et al.
4,459,817 A 7/1984 Inagaki et al.
4,460,309 A 7/1984 Walsh
4,460,319 A 7/1984 Ashikian
4,464,102 A 8/1984 Eiermann
4,470,375 A 9/1984 Showalter
4,472,119 A 9/1984 Roberts
4,472,121 A 9/1984 Tanaka et al.
4,472,122 A 9/1984 Yoshida et al.
4,477,233 A 10/1984 Schaefer
4,478,054 A 10/1984 Shaw et al.
4,478,553 A 10/1984 Leibowitz et al.
4,479,763 A 10/1984 Sakamaki et al.
4,484,873 A 11/1984 Inagaki et al.
4,486,158 A 12/1984 Maruyama et al.
4,487,029 A 12/1984 Hidaka et al.
4,487,561 A 12/1984 Eiermann
4,487,562 A 12/1984 Inagaki et al.
4,487,563 A 12/1984 Mori et al.
4,490,100 A 12/1984 Okazaki
4,494,386 A 1/1985 Edwards et al.
4,497,185 A 2/1985 Shaw
4,502,284 A 3/1985 Chrisoghilos
4,502,850 A 3/1985 Inagaki et al.
4,505,653 A 3/1985 Roberts
4,507,064 A 3/1985 Kocher et al.
4,508,491 A 4/1985 Schaefer
4,508,495 A 4/1985 Monden et al.
4,509,906 A 4/1985 Hattori et al.
4,512,728 A 4/1985 Nakano et al.
4,514,156 A 4/1985 Sakamaki et al.
4,514,157 A 4/1985 Nakamura et al.
4,515,513 A 5/1985 Hayase et al.
4,516,914 A 5/1985 Murphy et al.
4,518,330 A 5/1985 Asami et al.
4,519,748 A 5/1985 Murphy et al.
4,521,167 A 6/1985 Cavalleri et al.
4,524,599 A 6/1985 Bailey
4,531,899 A 7/1985 Sudbeck et al.
4,536,130 A 8/1985 Orlando et al.
4,536,141 A 8/1985 Maruyama
4,537,567 A 8/1985 Kawaguchi et al.
4,543,046 A 9/1985 Hasegawa
4,543,047 A 9/1985 Hasegawa
4,544,337 A 10/1985 Maruyama
4,544,338 A 10/1985 Takebayashi et al.
4,545,742 A 10/1985 Schaefer
4,548,549 A 10/1985 Murphy et al.
4,548,558 A 10/1985 Sakamaki et al.
4,553,903 A 11/1985 Ashikian
4,553,912 A 11/1985 Lassota
4,557,677 A 12/1985 Hasegawa
4,558,993 A 12/1985 Hori et al.
4,560,329 A 12/1985 Hirahara et al.
4,560,332 A 12/1985 Yokoyama et al.
4,561,829 A 12/1985 Iwata et al.
4,561,835 A 12/1985 Sakamaki et al.
4,564,344 A 1/1986 Sakamaki et al.
4,565,181 A 1/1986 August
4,565,498 A 1/1986 Schmid et al.
4,566,863 A 1/1986 Goto et al.
4,566,869 A 1/1986 Pandeya et al.
4,569,645 A 2/1986 Asami et al.
4,573,879 A 3/1986 Uetuji et al.
4,573,891 A 3/1986 Sakamaki et al.
4,577,472 A 3/1986 Pandeya et al.
4,580,949 A 4/1986 Maruyama et al.
4,580,950 A 4/1986 Sumikawa et al.
4,592,705 A 6/1986 Ueda et al.
4,594,061 A 6/1986 Terauchi
4,594,062 A 6/1986 Sakamaki et al.
4,595,347 A 6/1986 Sakamaki et al.
4,595,348 A 6/1986 Sakamaki et al.
4,598,559 A 7/1986 Tomayko et al.
4,599,059 A 7/1986 Hsu
4,601,643 A 7/1986 Seidel
4,601,644 A 7/1986 Gannaway
4,605,362 A 8/1986 Sturgeon et al.
4,608,002 A 8/1986 Hayase et al.
4,609,329 A 9/1986 Pillis et al.
4,610,602 A 9/1986 Schmid et al.
4,610,612 A 9/1986 Kocher
4,610,613 A 9/1986 Szymaszek
4,614,484 A 9/1986 Riegler
4,616,984 A 10/1986 Inagaki et al.
4,618,317 A 10/1986 Matsuzaki
4,619,112 A 10/1986 Colgate
4,620,837 A 11/1986 Sakamaki et al.
4,621,986 A 11/1986 Sudo
4,623,304 A 11/1986 Chikada et al.
4,624,630 A 11/1986 Hirahara et al.
4,626,180 A 12/1986 Tagawa et al.
4,627,802 A 12/1986 Draaisma et al.
4,629,403 A 12/1986 Wood
4,631,011 A 12/1986 Whitfield
4,636,152 A 1/1987 Kawaguchi et al.
4,636,153 A 1/1987 Ishizuka et al.
4,636,154 A 1/1987 Sugiyama et al.
4,639,198 A 1/1987 Gannaway
4,640,669 A 2/1987 Gannaway

(56) References Cited

U.S. PATENT DOCUMENTS 4,645,429 A 2/1987 Asami et al.
4,646,533 A 3/1987 Morita et al.
4,648,815 A 3/1987 Williams
4,648,818 A 3/1987 Sakamaki et al.
4,648,819 A 3/1987 Sakamaki et al.
4,657,493 A 4/1987 Sakamaki et al.
4,664,608 A 5/1987 Adams et al.
4,674,960 A 6/1987 Rando et al.
4,676,067 A 6/1987 Pinto
4,676,726 A 6/1987 Kawaguchi et al.
4,684,330 A 8/1987 Andersson et al.
4,701,110 A 10/1987 Iijima
4,704,069 A 11/1987 Kocher et al.
4,704,073 A 11/1987 Nomura et al.
4,704,076 A 11/1987 Kawaguchi et al.
4,706,353 A 11/1987 Zgliczynski et al.
4,708,598 A 11/1987 Sugita et al.
4,708,599 A 11/1987 Suzuki
4,710,111 A 12/1987 Kubo
4,711,617 A 12/1987 Asami et al.
4,712,986 A 12/1987 Nissen
4,715,435 A 12/1987 Foret
4,715,800 A 12/1987 Nishizawa et al.
4,716,347 A 12/1987 Fujimoto
4,717,316 A 1/1988 Muramatsu et al.
4,720,899 A 1/1988 Ando et al.
D294,361 S 2/1988 Williams
4,725,210 A 2/1988 Suzuki et al.
4,726,739 A 2/1988 Saitou et al.
4,726,740 A 2/1988 Suzuki et al.
4,728,273 A 3/1988 Linder et al.
4,730,996 A 3/1988 Akatsuchi et al.
4,737,088 A 4/1988 Taniguchi et al.
4,739,632 A 4/1988 Fry
4,743,183 A 5/1988 Irie et al.
4,743,184 A 5/1988 Sumikawa et al.
4,746,277 A 5/1988 Glanvall
4,747,276 A 5/1988 Kakinuma
4,758,138 A 7/1988 Timuska
4,759,698 A 7/1988 Nissen
4,762,471 A 8/1988 Asanuma et al.
4,764,095 A 8/1988 Fickelscher
4,764,097 A 8/1988 Hirahara et al.
4,776,074 A 10/1988 Suzuki et al.
4,780,067 A 10/1988 Suzuki et al.
4,781,542 A 11/1988 Ozu et al.
4,781,545 A 11/1988 Yokomizo et al.
4,781,551 A 11/1988 Tanaka
4,782,569 A 11/1988 Wood
4,785,640 A 11/1988 Naruse
4,793,779 A 12/1988 Schabert et al.
4,793,791 A 12/1988 Kokuryo
4,794,752 A 1/1989 Redderson
4,795,325 A 1/1989 Kishi et al.
4,801,251 A 1/1989 Nakajima et al.
4,815,953 A 3/1989 Iio
4,819,440 A 4/1989 Nakajima et al.
4,822,263 A 4/1989 Nakajima et al.
4,826,408 A 5/1989 Inoue et al.
4,826,409 A 5/1989 Kohayakawa et al.
4,828,463 A 5/1989 Nishizawa et al.
4,828,466 A 5/1989 Kim
4,830,590 A 5/1989 Sumikawa et al.
4,834,627 A 5/1989 Gannaway
4,834,634 A 5/1989 Ono
4,850,830 A 7/1989 Okoma et al.
4,859,154 A 8/1989 Aihara et al.
4,859,162 A 8/1989 Cox
4,859,164 A 8/1989 Shimomura
4,860,704 A 8/1989 Slaughter
4,861,372 A 8/1989 Shimomura
4,867,658 A 9/1989 Sugita et al.
4,877,380 A 10/1989 Glanvall
4,877,384 A 10/1989 Chu
4,881,879 A 11/1989 Ortiz
4,884,956 A 12/1989 Fujitani et al.
4,889,475 A 12/1989 Gannaway et al.
4,895,501 A 1/1990 Bagepalli
4,902,205 A 2/1990 DaCosta et al.
4,904,302 A 2/1990 Shimomura
4,909,716 A 3/1990 Orosz et al.
4,911,624 A 3/1990 Bagepalli
4,915,554 A 4/1990 Serizawa et al.
4,916,914 A 4/1990 Short
4,925,378 A 5/1990 Ushiku et al.
4,929,159 A 5/1990 Hayase et al.
4,929,161 A 5/1990 Aoki et al.
4,932,844 A 6/1990 Glanvall
4,932,851 A 6/1990 Kim
4,934,454 A 6/1990 Vandyke et al.
4,934,656 A 6/1990 Groves et al.
4,934,912 A 6/1990 Iio et al.
4,941,810 A 7/1990 Iio et al.
4,943,216 A 7/1990 Iio
4,943,217 A 7/1990 Nuber
4,944,663 A 7/1990 Iizuka et al.
4,946,362 A 8/1990 Soderlund et al.
4,955,414 A 9/1990 Fujii
4,960,371 A 10/1990 Bassett
4,968,228 A 11/1990 Da Costa et al.
4,968,231 A 11/1990 Zimmern et al.
4,969,832 A 11/1990 Fry
4,971,529 A 11/1990 Gannaway et al.
4,975,031 A 12/1990 Bagepalli et al.
4,978,279 A 12/1990 Rodgers
4,978,287 A 12/1990 Da Costa
4,979,879 A 12/1990 Da Costa
4,983,108 A 1/1991 Kawaguchi et al.
4,990,073 A 2/1991 Kudo et al.
4,993,923 A 2/1991 Daeyaert
4,997,352 A 3/1991 Fujiwara et al.
5,001,924 A 3/1991 Walter et al.
5,004,408 A 4/1991 Da Costa
5,004,410 A 4/1991 Da Costa
5,006,051 A 4/1991 Hattori
5,007,331 A 4/1991 Greiner et al.
5,007,813 A 4/1991 Da Costa
5,009,577 A 4/1991 Hayase et al.
5,009,583 A 4/1991 Carlsson et al.
5,012,896 A 5/1991 Da Costa
5,015,161 A 5/1991 Amin et al.
5,015,164 A 5/1991 Kudou et al.
5,018,948 A 5/1991 Sjoholm et al.
D317,313 S 6/1991 Yoshida et al.
5,020,975 A 6/1991 Aihara
5,022,146 A 6/1991 Gannaway et al.
5,024,588 A 6/1991 Lassota
5,026,257 A 6/1991 Aihara et al.
5,027,602 A 7/1991 Glen et al.
5,027,606 A 7/1991 Short
5,030,066 A 7/1991 Aihara et al.
5,030,073 A 7/1991 Serizawa et al.
5,035,584 A 7/1991 Akaike et al.
5,037,282 A 8/1991 Englund
5,039,287 A 8/1991 Da Costa
5,039,289 A 8/1991 Eiermann et al.
5,039,900 A 8/1991 Nashiki et al.
5,044,908 A 9/1991 Kawade
5,044,909 A 9/1991 Lindstrom
5,046,932 A 9/1991 Hoffmann
5,049,052 A 9/1991 Aihara
5,050,233 A 9/1991 Hitosugi et al.
5,051,076 A 9/1991 Okoma et al.
5,055,015 A 10/1991 Furukawa
5,055,016 A 10/1991 Kawade
5,062,779 A 11/1991 Da Costa
5,063,750 A 11/1991 Englund
5,067,557 A 11/1991 Nuber et al.
5,067,878 A 11/1991 Da Costa
5,067,884 A 11/1991 Lee
5,069,607 A 12/1991 Da Costa
5,074,761 A 12/1991 Hirooka et al.
5,076,768 A 12/1991 Ruf et al.
5,080,562 A 1/1992 Barrows et al.

(56) References Cited

U.S. PATENT DOCUMENTS

| | | | |
|---|---|---|---|
| 5,087,170 | A | 2/1992 | Kousokabe et al. |
| 5,087,172 | A | 2/1992 | Ferri et al. |
| 5,088,892 | A | 2/1992 | Weingold et al. |
| 5,090,879 | A | 2/1992 | Weinbrecht |
| 5,090,882 | A | 2/1992 | Serizawa et al. |
| 5,092,130 | A | 3/1992 | Nagao et al. |
| 5,098,266 | A | 3/1992 | Takimoto et al. |
| 5,102,317 | A | 4/1992 | Okoma et al. |
| 5,104,297 | A | 4/1992 | Sekiguchi et al. |
| 5,108,269 | A | 4/1992 | Glanvall |
| 5,109,764 | A | 5/1992 | Kappel et al. |
| 5,116,208 | A | 5/1992 | Parme |
| 5,120,207 | A | 6/1992 | Soderlund |
| 5,125,804 | A | 6/1992 | Akaike et al. |
| 5,131,826 | A | 7/1992 | Boussicault |
| 5,133,652 | A | 7/1992 | Abe et al. |
| 5,135,368 | A | 8/1992 | Amin et al. |
| 5,135,370 | A | 8/1992 | Iio |
| 5,139,391 | A | 8/1992 | Carrouset |
| 5,144,805 | A | 9/1992 | Nagao et al. |
| 5,144,810 | A | 9/1992 | Nagao et al. |
| 5,151,015 | A | 9/1992 | Bauer et al. |
| 5,151,021 | A | 9/1992 | Fujiwara et al. |
| 5,152,156 | A | 10/1992 | Tokairin |
| 5,154,063 | A | 10/1992 | Nagao et al. |
| 5,169,299 | A | 12/1992 | Gannaway |
| 5,178,514 | A | 1/1993 | Damiral |
| 5,179,839 | A | 1/1993 | Bland |
| 5,184,944 | A | 2/1993 | Scarfone |
| 5,186,956 | A | 2/1993 | Tanino et al. |
| 5,188,524 | A | 2/1993 | Bassine |
| 5,203,679 | A | 4/1993 | Yun et al. |
| 5,203,686 | A | 4/1993 | Scheldorf et al. |
| 5,207,568 | A | 5/1993 | Szymaszek |
| 5,217,681 | A | 6/1993 | Wedellsborg et al. |
| 5,218,762 | A | 6/1993 | Netto Da Costa |
| 5,221,191 | A | 6/1993 | Leyderman et al. |
| 5,222,879 | A | 6/1993 | Kapadia |
| 5,222,884 | A | 6/1993 | Kapadia |
| 5,222,885 | A | 6/1993 | Cooksey |
| 5,226,797 | A | 7/1993 | Da Costa |
| 5,230,616 | A | 7/1993 | Serizawa et al. |
| 5,232,349 | A | 8/1993 | Kimura et al. |
| 5,233,954 | A | 8/1993 | Chomyszak |
| 5,236,318 | A | 8/1993 | Richardson, Jr. |
| 5,239,833 | A | 8/1993 | Fineblum |
| 5,240,386 | A | 8/1993 | Amin et al. |
| 5,242,280 | A | 9/1993 | Fujio |
| 5,244,366 | A | 9/1993 | Delmotte |
| 5,251,456 | A | 10/1993 | Nagao et al. |
| 5,256,042 | A | 10/1993 | McCullough et al. |
| 5,259,740 | A | 11/1993 | Youn |
| 5,264,820 | A | 11/1993 | Kovacich et al. |
| 5,267,839 | A | 12/1993 | Kimura et al. |
| 5,273,412 | A | 12/1993 | Zwaans |
| 5,284,426 | A | 2/1994 | Strikis et al. |
| 5,293,749 | A | 3/1994 | Nagao et al. |
| 5,293,752 | A | 3/1994 | Nagao et al. |
| 5,302,095 | A | 4/1994 | Richardson, Jr. |
| 5,302,096 | A | 4/1994 | Cavalleri |
| 5,304,033 | A | 4/1994 | Tang |
| 5,304,043 | A | 4/1994 | Shilling |
| 5,306,128 | A | 4/1994 | Lee |
| 5,308,125 | A | 5/1994 | Anderson, Jr. |
| 5,310,326 | A | 5/1994 | Gui et al. |
| 5,311,739 | A | 5/1994 | Clark |
| 5,314,318 | A | 5/1994 | Hata et al. |
| 5,316,455 | A | 5/1994 | Yoshimura et al. |
| 5,322,420 | A | 6/1994 | Yannascoli |
| 5,322,424 | A | 6/1994 | Fujio |
| 5,322,427 | A | 6/1994 | Hsin-Tau |
| 5,328,344 | A | 7/1994 | Sato et al. |
| 5,334,004 | A | 8/1994 | Lefevre et al. |
| 5,336,059 | A | 8/1994 | Rowley |
| 5,337,572 | A | 8/1994 | Longsworth |
| 5,346,376 | A | 9/1994 | Bookbinder et al. |
| 5,348,455 | A | 9/1994 | Herrick et al. |
| 5,352,098 | A | 10/1994 | Hood |
| 5,365,743 | A | 11/1994 | Nagao et al. |
| 5,366,703 | A | 11/1994 | Liechti et al. |
| 5,368,456 | A | 11/1994 | Hirayama et al. |
| 5,370,506 | A | 12/1994 | Fujii et al. |
| 5,370,511 | A | 12/1994 | Strikis et al. |
| 5,372,483 | A | 12/1994 | Kimura et al. |
| 5,374,171 | A | 12/1994 | Cooksey |
| 5,374,172 | A | 12/1994 | Edwards |
| 5,380,165 | A | 1/1995 | Kimura et al. |
| 5,380,168 | A | 1/1995 | Kimura et al. |
| 5,383,773 | A | 1/1995 | Richardson, Jr. |
| 5,383,774 | A | 1/1995 | Toyama et al. |
| 5,385,450 | A | 1/1995 | Kimura et al. |
| 5,385,451 | A | 1/1995 | Fujii et al. |
| 5,385,458 | A | 1/1995 | Chu |
| 5,393,205 | A | 2/1995 | Fujii et al. |
| 5,394,709 | A | 3/1995 | Lorentzen |
| 5,395,326 | A | 3/1995 | Haber et al. |
| 5,397,215 | A | 3/1995 | Spear et al. |
| 5,397,218 | A | 3/1995 | Fujii et al. |
| 5,399,076 | A | 3/1995 | Matsuda et al. |
| 5,411,385 | A | 5/1995 | Eto et al. |
| 5,411,387 | A | 5/1995 | Lundin et al. |
| 5,419,685 | A | 5/1995 | Fujii et al. |
| 5,427,068 | A | 6/1995 | Palmer |
| 5,427,506 | A | 6/1995 | Fry et al. |
| 5,433,179 | A | 7/1995 | Wittry |
| 5,437,251 | A | 8/1995 | Anglim et al. |
| 5,439,358 | A | 8/1995 | Weinbrecht |
| 5,442,923 | A | 8/1995 | Bareiss |
| 5,443,376 | A | 8/1995 | Choi |
| 5,447,033 | A | 9/1995 | Nagao et al. |
| 5,447,422 | A | 9/1995 | Aoki et al. |
| 5,472,327 | A | 12/1995 | Strikis et al. |
| 5,477,688 | A | 12/1995 | Ban et al. |
| 5,479,887 | A | 1/1996 | Chen |
| 5,489,199 | A | 2/1996 | Palmer |
| 5,490,771 | A | 2/1996 | Wehber et al. |
| 5,494,412 | A | 2/1996 | Shin |
| 5,494,423 | A | 2/1996 | Ishiyama et al. |
| 5,499,515 | A | 3/1996 | Kawamura et al. |
| 5,501,579 | A | 3/1996 | Kimura et al. |
| 5,503,539 | A | 4/1996 | Nakajima et al. |
| 5,503,540 | A | 4/1996 | Kim |
| 5,511,389 | A | 4/1996 | Bush et al. |
| 5,518,381 | A | 5/1996 | Matsunaga et al. |
| 5,522,235 | A | 6/1996 | Matsuoka et al. |
| 5,522,356 | A | 6/1996 | Palmer |
| 5,529,469 | A | 6/1996 | Bushnell et al. |
| 5,536,149 | A | 7/1996 | Fujii et al. |
| 5,542,831 | A | 8/1996 | Scarfone |
| 5,542,832 | A | 8/1996 | Sone et al. |
| 5,544,400 | A | 8/1996 | Wells |
| 5,545,021 | A | 8/1996 | Fukuoka et al. |
| 5,556,270 | A | 9/1996 | Komine et al. |
| 5,564,280 | A | 10/1996 | Schilling et al. |
| 5,564,910 | A | 10/1996 | Huh |
| 5,564,916 | A | 10/1996 | Yamamoto et al. |
| 5,564,917 | A | 10/1996 | Leyderman et al. |
| 5,568,796 | A | 10/1996 | Palmer |
| 5,577,903 | A | 11/1996 | Yamamoto |
| 5,580,231 | A | 12/1996 | Yasui |
| 5,582,020 | A | 12/1996 | Scaringe et al. |
| 5,586,443 | A | 12/1996 | Lewis |
| 5,586,876 | A | 12/1996 | Yasnnascoli et al. |
| 5,591,018 | A | 1/1997 | Takeuchi et al. |
| 5,591,023 | A | 1/1997 | Nakamura et al. |
| 5,597,287 | A | 1/1997 | Helmick |
| 5,605,447 | A | 2/1997 | Kim et al. |
| 5,616,017 | A | 4/1997 | Iizuka et al. |
| 5,616,018 | A | 4/1997 | Ma |
| 5,616,019 | A | 4/1997 | Hattori et al. |
| 5,622,149 | A | 4/1997 | Wittry |
| 5,626,463 | A | 5/1997 | Kimura et al. |
| 5,639,208 | A | 6/1997 | Theis |
| 5,640,938 | A | 6/1997 | Craze |

(56) References Cited

U.S. PATENT DOCUMENTS 5,641,273 A 6/1997 Moseley
5,641,280 A 6/1997 Timuska
5,653,585 A 8/1997 Fresco
5,660,540 A 8/1997 Kang
5,662,463 A 9/1997 Mirzoev et al.
5,664,941 A 9/1997 Bearint
5,667,372 A 9/1997 Hwang et al.
5,672,054 A 9/1997 Cooper et al.
5,674,053 A 10/1997 Paul et al.
5,674,061 A 10/1997 Motegi et al.
5,676,535 A 10/1997 Bushnell
5,678,164 A 10/1997 Berthelemy et al.
5,678,987 A 10/1997 Timuska
5,685,703 A 11/1997 Fukuoka et al.
5,690,475 A 11/1997 Yamada et al.
5,692,887 A 12/1997 Krueger et al.
5,697,763 A 12/1997 Kitchener
5,699,672 A 12/1997 Foerster et al.
5,707,223 A 1/1998 Englund et al.
5,713,732 A 2/1998 Riney
5,727,936 A 3/1998 Eriksson et al.
5,733,112 A 3/1998 Kang
5,738,497 A 4/1998 Hensley
5,758,613 A 6/1998 Edelmayer et al.
5,769,610 A 6/1998 Paul et al.
5,775,882 A 7/1998 Kiyokawa et al.
5,775,883 A 7/1998 Hattori et al.
5,782,618 A 7/1998 Nishikawa et al.
5,788,472 A 8/1998 Lee
5,795,136 A 8/1998 Olsaker et al.
5,800,142 A 9/1998 Motegi et al.
5,820,349 A 10/1998 Caillat
5,820,357 A 10/1998 Itoh
5,823,755 A 10/1998 Wilson et al.
5,829,960 A 11/1998 Dreiman
5,839,270 A 11/1998 Jirnov et al.
5,853,288 A 12/1998 Motegi et al.
5,860,801 A 1/1999 Timuska
5,863,191 A 1/1999 Motegi et al.
5,873,261 A 2/1999 Bae
5,875,744 A 3/1999 Vallejos
5,921,106 A 7/1999 Girault et al.
5,947,710 A 9/1999 Cooper et al.
5,947,711 A 9/1999 Myers et al.
5,950,452 A 9/1999 Sakitani et al.
5,951,269 A 9/1999 Sasa et al.
5,951,273 A 9/1999 Matsunaga et al.
5,957,676 A 9/1999 Peeters
5,961,297 A 10/1999 Haga et al.
5,980,222 A 11/1999 Fry
6,017,186 A 1/2000 Hoeger et al.
6,017,203 A 1/2000 Sugawa et al.
6,027,322 A 2/2000 Ferentinos et al.
6,032,720 A 3/2000 Riegger et al.
6,039,552 A 3/2000 Mimura
6,045,343 A 4/2000 Liou
6,053,716 A 4/2000 Riegger et al.
6,071,103 A 6/2000 Hirano et al.
6,077,058 A 6/2000 Saitou et al.
6,079,965 A 6/2000 Delmotte
6,086,341 A 7/2000 Fukuhara et al.
6,102,682 A 8/2000 Kim
6,102,683 A 8/2000 Kirsten
6,106,242 A 8/2000 Sung
6,109,901 A 8/2000 Nakamura et al.
6,117,916 A 9/2000 Allam et al.
6,132,195 A 10/2000 Ikoma et al.
6,139,296 A 10/2000 Okajima et al.
6,142,756 A 11/2000 Hashimoto et al.
6,146,774 A 11/2000 Okamoto et al.
6,149,408 A 11/2000 Holt
6,164,263 A 12/2000 Saint-Hilaire et al.
6,164,934 A 12/2000 Niihara et al.
6,176,687 B1 1/2001 Kim et al.
6,195,889 B1 3/2001 Gannaway
6,205,788 B1 3/2001 Warren
6,205,960 B1 3/2001 Vallejos
6,210,130 B1 4/2001 Kakuda et al.
6,213,732 B1 4/2001 Fujio
6,220,825 B1 4/2001 Myers et al.
6,225,706 B1 5/2001 Keller
6,230,503 B1 5/2001 Spletzer
6,233,955 B1 5/2001 Egara
6,241,496 B1 6/2001 Kim et al.
6,250,899 B1 6/2001 Lee et al.
6,261,073 B1 7/2001 Kumazawa
6,270,329 B1 8/2001 Oshima et al.
6,273,694 B1 8/2001 Vading
6,280,168 B1 8/2001 Matsumoto et al.
6,283,728 B1 9/2001 Tomoiu
6,283,737 B1 9/2001 Kazakis et al.
6,287,098 B1 9/2001 Ahn et al.
6,287,100 B1 9/2001 Achtelik et al.
6,290,472 B2 9/2001 Gannaway
6,290,882 B1 9/2001 Maus et al.
6,299,425 B1 10/2001 Hirano et al.
6,302,664 B1 10/2001 Kazakis et al.
6,309,196 B1 10/2001 Jones et al.
6,312,233 B1 11/2001 Ahn et al.
6,312,240 B1 11/2001 Weinbrecht
6,318,981 B1 11/2001 Ebara et al.
6,328,540 B1 12/2001 Kosters et al.
6,328,545 B1 12/2001 Kazakis et al.
6,336,336 B1 1/2002 Kawaminami et al.
6,336,794 B1 1/2002 Kim
6,336,797 B1 1/2002 Kazakis et al.
6,336,799 B1 1/2002 Matsumoto et al.
6,336,800 B1 1/2002 Kim et al.
6,354,262 B2 3/2002 Wade
6,361,306 B1 3/2002 Hinzpeter et al.
6,371,745 B1 4/2002 Bassine
6,379,480 B1 4/2002 Girault et al.
6,398,520 B2 6/2002 Han
6,409,488 B1 6/2002 Ikoma et al.
6,409,490 B1 6/2002 Nemit, Jr. et al.
6,413,061 B1 7/2002 Esumi et al.
6,416,302 B1 7/2002 Achtelik et al.
6,418,927 B1 7/2002 Kullik
6,425,732 B1 7/2002 Rouse et al.
6,428,284 B1 8/2002 Vaisman
6,435,850 B2 8/2002 Sunaga et al.
6,440,105 B1 8/2002 Menne
6,447,268 B1 9/2002 Abramopaulos
6,447,274 B1 9/2002 Horihata et al.
6,461,119 B1 10/2002 Timuska
6,478,560 B1 11/2002 Bowman
6,488,488 B2 12/2002 Achtelik et al.
6,524,086 B2 2/2003 Matsumoto et al.
6,526,751 B1 3/2003 Moeckel
6,533,558 B1 3/2003 Matsumoto et al.
6,547,545 B1 4/2003 Jonsson et al.
6,550,442 B2 4/2003 Garcia
6,557,345 B1 5/2003 Moeckel
6,582,183 B2 6/2003 Eveker et al.
6,589,034 B2 7/2003 Vorwerk et al.
6,592,347 B2 7/2003 Matsumoto et al.
6,595,767 B1 7/2003 Hinzpeter et al.
6,599,113 B1 7/2003 Lee
6,616,428 B2 9/2003 Ebara et al.
6,651,458 B1 11/2003 Ebara et al.
6,658,885 B1 12/2003 Zhou et al.
6,669,450 B2 12/2003 Jeong
6,672,063 B1 1/2004 Proeschel
6,672,263 B2 1/2004 Vallejos
6,676,393 B2 1/2004 Matsumoto et al.
6,685,441 B2 2/2004 Nam
6,692,242 B2 2/2004 Matsumoto et al.
6,716,007 B2 4/2004 Kim et al.
6,722,867 B2 4/2004 Murata
6,732,542 B2 5/2004 Yamasaki et al.
6,733,723 B2 5/2004 Choi et al.
6,745,767 B2 6/2004 Kullik et al.
6,746,223 B2 6/2004 Manole
6,748,754 B2 6/2004 Matsumoto et al.

(56) References Cited

U.S. PATENT DOCUMENTS

| | | | |
|---|---|---|---|
| 6,749,405 | B2 | 6/2004 | Bassine |
| 6,749,416 | B2 | 6/2004 | Arndt et al. |
| 6,751,941 | B2 | 6/2004 | Edelman et al. |
| 6,752,605 | B2 | 6/2004 | Dreiman et al. |
| 6,764,279 | B2 | 7/2004 | Meshenky |
| 6,769,880 | B1 | 8/2004 | Hogan et al. |
| 6,769,890 | B2 | 8/2004 | Vigano' et al. |
| 6,796,773 | B1 | 9/2004 | Choi et al. |
| 6,799,956 | B1 | 10/2004 | Yap et al. |
| 6,813,989 | B2 | 11/2004 | Santiyanont |
| 6,817,185 | B2 | 11/2004 | Coney et al. |
| 6,824,367 | B2 | 11/2004 | Matsumoto et al. |
| 6,824,370 | B2 | 11/2004 | Takatsu |
| 6,827,564 | B2 | 12/2004 | Becker |
| 6,854,442 | B2 | 2/2005 | Satapathy et al. |
| 6,858,067 | B2 | 2/2005 | Burns et al. |
| 6,860,724 | B2 | 3/2005 | Cho et al. |
| 6,877,951 | B1 | 4/2005 | Awdalla |
| 6,881,044 | B1 | 4/2005 | Thomas, Jr. et al. |
| 6,884,054 | B2 | 4/2005 | Shimada |
| 6,892,454 | B2 | 5/2005 | Matsumoto et al. |
| 6,892,548 | B2 | 5/2005 | Choi et al. |
| 6,896,497 | B2 | 5/2005 | Kuo |
| 6,907,746 | B2 | 6/2005 | Sato et al. |
| 6,910,872 | B2 | 6/2005 | Cho et al. |
| 6,915,651 | B2 | 7/2005 | Hille et al. |
| 6,929,455 | B2 | 8/2005 | Dreiman et al. |
| 6,931,866 | B2 | 8/2005 | Sato et al. |
| 6,932,588 | B2 | 8/2005 | Choi et al. |
| 6,935,853 | B2 | 8/2005 | Lee et al. |
| 6,962,486 | B2 | 11/2005 | Lee et al. |
| 6,974,314 | B2 | 12/2005 | Matsumoto et al. |
| 6,983,606 | B2 | 1/2006 | Brown |
| 7,008,199 | B2 | 3/2006 | Matsumoto et al. |
| 7,011,183 | B2 | 3/2006 | Picouet |
| 7,028,476 | B2 | 4/2006 | Proeschel |
| 7,029,252 | B2 | 4/2006 | Masuda et al. |
| 7,040,880 | B2 | 5/2006 | Hasegawa et al. |
| 7,059,842 | B2 | 6/2006 | Lee et al. |
| 7,070,395 | B2 | 7/2006 | Lee et al. |
| 7,083,689 | B2 | 8/2006 | Park |
| 7,101,161 | B2 | 9/2006 | Matsumoto et al. |
| 7,104,764 | B2 | 9/2006 | Lee et al. |
| 7,128,540 | B2 | 10/2006 | Tadano et al. |
| 7,131,821 | B2 | 11/2006 | Matumoto et al. |
| 7,134,845 | B2 | 11/2006 | Lee et al. |
| 7,140,844 | B2 | 11/2006 | Lee et al. |
| 7,144,224 | B2 | 12/2006 | Kim et al. |
| 7,150,602 | B2 | 12/2006 | Choi et al. |
| 7,150,608 | B2 | 12/2006 | Cho et al. |
| 7,153,109 | B2 | 12/2006 | Cho et al. |
| 7,168,257 | B2 | 1/2007 | Matsumoto et al. |
| 7,172,016 | B2 | 2/2007 | Meshenky et al. |
| 7,174,725 | B2 | 2/2007 | Tadano et al. |
| 7,175,401 | B2 | 2/2007 | Cho et al. |
| 7,186,100 | B2 | 3/2007 | Cho et al. |
| 7,189,068 | B2 | 3/2007 | Thomas, Jr. et al. |
| 7,191,738 | B2 | 3/2007 | Shkolnik |
| 7,192,259 | B2 | 3/2007 | Lee |
| 7,195,451 | B1 | 3/2007 | Awdalla |
| 7,217,110 | B2 | 5/2007 | Dreiman |
| 7,220,108 | B2 | 5/2007 | Cho et al. |
| 7,223,081 | B2 | 5/2007 | Lee et al. |
| 7,223,082 | B2 | 5/2007 | Sato et al. |
| 7,226,275 | B2 | 6/2007 | Lee et al. |
| 7,232,291 | B2 | 6/2007 | Choi et al. |
| 7,241,239 | B2 | 7/2007 | Tanaka |
| 7,252,487 | B2 | 8/2007 | Sato |
| 7,270,521 | B2 | 9/2007 | Sung et al. |
| 7,281,914 | B2 | 10/2007 | Lee |
| 7,284,372 | B2 | 10/2007 | Crow |
| 7,290,994 | B2 | 11/2007 | Kitaichi et al. |
| 7,293,966 | B2 | 11/2007 | Cho et al. |
| 7,293,970 | B2 | 11/2007 | Sato |
| 7,300,259 | B2 | 11/2007 | Cho et al. |
| 7,302,803 | B2 | 12/2007 | Tadano et al. |
| 7,309,217 | B2 | 12/2007 | Cho et al. |
| 7,322,809 | B2 | 1/2008 | Kitaura et al. |
| 7,334,428 | B2 | 2/2008 | Holdsworth |
| 7,344,367 | B2 | 3/2008 | Manole |
| 7,347,676 | B2 | 3/2008 | Kopelowicz |
| 7,354,250 | B2 | 4/2008 | Sung et al. |
| 7,354,251 | B2 | 4/2008 | Cho et al. |
| 7,361,005 | B2 | 4/2008 | Sato |
| 7,363,696 | B2 | 4/2008 | Kimura et al. |
| 7,377,755 | B2 | 5/2008 | Cho |
| 7,377,956 | B2 | 5/2008 | Cheney, Jr. et al. |
| 7,380,446 | B2 | 6/2008 | Baeuerle et al. |
| 7,381,039 | B2 | 6/2008 | Sato |
| 7,381,040 | B2 | 6/2008 | Ogasawara et al. |
| 7,381,356 | B2 | 6/2008 | Shimada et al. |
| 7,390,162 | B2 | 6/2008 | Awdalla |
| 7,399,170 | B2 | 7/2008 | Aya et al. |
| 7,401,475 | B2 | 7/2008 | Hugenroth et al. |
| 7,431,571 | B2 | 10/2008 | Kim et al. |
| 7,435,062 | B2 | 10/2008 | Tadano et al. |
| 7,435,063 | B2 | 10/2008 | Tadano et al. |
| 7,438,540 | B2 | 10/2008 | Sato |
| 7,438,541 | B2 | 10/2008 | Aya et al. |
| 7,458,791 | B2 | 12/2008 | Radziwill |
| 7,462,021 | B2 | 12/2008 | Ebara et al. |
| 7,481,631 | B2 | 1/2009 | Park et al. |
| 7,481,635 | B2 | 1/2009 | Nishikawa et al. |
| 7,488,165 | B2 | 2/2009 | Ogasawara et al. |
| 7,491,042 | B2 | 2/2009 | Matsumoto et al. |
| 7,507,079 | B2 | 3/2009 | Fujisaki |
| 7,510,381 | B2 | 3/2009 | Beckmann et al. |
| 7,520,733 | B2 | 4/2009 | Matumoto et al. |
| 7,524,174 | B2 | 4/2009 | Nishikawa et al. |
| 7,540,727 | B2 | 6/2009 | Byun et al. |
| 7,556,485 | B2 | 7/2009 | Kanayama et al. |
| 7,563,080 | B2 | 7/2009 | Masuda |
| 7,563,085 | B2 | 7/2009 | Sakaniwa et al. |
| 7,566,204 | B2 | 7/2009 | Ogasawara et al. |
| 7,572,116 | B2 | 8/2009 | Nishikawa et al. |
| 7,581,937 | B2 | 9/2009 | Nishikawa et al. |
| 7,581,941 | B2 | 9/2009 | Harada et al. |
| 7,584,613 | B1 | 9/2009 | Crow |
| 7,585,162 | B2 | 9/2009 | Nishikawa et al. |
| 7,585,163 | B2 | 9/2009 | Nishikawa et al. |
| 7,588,427 | B2 | 9/2009 | Bae et al. |
| 7,588,428 | B2 | 9/2009 | Masuda |
| 7,597,547 | B2 | 10/2009 | Ha et al. |
| 7,600,986 | B2 | 10/2009 | Matumoto et al. |
| 7,604,466 | B2 | 10/2009 | Dreiman et al. |
| 7,607,904 | B2 | 10/2009 | Masuda |
| 7,611,341 | B2 | 11/2009 | Byun et al. |
| 7,611,342 | B2 | 11/2009 | Matsumoto et al. |
| 7,611,343 | B2 | 11/2009 | Matsumoto et al. |
| 7,618,242 | B2 | 11/2009 | Higuchi et al. |
| 7,621,729 | B2 | 11/2009 | Matsumoto et al. |
| 7,641,454 | B2 | 1/2010 | Ueda et al. |
| 7,650,871 | B2 | 1/2010 | See |
| 7,658,599 | B2 | 2/2010 | Lee et al. |
| 7,661,940 | B2 | 2/2010 | Maeng |
| 7,665,973 | B2 | 2/2010 | Hwang |
| 7,681,889 | B2 | 3/2010 | Tsuboi et al. |
| 7,690,906 | B2 | 4/2010 | Tado et al. |
| 7,703,433 | B2 | 4/2010 | Webster |
| 7,713,040 | B2 | 5/2010 | Kimura et al. |
| 7,717,686 | B2 | 5/2010 | Kondo et al. |
| 7,722,343 | B2 | 5/2010 | Hirayama |
| 7,726,960 | B2 | 6/2010 | Oui et al. |
| 7,748,968 | B2 | 7/2010 | Morozumi |
| 7,753,663 | B2 | 7/2010 | Shimizu et al. |
| 7,762,792 | B2 | 7/2010 | Tadano et al. |
| 7,768,172 | B2 | 8/2010 | Takahata et al. |
| 7,775,044 | B2 | 8/2010 | Julien et al. |
| 7,775,782 | B2 | 8/2010 | Choi et al. |
| 7,780,426 | B2 | 8/2010 | Cho et al. |
| 7,780,427 | B2 | 8/2010 | Ueda et al. |
| 7,789,641 | B2 | 9/2010 | Masuda |
| 7,793,516 | B2 | 9/2010 | Farrow et al. |
| 7,798,787 | B2 | 9/2010 | Matumoto et al. |

(56) References Cited

U.S. PATENT DOCUMENTS

| | | | |
|---|---|---|---|
| 7,798,791 | B2 | 9/2010 | Byun et al. |
| 7,802,426 | B2 | 9/2010 | Bollinger |
| 7,802,972 | B2 | 9/2010 | Shimizu et al. |
| 7,806,672 | B2 | 10/2010 | Furusho et al. |
| 7,837,449 | B2 | 11/2010 | Tadano et al. |
| 7,841,838 | B2 | 11/2010 | Kawabe et al. |
| 7,854,602 | B2 | 12/2010 | Bae et al. |
| 7,871,252 | B2 | 1/2011 | Bae et al. |
| 7,874,155 | B2 | 1/2011 | McBride et al. |
| 8,240,142 | B2 | 8/2012 | Fong et al. |
| 2011/0023814 | A1 | 2/2011 | Shkolnik et al. |
| 2011/0023977 | A1 | 2/2011 | Fong et al. |
| 2012/0051958 | A1 | 3/2012 | Santos et al. |

FOREIGN PATENT DOCUMENTS

| | | |
|---|---|---|
| DE | 3611395 | 10/1987 |
| JP | 61-277889 | 12/1986 |
| JP | 02-140489 | 5/1990 |
| JP | 2009-185680 | 8/2009 |
| JP | 2009-185680 A | 8/2009 |
| SU | 1150401 | 4/1985 |
| WO | WO 95/18945 | 7/1995 |
| WO | WO9943926 | 9/1999 |
| WO | WO 01/20167 | 3/2001 |
| WO | WO2010017199 | 2/2010 |
| WO | WO 2012/030741 | 3/2012 |

OTHER PUBLICATIONS

Kreith, Frank, "The CRC Handbook of Thermal Engineering", Library of Congress Cataloging-in-Publication Data, 2000 by CRC Press LLC.

Avallone, Eugene A., et al., "Marks' Standard Handbook for Mechanical Engineering", Eleventh Edition, 2007, 1996, 1987, 1978 by the McGraw-Hill Companies, Inc.

"Basic Refrigeration and Air Conditioning", Third Edition, 2005, 1996, 1982, by Tata McGraw-Hill Publishing Company Limited.

Budynas, Richard G. and Nlsbett, J. Keith, "Shigley's Mechanical Engineering Design", 8th edition, 2008 by McGraw Hill Higher Education.

Oberg, Erik et al, "Machinery's Handbook", 27th edition, 2004, by Industrial Press Inc, New York, NY.

International Search Report and Written Opinion as issued for International Application No. PCT/US2011/049599, dated Feb. 28, 2013.

International Preliminary Report on Patentability as issued for International Application No. PCT/US2011/049599, dated Mar. 14, 2013.

Coney, et al., "Development of a Reciprocating Compressor Using Water Injection to Achieve Quasi-Isothermal Compression", International Compressor Engineering Conference, Purdue University, School of Mechanical Engineering, Purdue e-Pubs, 2002, 10 pgs.

Office Action issued for U.S. Appl. No. 13/220,528, dated Mar. 24, 2014.

Search and Examination Report issued in Gulf Coast Patent Application No. GC 2011-19481, dated Nov. 26, 2014.

First Office Action as issued in Chinese Patent Application No. 201180052573.3, dated May 6, 2015.

Engineering Data Book, SI Version, vol. I, Sections 1-15, 2004, 68 pages.

Ohama, T. et al., "High Pressure Oil-Injected Screw Gas Compressors (API 619 Design) for Heavy Duty Process Gas Applications," Proceedings of the Thirty-Third Turbomachinery Symposium, 2004, pp. 49-56.

Ohama, T. et al., "Process Gas Applications Where API619 Screw Compressors Replaced Reciprocating and Centrifrugal Compressors," Proceedings of the Thirty-Fifth Turbomachinery Symposium, Sep. 25-28, 2006, pp. 89-96.

Wrigley, B., "Heat Exchanger", retrieved online URL:<http:// www. real-world-physics-problems. com/heat-exchanger.html>, 2009, pp. 1-28.

Panao, Miguel R.O. et al., Intermittent Spray Cooling: A New Technology for Controlling Surface Temperature, International Journal of Heat and Fluid Flow, vol. 30, No. 1, Feb. 2009, pp. 117-130.

COMPRESSOR

CROSS REFERENCE

This application is continuation of U.S. Ser. No. 14/994,964, titled "Compressor With Liquid Injection Cooling," filed Jan. 13, 2016, which is a divisional of U.S. Ser. No. 13/782,845, titled "Compressor With Liquid Injection Cooling," filed Mar. 1, 2013, which is a continuation-in-part of U.S. Ser. No. 13/220,528, titled "Compressor With Liquid Injection Cooling," filed Aug. 29, 2011, which claims priority to U.S. provisional application Ser. No. 61/378,297, which was filed on Aug. 30, 2010, and U.S. provisional application Ser. No. 61/485,006, which was filed on May 11, 2011, all of which are incorporated by reference herein in their entirety. U.S. Ser. No. 13/782,845 is also a continuation in part of PCT Application No. PCT/US2011/49599, titled "Compressor With Liquid Injection Cooling," filed Aug. 29, 2011, the entire contents of which are incorporated herein by reference in its entirety. U.S. Ser. No. 13/782,845 claims priority to U.S. Provisional Application No. 61/770,989, titled "Compressor With Liquid Injection Cooling," filed Feb. 28, 2013, the entire contents of which are incorporated herein by reference in its entirety. This application claims priority to all of these applications.

BACKGROUND

1. Technical Field

The invention generally relates to fluid pumps, such as compressors and expanders. More specifically, preferred embodiments utilize a novel rotary compressor design for compressing air, vapor, or gas for high pressure conditions over 200 psi and power ratings above 10 HP.

2. Related Art

Compressors have typically been used for a variety of applications, such as air compression, vapor compression for refrigeration, and compression of industrial gases. Compressors can be split into two main groups, positive displacement and dynamic. Positive displacement compressors reduce the compression volume in the compression chamber to increase the pressure of the fluid in the chamber. This is done by applying force to a drive shaft that is driving the compression process. Dynamic compressors work by transferring energy from a moving set of blades to the working fluid.

Positive displacement compressors can take a variety of forms. They are typically classified as reciprocating or rotary compressors. Reciprocating compressors are commonly used in industrial applications where higher pressure ratios are necessary. They can easily be combined into multistage machines, although single stage reciprocating compressors are not typically used at pressures above 80 psig. Reciprocating compressors use a piston to compress the vapor, air, or gas, and have a large number of components to help translate the rotation of the drive shaft into the reciprocating motion used for compression. This can lead to increased cost and reduced reliability. Reciprocating compressors also suffer from high levels of vibration and noise. This technology has been used for many industrial applications such as natural gas compression.

Rotary compressors use a rotating component to perform compression. As noted in the art, rotary compressors typically have the following features in common: (1) they impart energy to the gas being compressed by way of an input shaft moving a single or multiple rotating elements; (2) they perform the compression in an intermittent mode; and (3) they do not use inlet or discharge valves. (Brown, Compressors: Selection and Sizing, 3rd Ed., at 6). As further noted in Brown, rotary compressor designs are generally suitable for designs in which less than 20:1 pressure ratios and 1000 CFM flow rates are desired. For pressure ratios above 20:1, Royce suggests that multistage reciprocating compressors should be used instead.

Typical rotary compressor designs include the rolling piston, screw compressor, scroll compressor, lobe, liquid ring, and rotary vane compressors. Each of these traditional compressors has deficiencies for producing high pressure, near isothermal conditions.

The design of a rotating element/rotor/lobe against a radially moving element/piston to progressively reduce the volume of a fluid has been utilized as early as the mid-19th century with the introduction of the "Yule Rotary Steam Engine." Developments have been made to small-sized compressors utilizing this methodology into refrigeration compression applications. However, current Yule-type designs are limited due to problems with mechanical spring durability (returning the piston element) as well as chatter (insufficient acceleration of the piston in order to maintain contact with the rotor).

For commercial applications, such as compressors for refrigerators, small rolling piston or rotary vane designs are typically used. (P N Ananthanarayanan, Basic Refrigeration and Air Conditioning, 3rd Ed., at 171-72.) In these designs, a closed oil-lubricating system is typically used.

Rolling piston designs typically allow for a significant amount of leakage between an eccentrically mounted circular rotor, the interior wall of the casing, and/or the vane that contacts the rotor. By spinning the rolling piston faster, the leakages are deemed acceptable because the desired pressure and flow rate for the application can be easily reached even with these losses. The benefit of a small self-contained compressor is more important than seeking higher pressure ratios.

Rotary vane designs typically use a single circular rotor mounted eccentrically in a cylinder slightly larger than the rotor. Multiple vanes are positioned in slots in the rotor and are kept in contact with the cylinder as the rotor turns typically by spring or centrifugal force inside the rotor. The design and operation of these type of compressors may be found in Mark's Standard Handbook for Mechanical Engineers, Eleventh Edition, at 14:33-34.

In a sliding-vane compressor design, vanes are mounted inside the rotor to slide against the casing wall. Alternatively, rolling piston designs utilize a vane mounted within the cylinder that slides against the rotor. These designs are limited by the amount of restoring force that can be provided and thus the pressure that can be yielded.

Each of these types of prior art compressors has limits on the maximum pressure differential that it can provide. Typical factors include mechanical stresses and temperature rise. One proposed solution is to use multistaging. In multistaging, multiple compression stages are applied sequentially. Intercooling, or cooling between stages, is used to cool the working fluid down to an acceptable level to be input into the next stage of compression. This is typically done by passing the working fluid through a heat exchanger in thermal communication with a cooler fluid. However, intercooling can result in some condensation of liquid and typically requires filtering out of the liquid elements. Multistaging greatly increases the complexity of the overall compression system and adds costs due to the increased number of components required. Additionally, the increased number of components leads to decreased reliability and the overall size and weight of the system are markedly increased.

For industrial applications, single- and double-acting reciprocating compressors and helical-screw type rotary compressors are most commonly used. Single-acting reciprocating compressors are similar to an automotive type piston with compression occurring on the top side of the piston during each revolution of the crankshaft. These machines can operate with a single-stage discharging between 25 and 125 psig or in two stages, with outputs ranging from 125 to 175 psig or higher. Single-acting reciprocating compressors are rarely seen in sizes above 25 HP. These types of compressors are typically affected by vibration and mechanical stress and require frequent maintenance. They also suffer from low efficiency due to insufficient cooling.

Double-acting reciprocating compressors use both sides of the piston for compression, effectively doubling the machine's capacity for a given cylinder size. They can operate as a single-stage or with multiple stages and are typically sized greater than 10 HP with discharge pressures above 50 psig. Machines of this type with only one or two cylinders require large foundations due to the unbalanced reciprocating forces. Double-acting reciprocating compressors tend to be quite robust and reliable, but are not sufficiently efficient, require frequent valve maintenance, and have extremely high capital costs.

Lubricant-flooded rotary screw compressors operate by forcing fluid between two intermeshing rotors within a housing which has an inlet port at one end and a discharge port at the other. Lubricant is injected into the chamber to lubricate the rotors and bearings, take away the heat of compression, and help to seal the clearances between the two rotors and between the rotors and housing. This style of compressor is reliable with few moving parts. However, it becomes quite inefficient at higher discharge pressures (above approximately 200 psig) due to the intermeshing rotor geometry being forced apart and leakage occurring. In addition, lack of valves and a built-in pressure ratio leads to frequent over or under compression, which translates into significant energy efficiency losses.

Rotary screw compressors are also available without lubricant in the compression chamber, although these types of machines are quite inefficient due to the lack of lubricant helping to seal between the rotors. They are a requirement in some process industries such as food and beverage, semiconductor, and pharmaceuticals, which cannot tolerate any oil in the compressed air used in their processes. Efficiency of dry rotary screw compressors are 15-20% below comparable injected lubricated rotary screw compressors and are typically used for discharge pressures below 150 psig.

Using cooling in a compressor is understood to improve upon the efficiency of the compression process by extracting heat, allowing most of the energy to be transmitted to the gas and compressing with minimal temperature increase. Liquid injection has previously been utilized in other compression applications for cooling purposes. Further, it has been suggested that smaller droplet sizes of the injected liquid may provide additional benefits.

In U.S. Pat. No. 4,497,185, lubricating oil was intercooled and injected through an atomizing nozzle into the inlet of a rotary screw compressor. In a similar fashion, U.S. Pat. No. 3,795,117 uses refrigerant, though not in an atomized fashion, that is injected early in the compression stages of a rotary screw compressor. Rotary vane compressors have also attempted finely atomized liquid injection, as seen in U.S. Pat. No. 3,820,923.

In each example, cooling of the fluid being compressed was desired. Liquid injection in rotary screw compressors is typically done at the inlet and not within the compression chamber. This provides some cooling benefits, but the liquid is given the entire compression cycle to coalesce and reduce its effective heat transfer coefficient. Additionally, these examples use liquids that have lubrication and sealing as a primary benefit. This affects the choice of liquid used and may adversely affect its heat transfer and absorption characteristics. Further, these styles of compressors have limited pressure capabilities and thus are limited in their potential market applications.

Rotary designs for engines are also known, but suffer from deficiencies that would make them unsuitable for an efficient compressor design. The most well-known example of a rotary engine is the Wankel engine. While this engine has been shown to have benefits over conventional engines and has been commercialized with some success, it still suffers from multiple problems, including low reliability and high levels of hydrocarbon emissions.

Published International Pat. App. No. WO 2010/017199 and U.S. Pat. Pub. No. 2011/0023814 relate to a rotary engine design using a rotor, multiple gates to create the chambers necessary for a combustion cycle, and an external cam-drive for the gates. The force from the combustion cycle drives the rotor, which imparts force to an external element. Engines are designed for a temperature increase in the chamber and high temperatures associated with the combustion that occurs within an engine. Increased sealing requirements necessary for an effective compressor design are unnecessary and difficult to achieve. Combustion forces the use of positively contacting seals to achieve near perfect sealing, while leaving wide tolerances for metal expansion, taken up by the seals, in an engine. Further, injection of liquids for cooling would be counterproductive and coalescence is not addressed.

Liquid mist injection has been used in compressors, but with limited effectiveness. In U.S. Pat. No. 5,024,588, a liquid injection mist is described, but improved heat transfer is not addressed. In U.S. Pat. Publication. No. U.S. 2011/0023977, liquid is pumped through atomizing nozzles into a reciprocating piston compressor's compression chamber prior to the start of compression. It is specified that liquid will only be injected through atomizing nozzles in low pressure applications. Liquid present in a reciprocating piston compressor's cylinder causes a high risk for catastrophic failure due to hydrolock, a consequence of the incompressibility of liquids when they build up in clearance volumes in a reciprocating piston, or other positive displacement, compressor. To prevent hydrolock situations, reciprocating piston compressors using liquid injection will typically have to operate at very slow speeds, adversely affecting the performance of the compressor.

The prior art lacks compressor designs in which the application of liquid injection for cooling provides desired results for a near-isothermal application. This is in large part due to the lack of a suitable positive displacement compressor design that can both accommodate a significant amount of liquid in the compression chamber and pass that liquid through the compressor outlet without damage.

BRIEF SUMMARY

The presently preferred embodiments are directed to rotary compressor designs. These designs are particularly suited for high pressure applications, typically above 200 psig with pressure ratios typically above that for existing high-pressure positive displacement compressors.

One or more embodiments provide a method of operating a compressor having a casing defining a compression chamber, and a rotatable drive shaft configured to drive the compressor. The method includes compressing a working fluid using the compressor such that a speed of the drive shaft relative to the casing is at least 450 rpm, and a pressure ratio of the compressor is at least 15:1. The method also includes injecting liquid coolant into the compression chamber during the compressing.

According to one or more of these embodiments, the compressor is a positive displacement rotary compressor that includes a rotor connected to the drive shaft for rotation with the drive shaft relative to the casing.

According to one or more of these embodiments, the compressing includes moving the working fluid into the compression chamber through an inlet port in the compression chamber. The compressing also includes expelling compressed working fluid out of the compression chamber through an outlet port in the compression chamber. The pressure ratio is a ratio of (a) an absolute inlet pressure of the working fluid at the inlet port, to (b) an absolute outlet pressure of the working fluid expelled from the compression chamber through the outlet port.

According to one or more of these embodiments, the speed is between 450 and 1800 rpm and/or greater than 500, 600, 700, and/or 800 rpm.

According to one or more of these embodiments, the pressure ratio is between 15:1 and 100:1, at least 20:1, at least 30:1, and/or at least 40:1.

According to one or more of these embodiments, the working fluid is a multi-phase fluid that has a liquid volume fraction at an inlet into the compression chamber of at least 1, 2, 3, 4, 5, 10, 20, 30 and/or 40%.

According to one or more of these embodiments, the compressed fluid is expelled from the compressor at an outlet pressure of between 200 and 6000 psig and/or at least 200, 225, 250, 275, 300, 325, 350, 400, 450, 500, 750, 1000, 1250, 1500, 2000, 3000, 4000, and/or 5000 psig.

According to one or more of these embodiments, an outlet temperature of the compressed working fluid being expelled through the outlet port is less than 100, 150, 200, 250, and/or 300 degrees C. The outlet temperature may be greater than 0 degrees C.

According to one or more of these embodiments, an outlet temperature of the compressed working fluid being expelled through the outlet port exceeds an inlet temperature of the working fluid entering the compression chamber through the inlet port by less than 100, 150, 200, 250, and/or 300 degrees C.

According to one or more of these embodiments, a rotational axis of the rotor is oriented in a horizontal direction during the compressing.

According to one or more of these embodiments, the injecting includes injecting atomized liquid coolant with an average droplet size of 300 microns or less into a compression volume defined between the rotor and an inner wall of the compression chamber.

According to one or more of these embodiments, the injecting includes injecting liquid coolant into the compression chamber in a direction that is perpendicular to or at least partially counter to a flow direction of the working fluid adjacent to the location of liquid coolant injection.

According to one or more of these embodiments, the injecting includes discontinuously injecting liquid coolant into the compression chamber over the course of each compression cycle. During each compression cycle, coolant injection begins at or after the first 20% of the compression cycle.

According to one or more of these embodiments, the injecting includes injecting the liquid coolant into the compression chamber at an average rate of at least 3, 4, 5, 6, and/or 7 gallons per minute (gpm), and/or between 3 and 20 gpm.

According to one or more of these embodiments, the injecting includes injecting liquid coolant into a compression volume defined between the rotor and an inner wall of the compression chamber during the compressor's highest rate of compression over the course of a compression cycle of the compressor.

According to one or more of these embodiments, the compression chamber is defined by a cylindrical inner wall of the casing; the compression chamber includes an inlet port and an outlet port; the rotor has a sealing portion that corresponds to a curvature of the inner wall of the casing and has a constant radius, and a non-sealing portion having a variable radius; the rotor rotates concentrically relative to the cylindrical inner wall during the compressing; the compressor includes at least one liquid injector connected with the casing; the at least one liquid injector carries out the injecting; the compressor includes a gate having a first end and a second end, and operable to move within the casing to locate the first end proximate to the rotor as the rotor rotates during the compressing; the gate separates an inlet volume and a compression volume in the compression chamber; the inlet port is configured to enable suction in of the working fluid; and the outlet port is configured to enable expulsion of both liquid and gas.

One or more embodiments of the invention provide a compressor that is configured to carry out one or more of these methods.

One or more embodiments provide a compressor comprising: a casing with an inner wall defining a compression chamber; a positive displacement compressing structure movable relative to the casing to compress a working fluid in the compression chamber; a rotatable drive shaft configured to drive the compressing structure; and at least one liquid injector connected to the casing and configured to inject liquid coolant into the compression chamber during compression of the working fluid.

According to one or more of these embodiments, the compressor is configured and shaped to compress the working fluid at a drive shaft speed of at least 450 rpm with a pressure ratio of at least 15:1.

According to one or more of these embodiments, the compressor is a positive displacement rotary compressor, and the compressing structure is a rotor connected to the drive shaft for rotation with the drive shaft relative to the casing.

According to one or more of these embodiments, the compression chamber includes an inlet port and an outlet port; the compressor is shaped and configured to receive the working fluid into the compression chamber via the inlet port and expel the working fluid out of the compression chamber via the outlet port; and the pressure ratio is a ratio of (a) an absolute inlet pressure of the working fluid at the inlet port, to (b) an absolute outlet pressure of the working fluid expelled from the compression chamber through the outlet port.

According to one or more of these embodiments, the compression chamber includes an inlet port and an outlet port; the inner wall is cylindrical; the rotor has a sealing portion that corresponds to a curvature of the inner wall and has a constant radius, and a non-sealing portion having a variable radius; the rotor is connected to the casing for concentric rotation within the compression chamber; the compressor includes a gate having a first end and a second end, and operable to move within the casing to locate the first end proximate to the rotor as the rotor rotates; the gate separates an inlet volume and a compression volume in the compression chamber; the inlet port is configured to enable suction in of the working fluid; and the outlet is configured to enable expulsion of both liquid and gas.

One or more embodiments provides a positive displacement compressor, comprising: a cylindrical rotor casing, the rotor casing having an inlet port, an outlet port, and an inner wall defining a rotor casing volume; a rotor, the rotor having a sealing portion that corresponds to a curvature of the inner wall of the rotor casing; at least one liquid injector connected with the rotor casing to inject liquids into the rotor casing volume; and a gate having a first end and a second end, and operable to move within the rotor casing to locate the first end proximate to the rotor as it turns. The gate may separate an inlet volume and a compression volume in the rotor casing volume. The inlet port may be configured to enable suction in of gas. The outlet port may be configured to enable expulsion of both liquid and gas.

According to one or more of these embodiments, the at least one liquid injector is positioned to inject liquid into an area within the rotor casing volume where compression occurs during operation of the compressor.

One or more embodiments provides a method for compressing a fluid, the method comprising: providing a rotary compressor, the rotary compressor having a rotor, rotor casing, intake volume, a compression volume, and outlet valve; receiving air into the intake volume; rotating the rotor to increase the intake volume and decrease the compression volume; injecting cooling liquid into the chamber; rotating the rotor to further increase and decrease the compression volume; opening the outlet valve to release compressed gas and liquid; and separating the liquid from the compressed gas.

According to one or more of these embodiments, injected cooling liquid is atomized when injected, absorbs heat, and is directed toward the outlet valve.

One or more embodiments provides a positive displacement compressor, comprising: a compression chamber, including a cylindrical-shaped casing having a first end and a second end, the first and second end aligned horizontally; a shaft located axially in the compression chamber; a rotor concentrically mounted to the shaft; liquid injectors located to inject liquid into the compression chamber; and a dual purpose outlet operable to release gas and liquid.

According to one or more of these embodiments, the rotor includes a curved portion that forms a seal with the cylindrical-shaped casing, and balancing holes.

One illustrative embodiment of the design includes a non-circular-shaped rotor rotating within a cylindrical casing and mounted concentrically on a drive shaft inserted axially through the cylinder. The rotor is symmetrical along the axis traveling from the drive shaft to the casing with cycloid and constant radius portions. The constant radius portion corresponds to the curvature of the cylindrical casing, thus providing a sealing portion. The changing rate of curvature on the other portions provides for a non-sealing portion. In this illustrative embodiment, the rotor is balanced by way of holes and counterweights.

A gate structured similar to a reciprocating rectangular piston is inserted into and withdrawn from the bottom of the cylinder in a timed manner such that the tip of the piston remains in contact with or sufficiently proximate to the surface of the rotor as it turns. The coordinated movement of the gate and the rotor separates the compression chamber into a low pressure and high pressure region.

As the rotor rotates inside the cylinder, the compression volume is progressively reduced and compression of the fluid occurs. At the same time, the intake side is filled with gas through the inlet. An inlet and exhaust are located to allow fluid to enter and exit the chamber at appropriate times. During the compression process, atomized liquid is injected into the compression chamber in such a way that a high and rapid rate of heat transfer is achieved between the gas being compressed and the injected cooling liquid. This results in near isothermal compression, which enables a much higher efficiency compression process.

The rotary compressor embodiments sufficient to achieve near isothermal compression are capable of achieving high pressure compression at higher efficiencies. It is capable of compressing gas only, a mixture of gas and liquids, or for pumping liquids. As one of ordinary skill in the art would appreciate, the design can also be used as an expander.

The particular rotor and gate designs may also be modified depending on application parameters. For example, different cycloidal and constant radii may be employed. Alternatively, double harmonic, polynomial, or other functions may be used for the variable radius. The gate may be of one or multiple pieces. It may implement a contacting tip-seal, liquid channel, or provide a non-contacting seal by which the gate is proximate to the rotor as it turns.

Several embodiments provide mechanisms for driving the gate external to the main casing. In one embodiment, a spring-backed cam drive system is used. In others, a belt-based system with or without springs may be used. In yet another, a dual cam follower gate positioning system is used. Further, an offset gate guide system may be used. Further still, linear actuator, magnetic drive, and scotch yoke systems may be used.

The presently preferred embodiments provide advantages not found in the prior art. The design is tolerant of liquid in the system, both coming through the inlet and injected for cooling purposes. High pressure ratios are achievable due to effective cooling techniques. Lower vibration levels and noise are generated. Valves are used to minimize inefficiencies resulting from over- and under-compression common in existing rotary compressors. Seals are used to allow higher pressures and slower speeds than typical with other rotary compressors. The rotor design allows for balanced, concentric motion, reduced acceleration of the gate, and effective sealing between high pressure and low pressure regions of the compression chamber.

These and other aspects of various embodiments of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not intended as a definition of the limits of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

All closed-ended (e.g., between A and B) and open-ended (greater than C) ranges of values disclosed herein explicitly include all ranges that fall within or nest within such ranges. For example, a disclosed range of 1-10 is understood as also disclosing, among other ranged, 2-10, 1-9, 3-9, etc.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
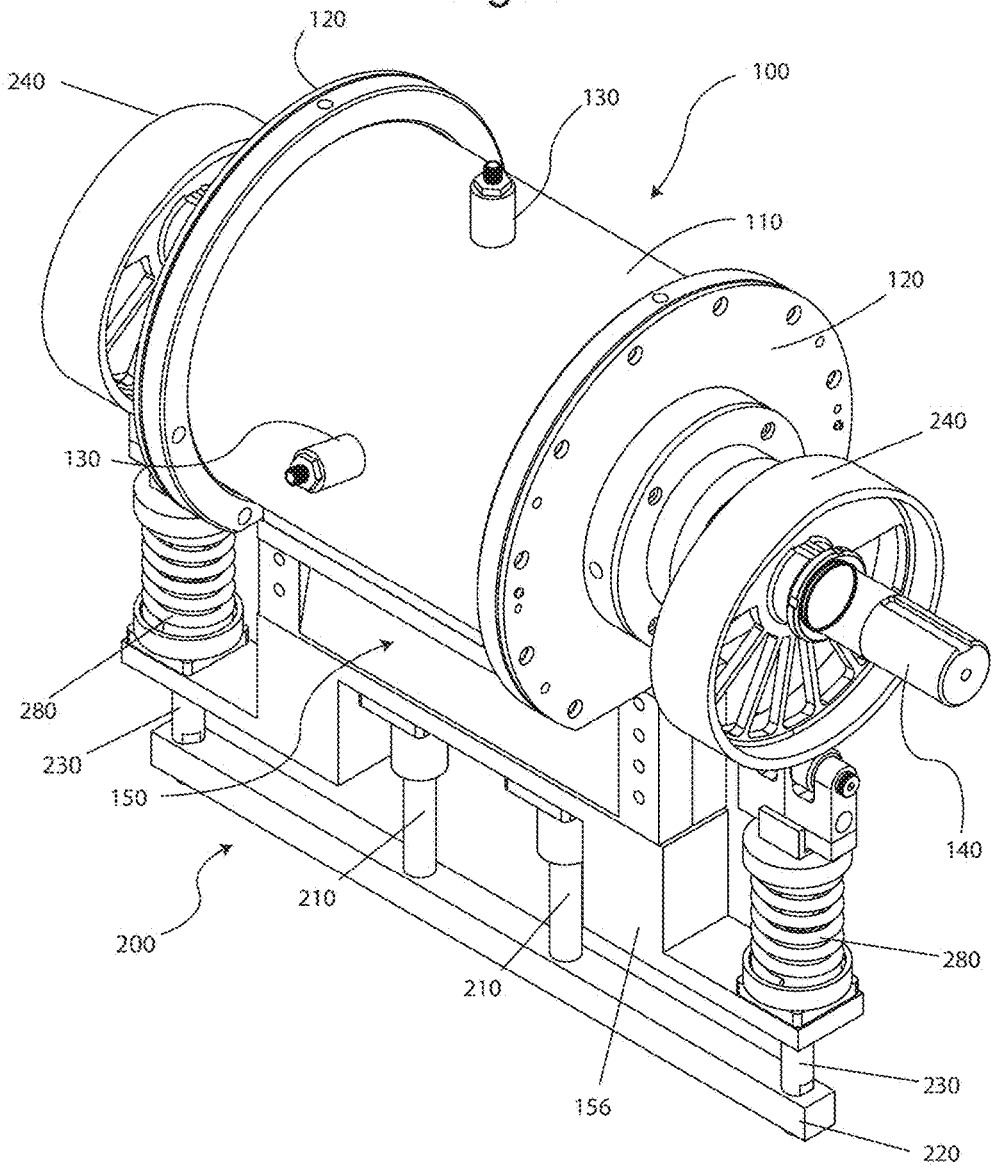
FIG. 1 is a perspective view of a rotary compressor with a spring-backed cam drive in accordance with an embodiment of the present invention.
Figure 2:
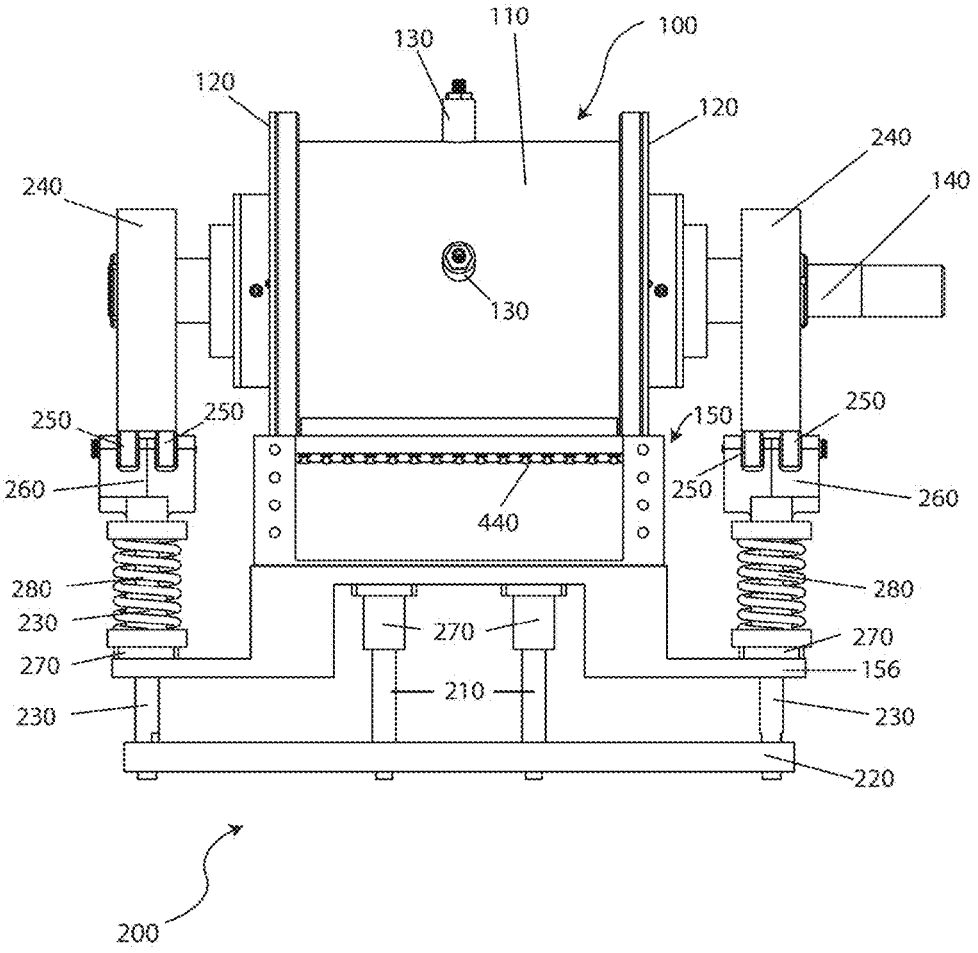
FIG. 2 is a right-side view of a rotary compressor with a spring-backed cam drive in accordance with an embodiment of the present invention.

To the extent that the following terms are utilized herein, the following definitions are applicable:

Balanced rotation: the center of mass of the rotating mass is located on the axis of rotation.

Chamber volume: any volume that can contain fluids for compression.

Compressor: a device used to increase the pressure of a compressible fluid. The fluid can be either gas or vapor, and can have a wide molecular weight range.

Concentric: the center or axis of one object coincides with the center or axis of a second object Concentric rotation: rotation in which one object's center of rotation is located on the same axis as the second object's center of rotation.

Positive displacement compressor: a compressor that collects a fixed volume of gas within a chamber and compresses it by reducing the chamber volume.

Proximate: sufficiently close to restrict fluid flow between high pressure and low pressure regions. Restriction does not need to be absolute; some leakage is acceptable.

Rotor: A rotating element driven by a mechanical force to rotate about an axis. As used in a compressor design, the rotor imparts energy to a fluid.

Rotary compressor: A positive-displacement compressor that imparts energy to the gas being compressed by way of an input shaft moving a single or multiple rotating elements FIGS. 1 through 7 show external views of an embodiment of the present invention in which a rotary compressor includes spring backed cam drive gate positioning system. Main housing 100 includes a main casing 110 and end plates 120, each of which includes a hole through which drive shaft 140 passes axially. Liquid injector assemblies 130 are located on holes in the main casing 110. The main casing includes a hole for the inlet flange 160, and a hole for the gate casing 150.

Figure 28:
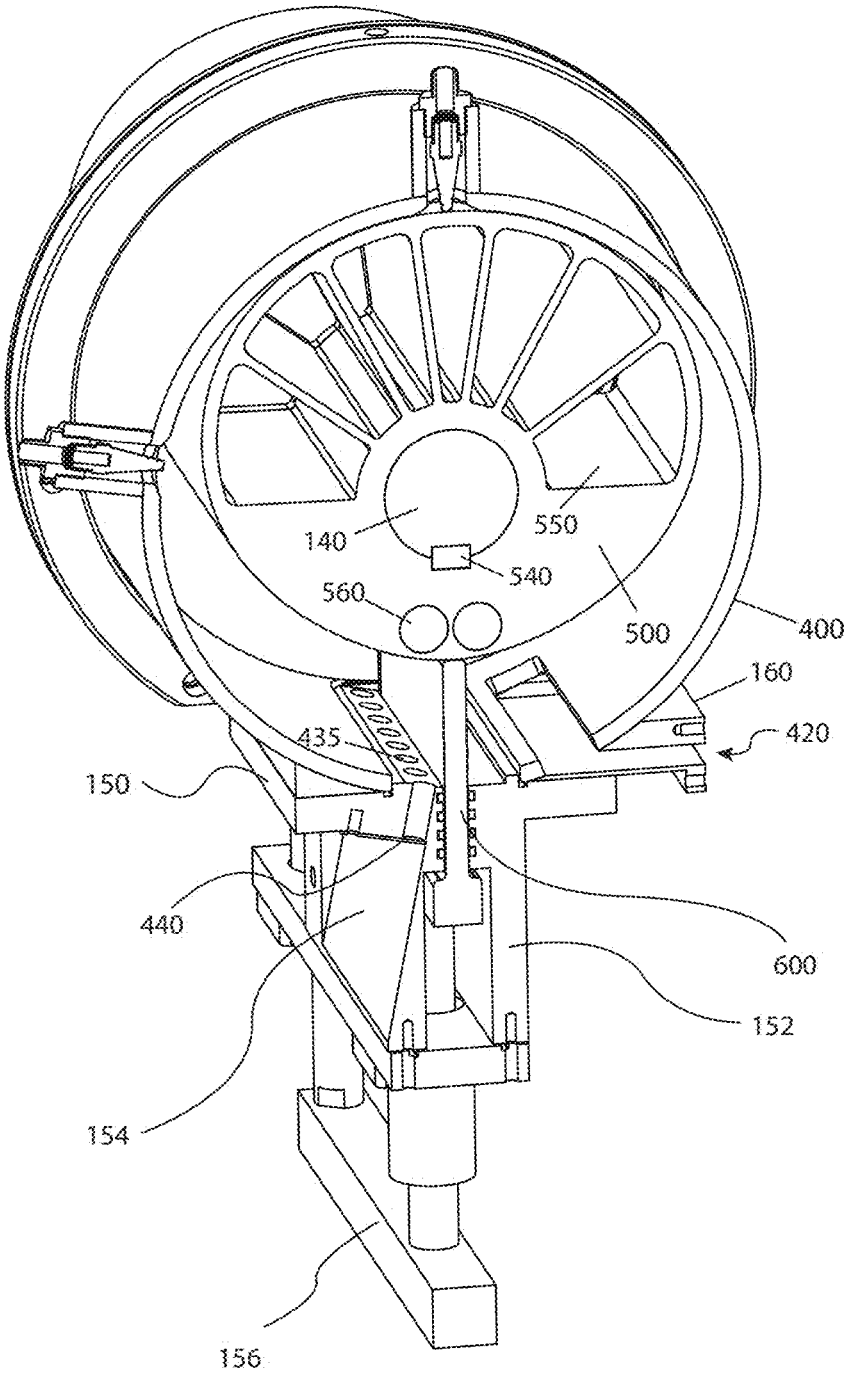
FIG. 28 is perspective, cross-sectional view of a rotary compressor in accordance with an embodiment of the present invention.

Gate casing 150 is connected to and positioned below main casing 110 at a hole in main casing 110. The gate casing 150 is comprised of two portions: an inlet side 152 and an outlet side 154. Other embodiments of gate casing 150 may only consist of a single portion. As shown in FIG. 28, the outlet side 154 includes outlet ports 435, which are holes which lead to outlet valves 440. Alternatively, an outlet valve assembly may be used.

Referring back to FIGS. 1-7, the spring-backed cam drive gate positioning system 200 is attached to the gate casing 150 and drive shaft 140. The gate positioning system 200 moves gate 600 in conjunction with the rotation of rotor 500. A movable assembly includes gate struts 210 and cam struts 230 connected to gate support arm 220 and bearing support plate 156. The bearing support plate 156 seals the gate casing 150 by interfacing with the inlet and outlet sides through a bolted gasket connection. Bearing support plate 156 is shaped to seal gate casing 150, mount bearing housings 270 in a sufficiently parallel manner, and constrain compressive springs 280. In one embodiment, the interior of the gate casing 150 is hermetically sealed by the bearing support plate 156 with o-rings, gaskets, or other sealing materials. Other embodiments may support the bearings at other locations, in which case an alternate plate may be used to seal the interior of the gate casing. Shaft seals, mechanical seals, or other sealing mechanisms may be used to seal around the gate struts 210 which penetrate the bearing support plate 156 or other sealing plate. Bearing housings 270, also known as pillow blocks, are concentric to the gate struts 210 and the cam struts 230.

In the illustrated embodiment, the compressing structure comprises a rotor 500. However, according to alternative embodiments, alternative types of compressing structures (e.g., gears, screws, pistons, etc.) may be used in connection with the compression chamber to provide alternative compressors according to alternative embodiments of the invention.

Two cam followers 250 are located tangentially to each cam 240, providing a downward force on the gate. Drive shaft 140 turns cams 240, which transmits force to the cam followers 250. The cam followers 250 may be mounted on a through shaft, which is supported on both ends, or cantilevered and only supported on one end. The cam followers 250 are attached to cam follower supports 260, which transfer the force into the cam struts 230. As cams 240 turn, the cam followers 250 are pushed down, thus moving the cam struts 230 down. This moves the gate support arm 220 and the gate strut 210 down. This, in turn, moves the gate 600 down.

Springs 280 provide a restorative upward force to keep the gate 600 timed appropriately to seal against the rotor 500. As the cams 240 continue to turn and no longer effectuate a downward force on the cam followers 250, springs 280 provide an upward force. As shown in this embodiment, compression springs are utilized. As one of ordinary skill in the art would appreciate, tension springs and the shape of the bearing support plate 156 may be altered to provide for the desired upward or downward force. The upward force of the springs 280 pushes the cam follower support 260 and thus the gate support arm 220 up which in turn moves the gate 600 up.

Due to the varying pressure angle between the cam followers 250 and cams 240, the preferred embodiment may utilize an exterior cam profile that differs from the rotor 500 profile. This variation in profile allows for compensation for the changing pressure angle to ensure that the tip of the gate 600 remains proximate to the rotor 500 throughout the entire compression cycle.

Figure 3:
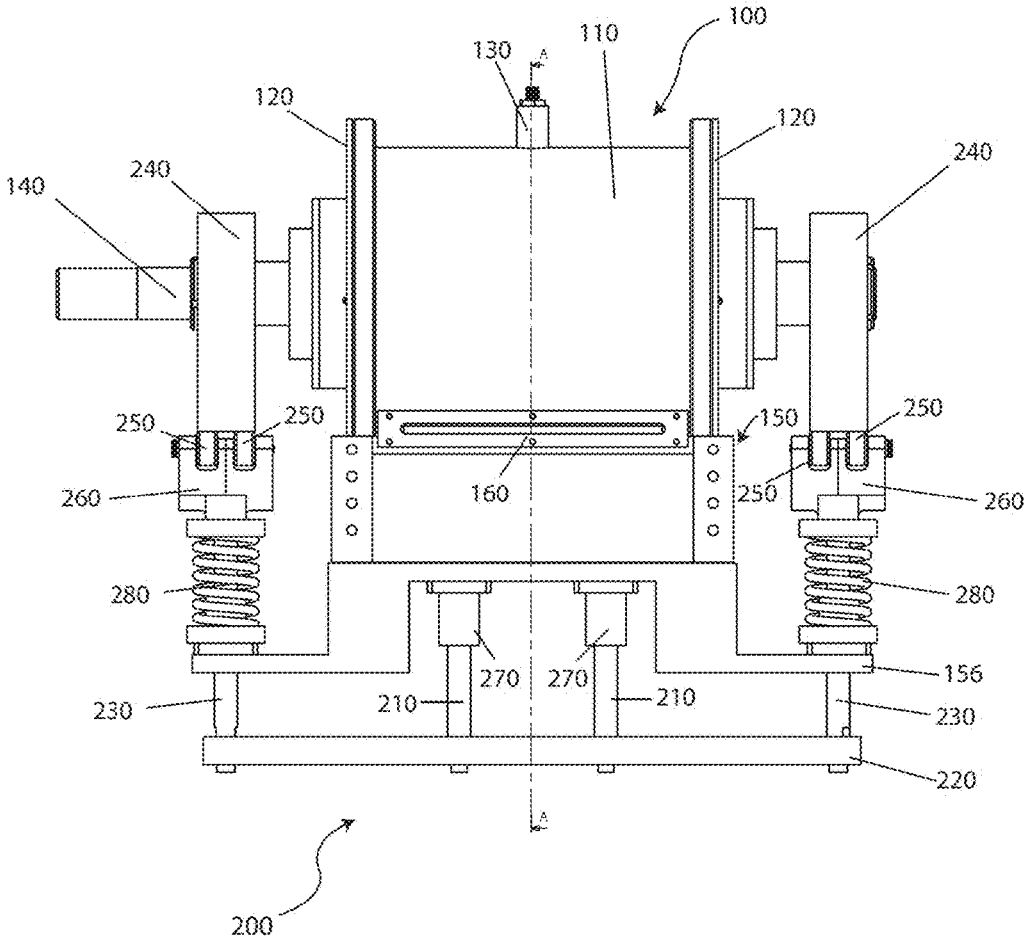
FIG. 3 is a left-side view of a rotary compressor with a spring-backed cam drive in accordance with an embodiment of the present invention.
Figure 4:
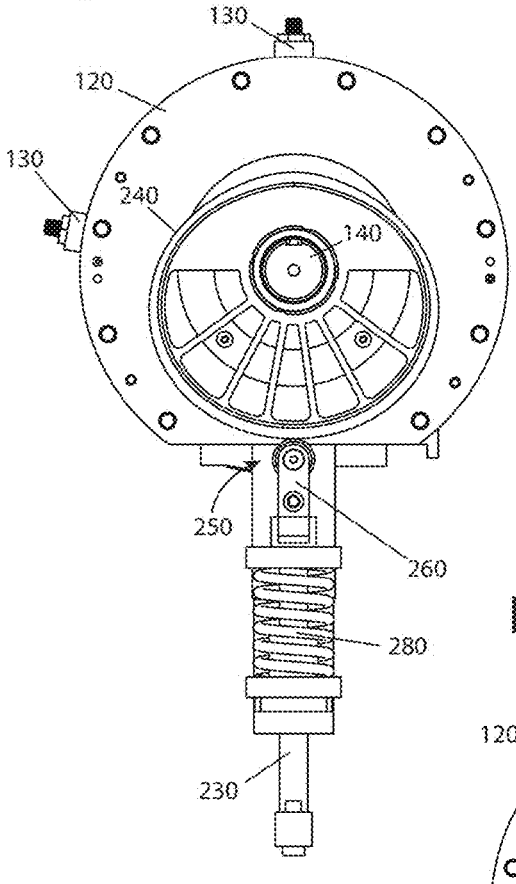
FIG. 4 is a front view of a rotary compressor with a spring-backed cam drive in accordance with an embodiment of the present invention.
Figure 5:
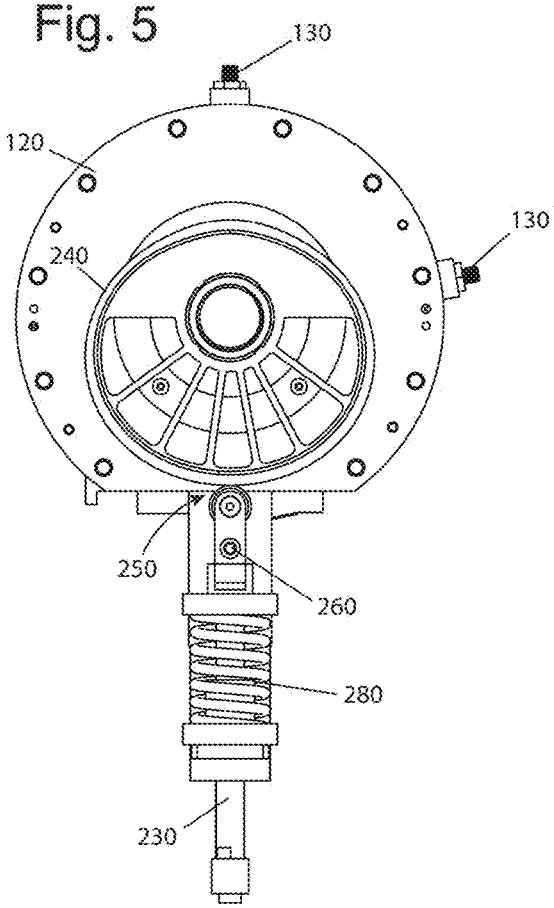
FIG. 5 is a back view of a rotary compressor with a spring-backed cam drive in accordance with an embodiment of the present invention.
Figure 6:
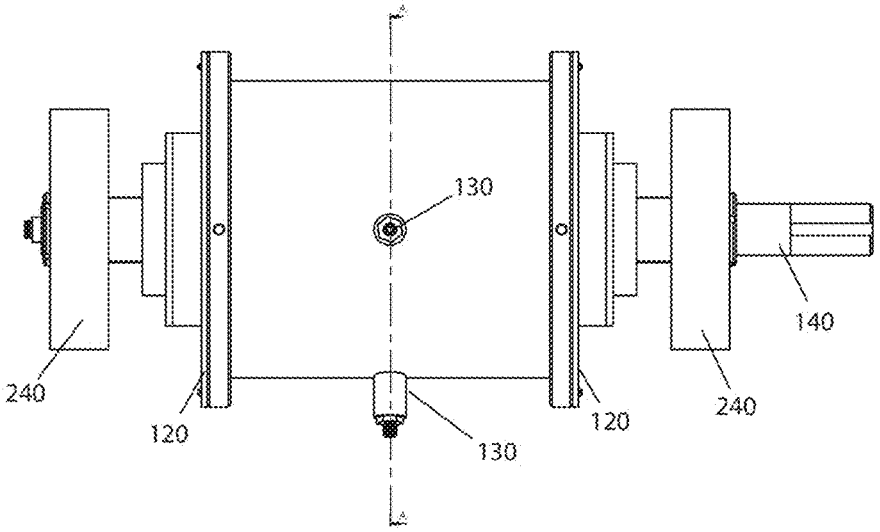
FIG. 6 is a top view of a rotary compressor with a spring-backed cam drive in accordance with an embodiment of the present invention.
Figure 7:
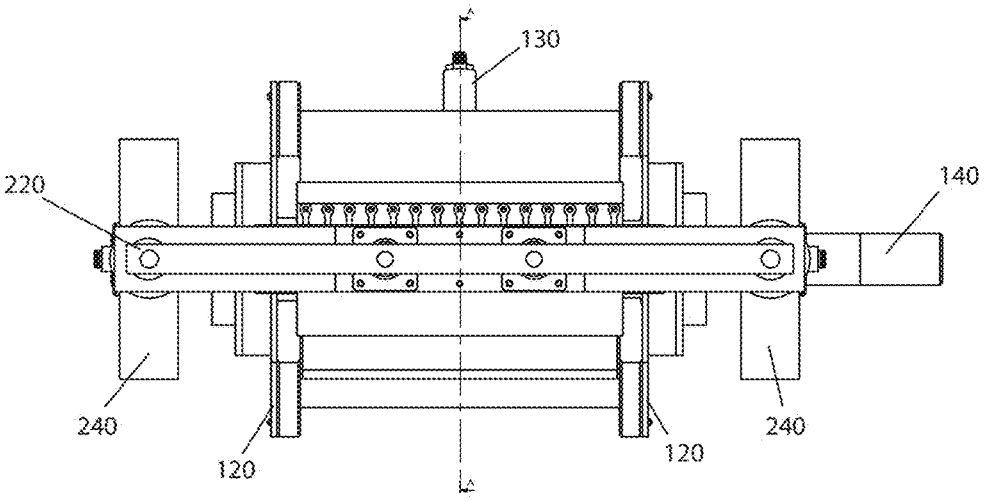
FIG. 7 is a bottom view of a rotary compressor with a spring-backed cam drive in accordance with an embodiment of the present invention.
Figure 8:
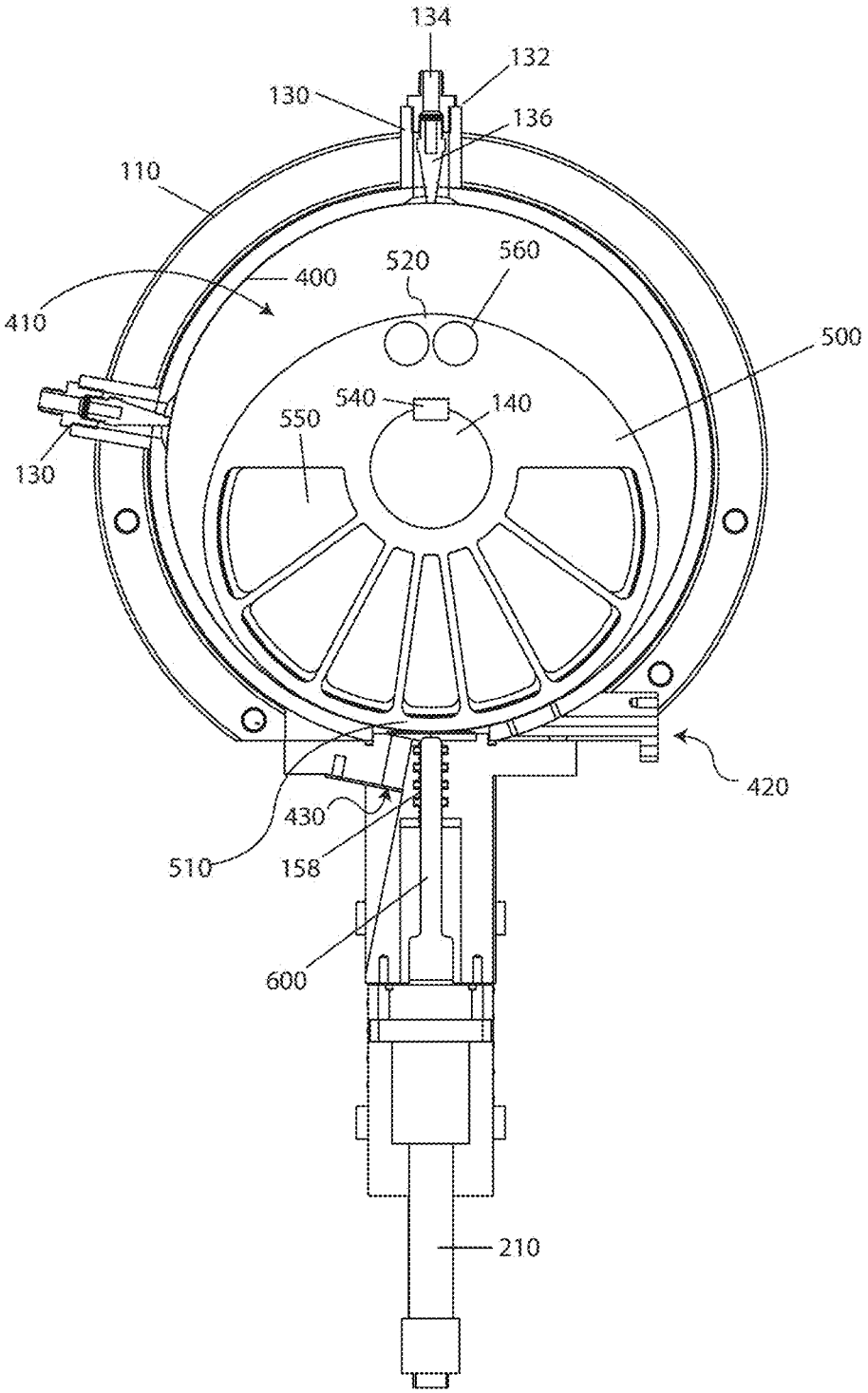
FIG. 8 is a cross-sectional view of a rotary compressor with a spring-backed cam drive in accordance with an embodiment of the present invention.

Line A in FIGS. 3, 6, and 7 shows the location for the cross-sectional view of the compressor in FIG. 8. As shown in FIG. 8, the main casing 110 has a cylindrical shape. Liquid injector housings 132 are attached to, or may be cast as a part of, the main casing 110 to provide for openings in the rotor casing 400. Because it is cylindrically shaped in this embodiment, the rotor casing 400 may also be referenced as the cylinder. The interior wall defines a rotor casing volume 410 (also referred to as the compression chamber). The rotor 500 concentrically rotates with drive shaft 140 and is affixed to the drive shaft 140 by way of key 540 and press fit. Alternate methods for affixing the rotor 500 to the drive shaft 140, such as polygons, splines, or a tapered shaft may also be used.

Figure 9:
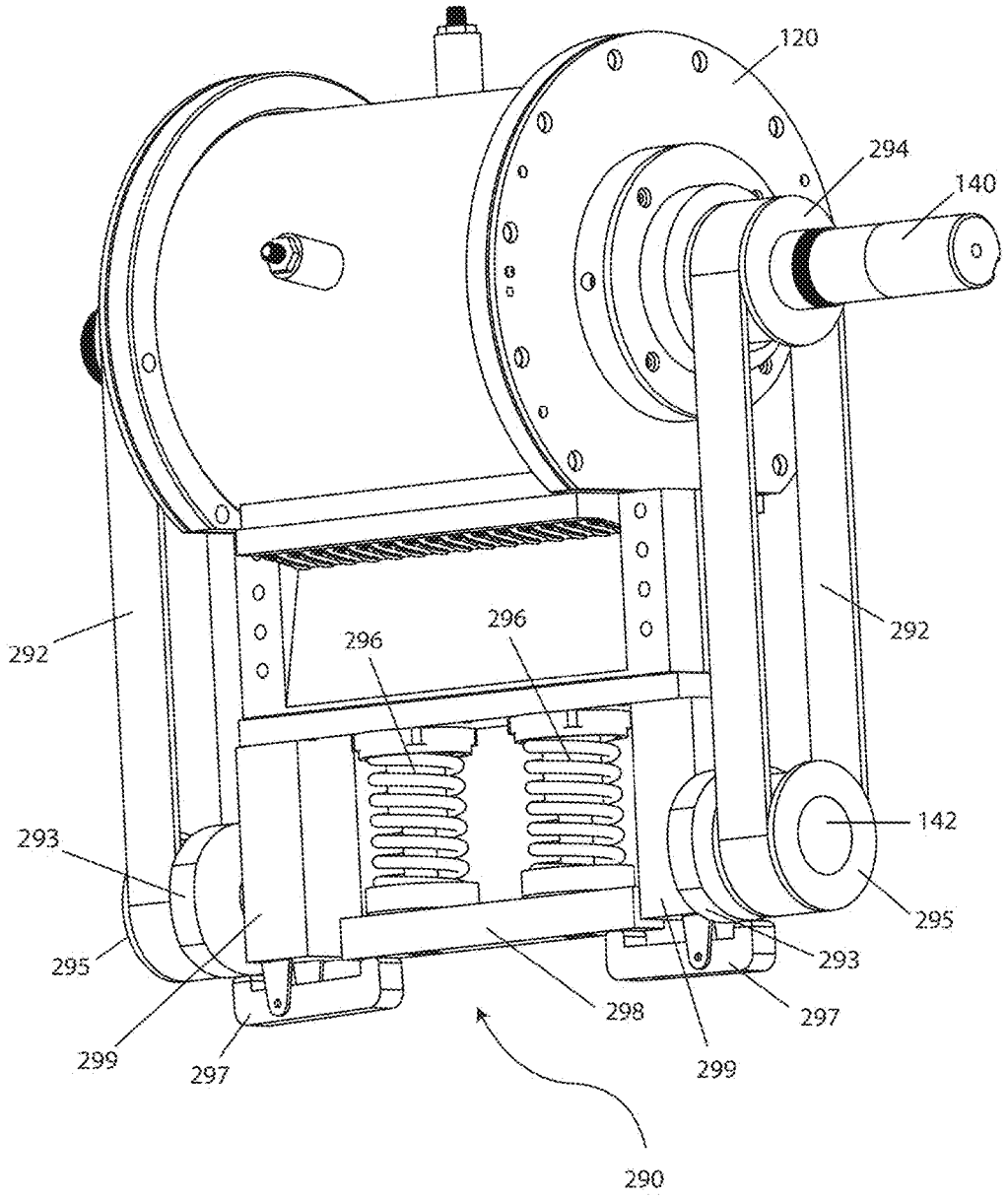
FIG. 9 is a perspective view of rotary compressor with a belt-driven, spring-biased gate positioning system in accordance with an embodiment of the present invention.
Figure 10:
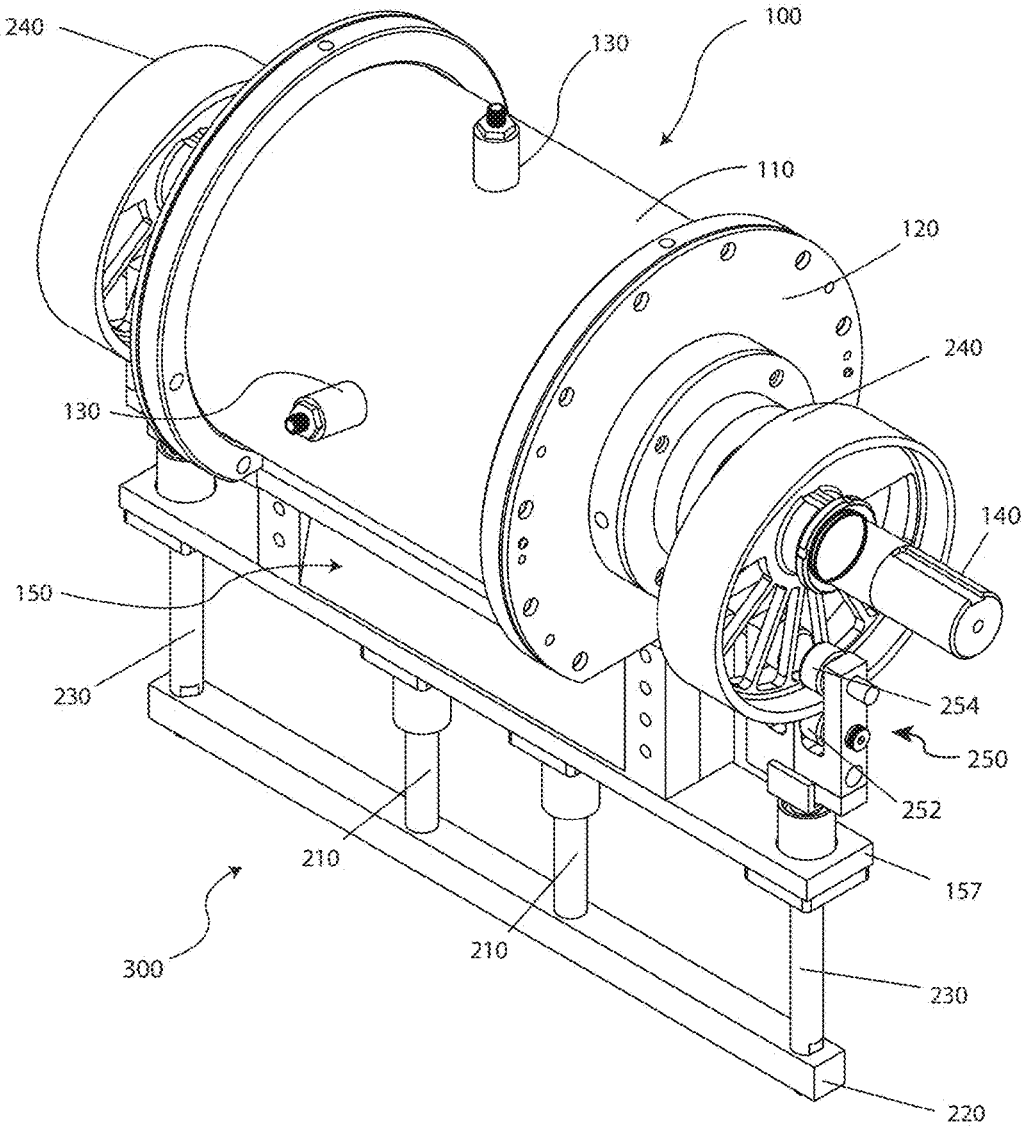
FIG. 10 is a perspective view of a rotary compressor with a dual cam follower gate positioning system in accordance with an embodiment of the present invention.
Figure 11:
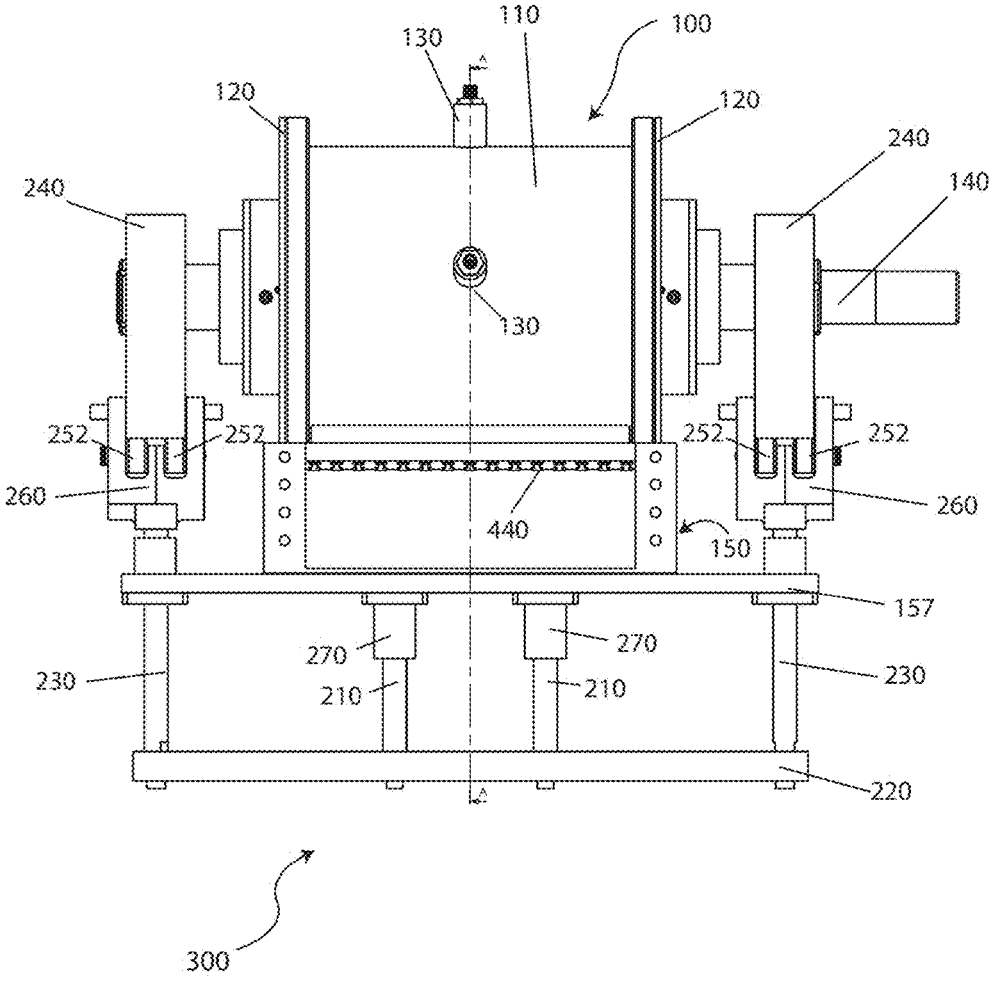
FIG. 11 is a right-side view of a rotary compressor with a dual cam follower gate positioning system in accordance with an embodiment of the present invention.
Figure 12:
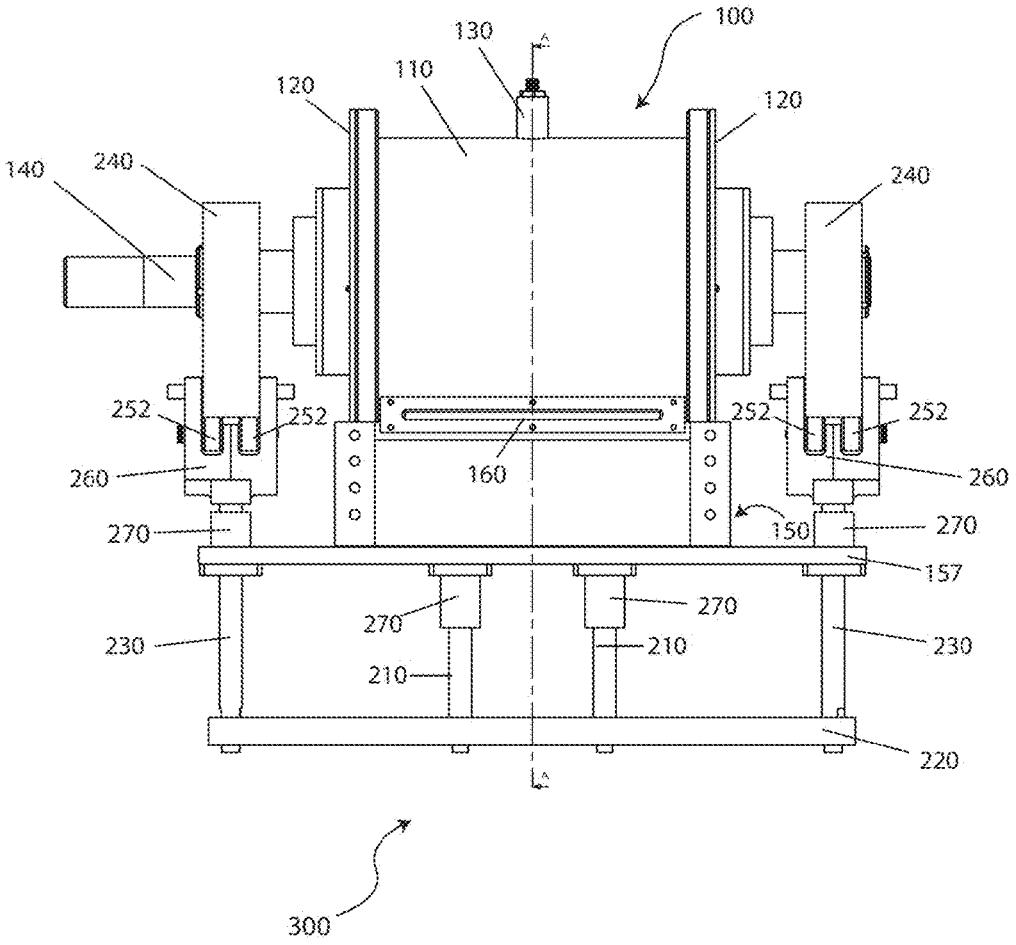
FIG. 12 is a left-side view of a rotary compressor with a dual cam follower gate positioning system in accordance with an embodiment of the present invention.
Figure 13:
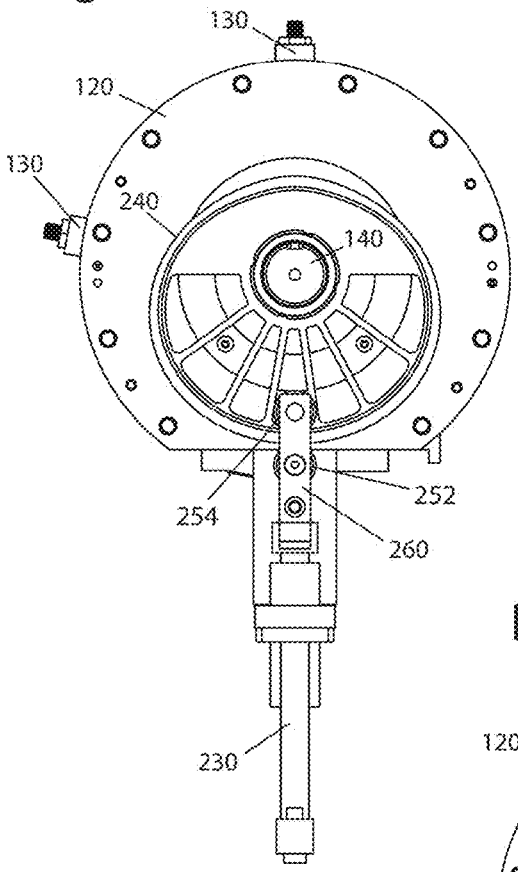
FIG. 13 is a front view of a rotary compressor with a dual cam follower gate positioning system in accordance with an embodiment of the present invention.
Figure 14:
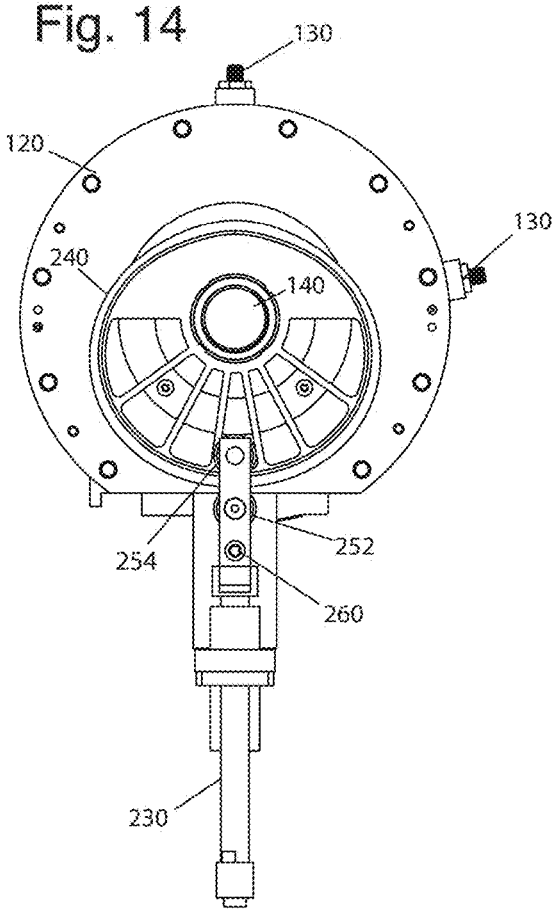
FIG. 14 is a back view of a rotary compressor with a dual cam follower gate positioning system in accordance with an embodiment of the present invention.
Figure 15:
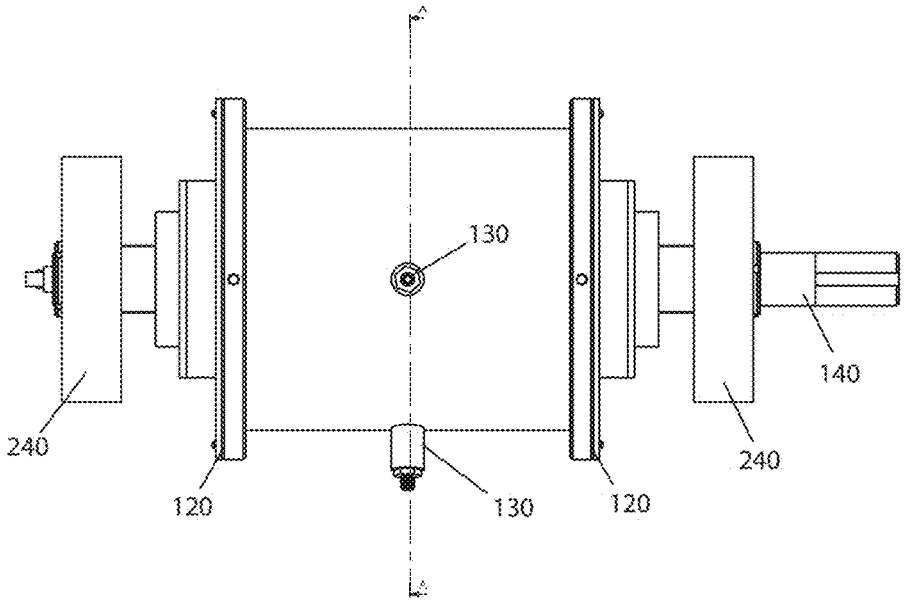
FIG. 15 is a top view of a rotary compressor with a dual cam follower gate positioning system in accordance with an embodiment of the present invention.
Figure 16:
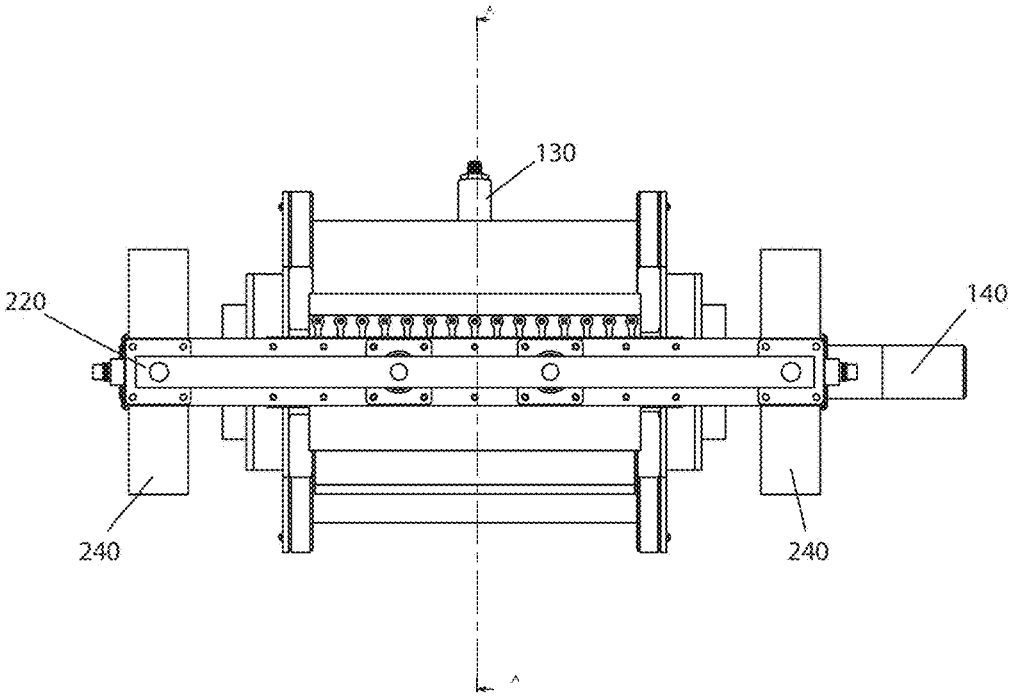
FIG. 16 is a bottom view of a rotary compressor with a dual cam follower gate positioning system in accordance with an embodiment of the present invention.

FIG. 9 shows an embodiment of the present invention in which a timing belt with spring gate positioning system is utilized. This embodiment 290 incorporates two timing belts 292 each of which is attached to the drive shaft 140 by way of sheaves 294. The timing belts 292 are attached to secondary shafts 142 by way of sheaves 295. Gate strut springs 296 are mounted around gate struts. Rocker arms 297 are mounted to rocker arm supports 299. The sheaves 295 are connected to rocker arm cams 293 to push the rocker arms 297 down. As the inner rings push down on one side of the rocker arms 297, the other side pushes up against the gate support bar 298. The gate support bar 298 pushes up against the gate struts and gate strut springs 296. This moves the gate up. The springs 296 provide a downward force pushing the gate down.

FIGS. 10 through 17 show external views of a rotary compressor embodiment utilizing a dual cam follower gate positioning system. The main housing 100 includes a main casing 110 and end plates 120, each of which includes a hole through which a drive shaft 140 passes axially. Liquid injector assemblies 130 are located on holes in the main casing 110. The main casing 110 also includes a hole for the inlet flange 160 and a hole for the gate casing 150. The gate casing 150 is mounted to and positioned below the main casing 110 as discussed above.

A dual cam follower gate positioning system 300 is attached to the gate casing 150 and drive shaft 140. The dual cam follower gate positioning system 300 moves the gate 600 in conjunction with the rotation of the rotor 500. In a preferred embodiment, the size and shape of the cams is nearly identical to the rotor in cross-sectional size and shape. In other embodiments, the rotor, cam shape, curvature, cam thickness, and variations in the thickness of the lip of the cam may be adjusted to account for variations in the attack angle of the cam follower. Further, large or smaller cam sizes may be used. For example, a similar shape but smaller size cam may be used to reduce roller speeds.

A movable assembly includes gate struts 210 and cam struts 230 connected to gate support arm 220 and bearing support plate 156. In this embodiment, the bearing support plate 157 is straight. As one of ordinary skill in the art would appreciate, the bearing support plate can utilize different geometries, including structures designed to or not to perform sealing of the gate casing 150. In this embodiment, the bearing support plate 157 serves to seal the bottom of the gate casing 150 through a bolted gasket connection. Bearing housings 270, also known as pillow blocks, are mounted to bearing support plate 157 and are concentric to the gate struts 210 and the cam struts 230. In certain embodiments, the components comprising this movable assembly may be optimized to reduce weight, thereby reducing the force necessary to achieve the necessary acceleration to keep the tip of gate 600 proximate to the rotor 500. Weight reduction could additionally and/or alternatively be achieved by removing material from the exterior of any of the moving components, as well as by hollowing out moving components, such as the gate struts 210 or the gate 600.

Drive shaft 140 turns cams 240, which transmit force to the cam followers 250, including upper cam followers 252 and lower cam followers 254. The cam followers 250 may be mounted on a through shaft, which is supported on both ends, or cantilevered and only supported on one end. In this embodiment, four cam followers 250 are used for each cam 240. Two lower cam followers 252 are located below and follow the outside edge of the cam 240. They are mounted using a through shaft. Two upper cam followers 254 are located above the previous two and follow the inside edge of the cams 240. They are mounted using a cantilevered connection.

The cam followers 250 are attached to cam follower supports 260, which transfer the force into the cam struts 230. As the cams 240 turn, the cam struts 230 move up and down. This moves the gate support arm 220 and gate struts 210 up and down, which in turn, moves the gate 600 up and down.

Figure 17:
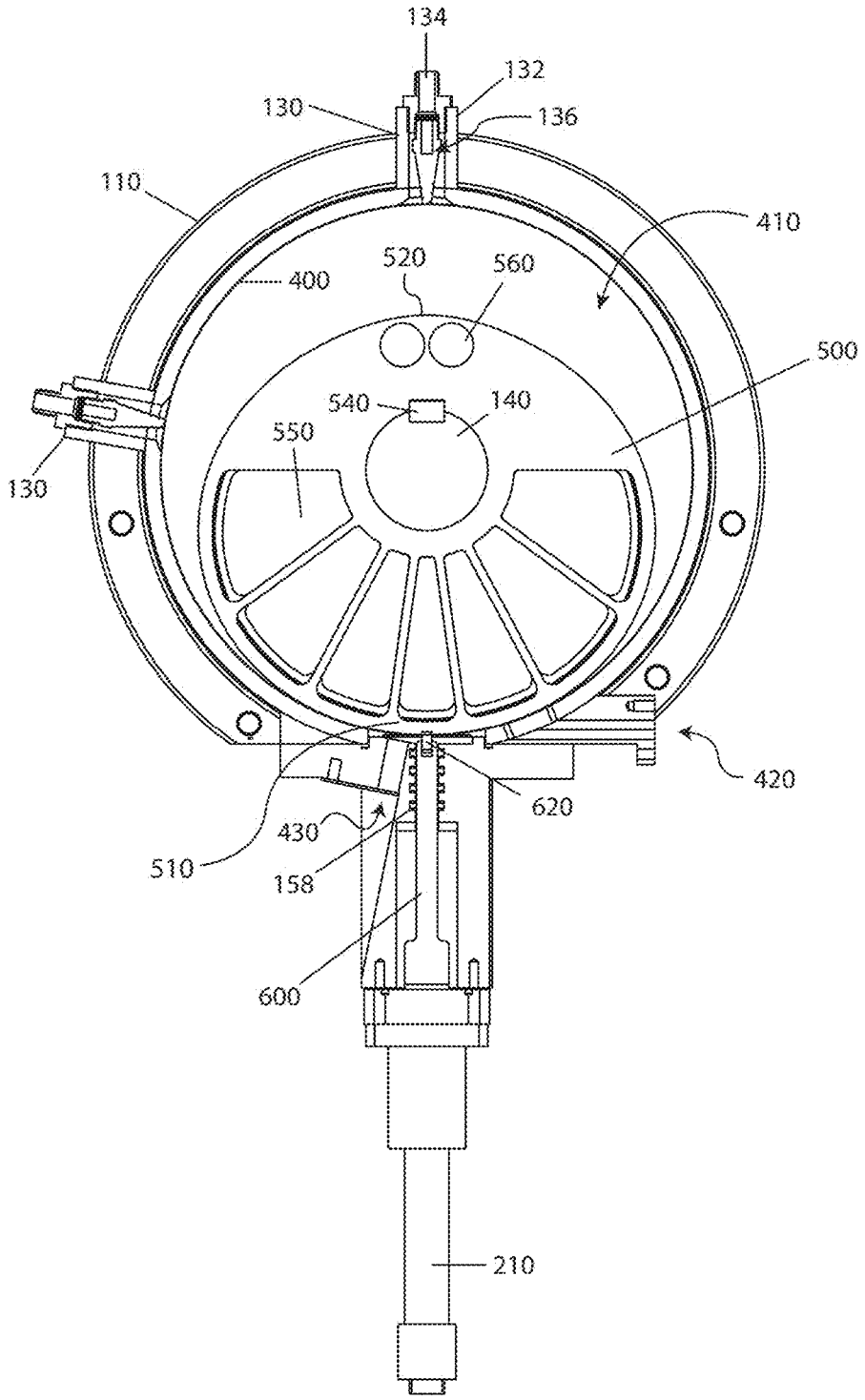
FIG. 17 is a cross-sectional view of a rotary compressor with a dual cam follower gate positioning system in accordance with an embodiment of the present invention.

Line A in FIGS. 11, 12, 15, and 16 show the location for the cross-sectional view of the compressor in FIG. 17. As shown in FIG. 17, the main casing 110 has a cylindrical shape. Liquid injector housings 132 are attached to or may be cast as a part of the main casing 110 to provide for openings in the rotor casing 400. The rotor 500 concentrically rotates around drive shaft 140.

Figure 18:
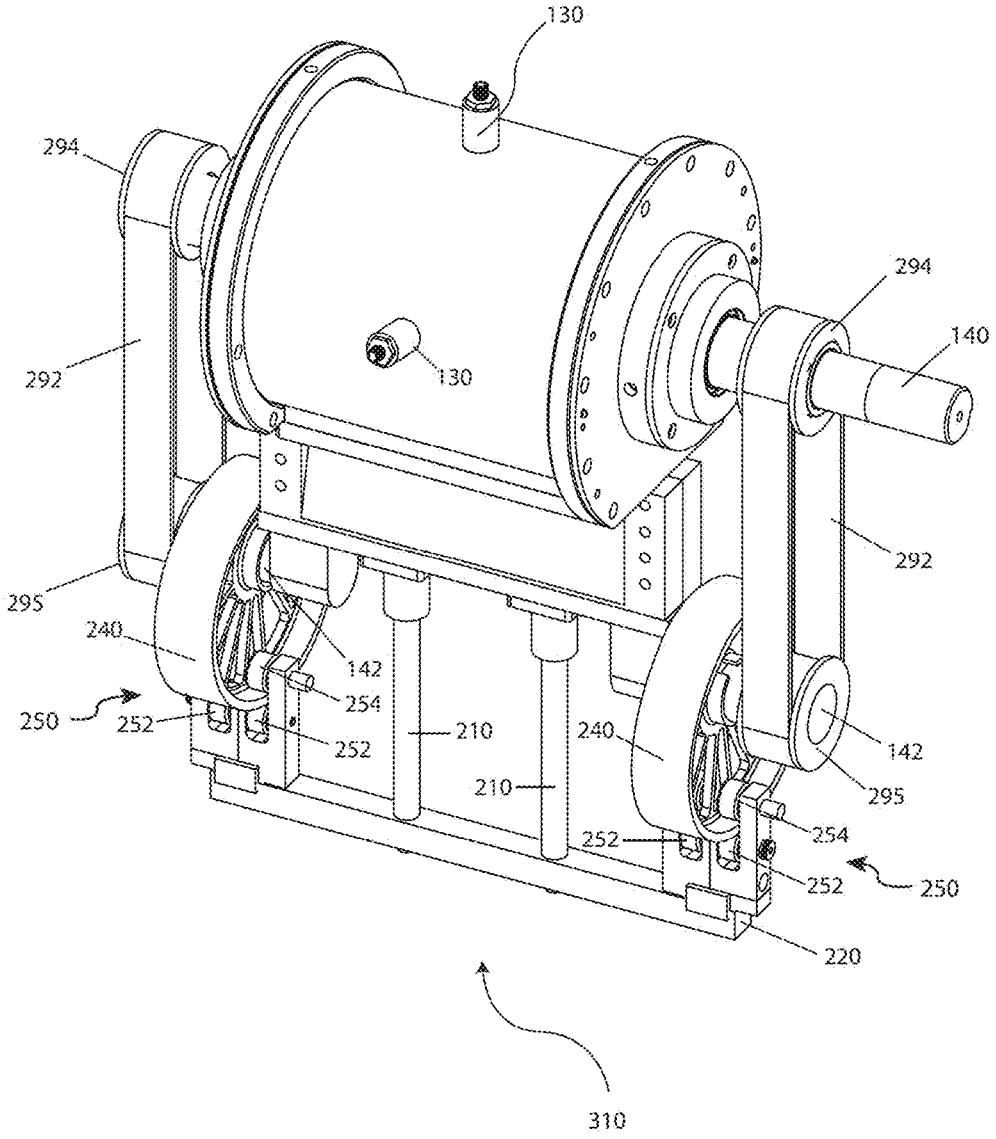
FIG. 18 is perspective view of a rotary compressor with a belt-driven gate positioning system in accordance with an embodiment of the present invention.
Figure 19:
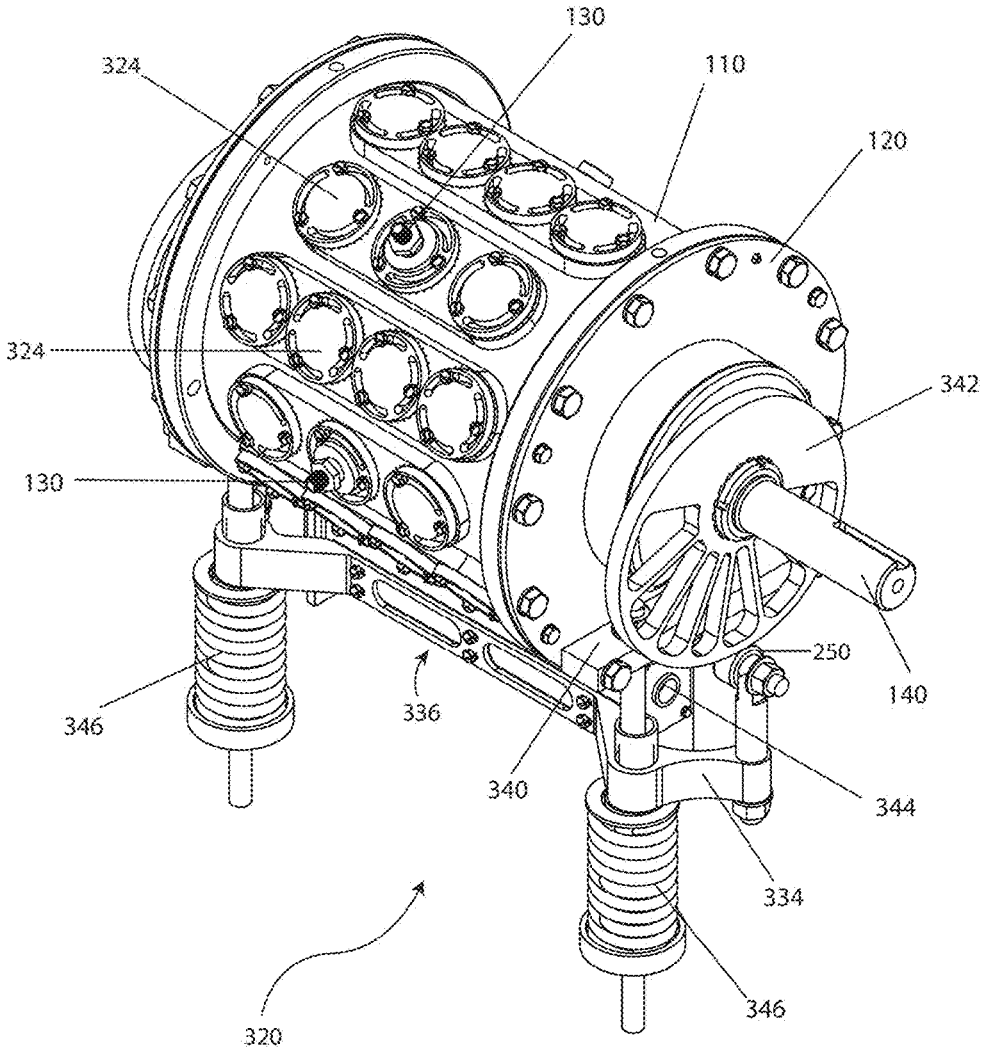
FIG. 19 is perspective view of a rotary compressor with an offset gate guide positioning system in accordance with an embodiment of the present invention.
Figure 20:
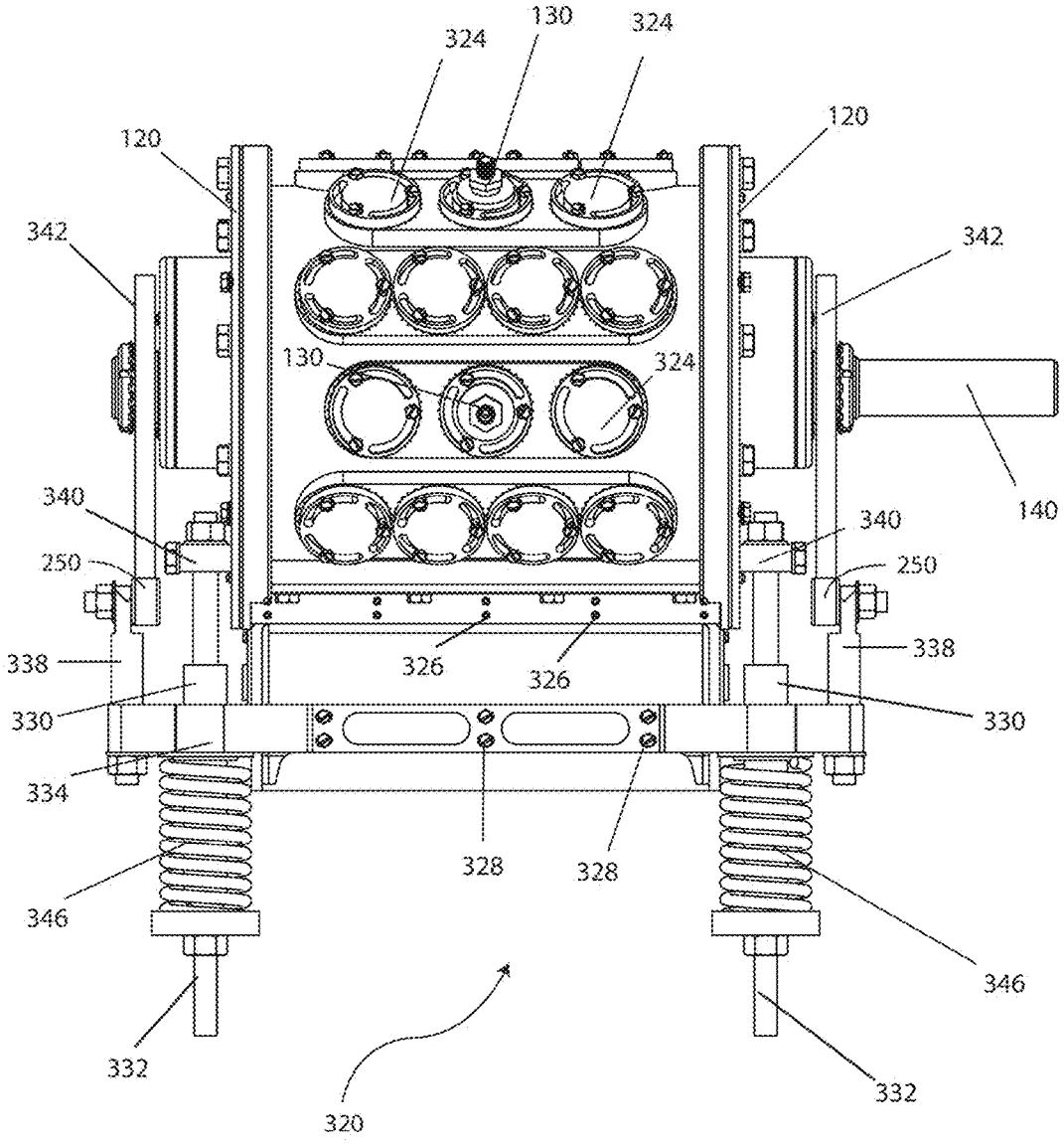
FIG. 20 is a right-side view of a rotary compressor with an offset gate guide positioning system in accordance with an embodiment of the present invention.
Figure 21:
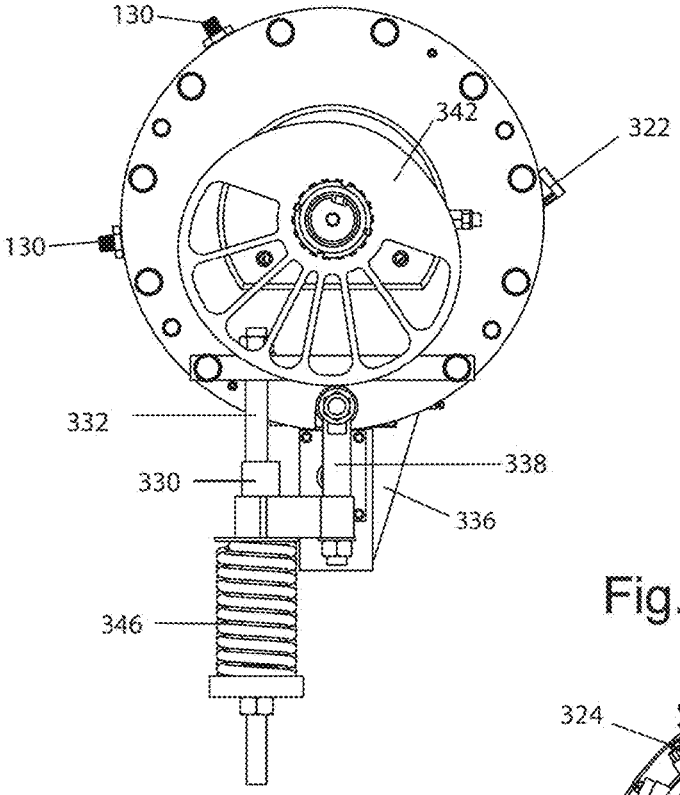
FIG. 21 is a front view of a rotary compressor with an offset gate guide positioning system in accordance with an embodiment of the present invention.
Figure 22:
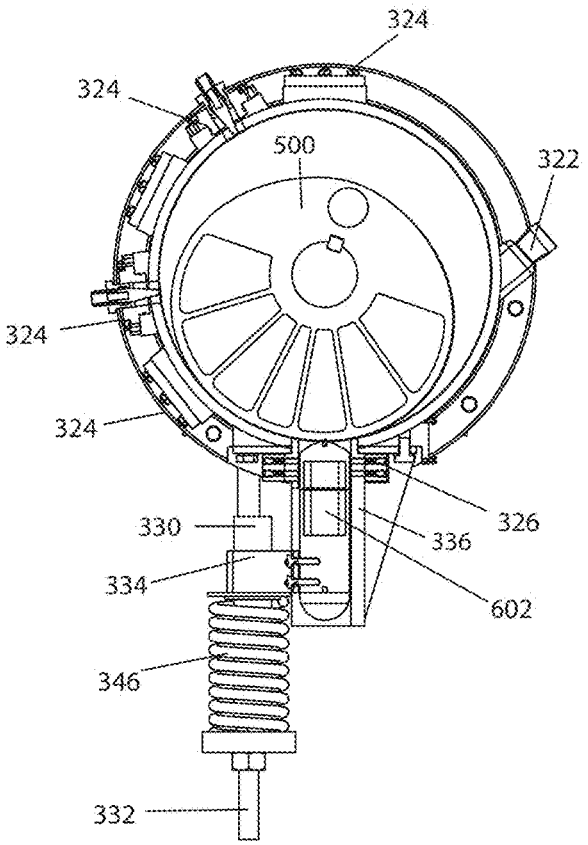
FIG. 22 is a cross-sectional view of a rotary compressor with an offset gate guide positioning system in accordance with an embodiment of the present invention.

An embodiment using a belt driven system 310 is shown in FIG. 18. Timing belts 292 are connected to the drive shaft 140 by way of sheaves 294. The timing belts 292 are each also connected to secondary shafts 142 by way of another set of sheaves 295. The secondary shafts 142 drive the external cams 240, which are placed below the gate casing 150 in this embodiment. Sets of upper and lower cam followers 254 and 252 are applied to the cams 240, which provide force to the movable assembly including gate struts 210 and gate support arm 220. As one of ordinary skill in the art would appreciate, belts may be replaced by chains or other materials.

An embodiment of the present invention using an offset gate guide system is shown in FIGS. 19 through 22 and 33. Outlet of the compressed gas and injected fluid is achieved through a ported gate system 602 comprised of two parts bolted together to allow for internal lightening features. Fluid passes through channels 630 in the upper portion of the gate 602 and travels to the lengthwise sides to outlet through an exhaust port 344 in a timed manner with relation to the angle of rotation of the rotor 500 during the cycle. Discrete point spring-backed scraper seals 326 provide sealing of the gate 602 in the single piece gate casing 336. Liquid injection is achieved through a variety of flat spray nozzles 322 and injector nozzles 130 across a variety of liquid injector port 324 locations and angles.

Reciprocating motion of the two-piece gate 602 is controlled through the use of an offset spring-backed cam follower control system 320 to achieve gate motion in concert with rotor rotation. Single cams 342 drive the gate system downwards through the transmission of force on the cam followers 250 through the cam struts 338. This results in controlled motion of the crossarm 334, which is connected by bolts (some of which are labeled as 328) with the two-piece gate 602. The crossarm 334 mounted linear bushings 330, which reciprocate along the length of cam shafts 332, control the motion of the gate 602 and the crossarm 334. The cam shafts 332 are fixed in a precise manner to the main casing through the use of cam shaft support blocks 340. Compression springs 346 are utilized to provide a returning force on the crossarm 334, allowing the cam followers 250 to maintain constant rolling contact with the cams, thereby achieving controlled reciprocating motion of the two-piece gate 602.

Figure 23:
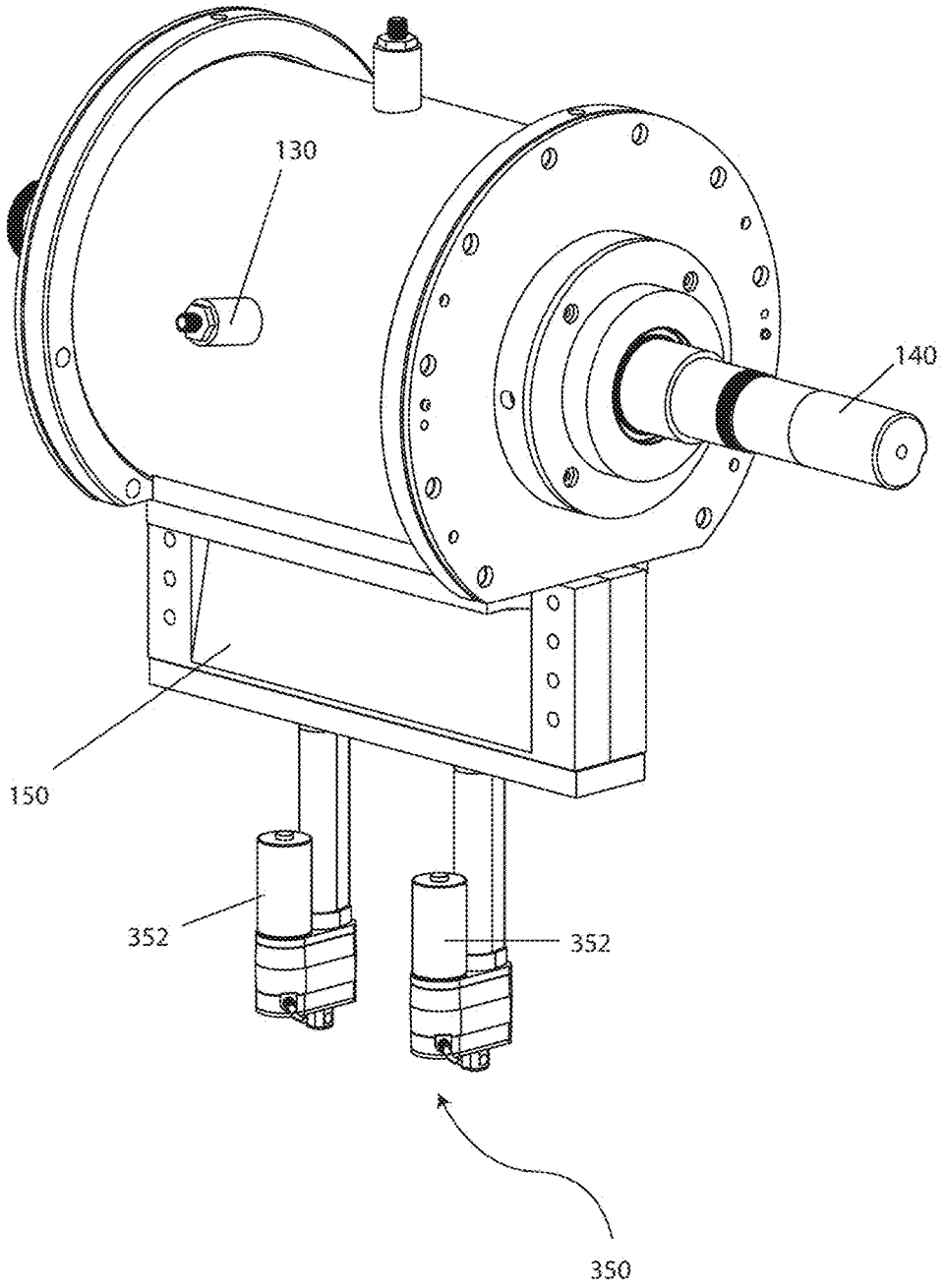
FIG. 23 is perspective view of a rotary compressor with a linear actuator gate positioning system in accordance with an embodiment of the present invention.

FIG. 23 shows an embodiment using a linear actuator system 350 for gate positioning. A pair of linear actuators 352 is used to drive the gate. In this embodiment, it is not necessary to mechanically link the drive shaft to the gate as with other embodiments. The linear actuators 352 are controlled so as to raise and lower the gate in accordance with the rotation of the rotor. The actuators may be electronic, hydraulic, belt-driven, electromagnetic, gas-driven, variable-friction, or other means. The actuators may be computer controlled or controlled by other means.

Figure 24A:
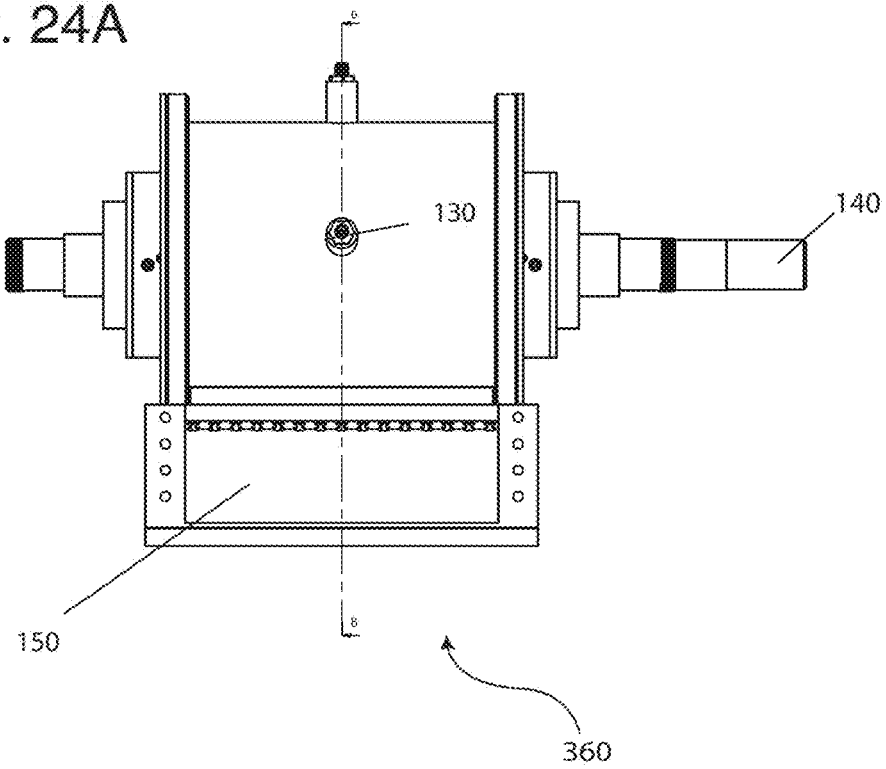
FIGS. 24A and B are right side and cross-section views, respectively, of a rotary compressor with a magnetic drive gate positioning system in accordance with an embodiment of the present invention
Figure 24B:
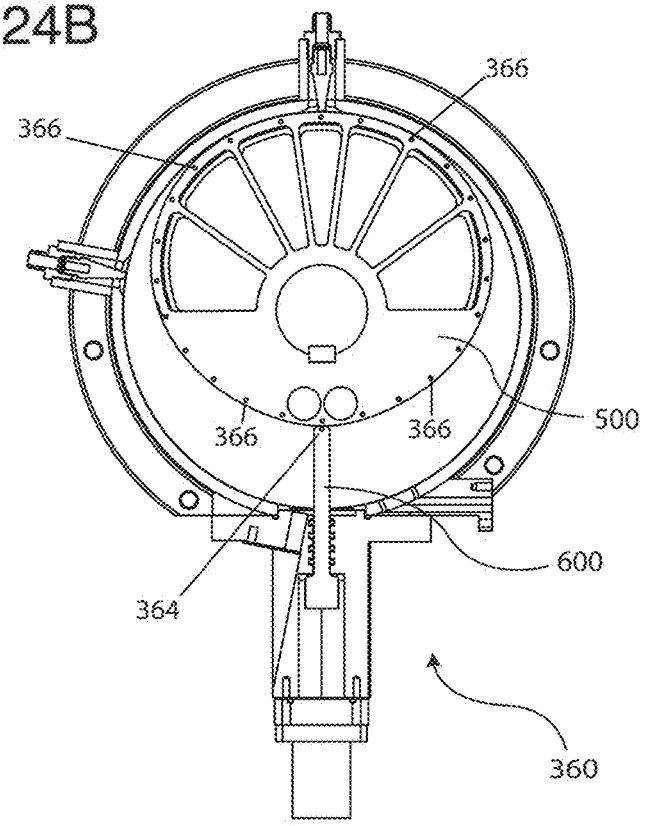

FIGS. 24A and B show a magnetic drive system 360. The gate system may be driven, or controlled, in a reciprocating motion through the placement of magnetic field generators, whether they are permanent magnets or electromagnets, on any combination of the rotor 500, gate 600, and/or gate casing 150. The purpose of this system is to maintain a constant distance from the tip of the gate 600 to the surface of the rotor 500 at all angles throughout the cycle. In a preferred magnetic system embodiment, permanent magnets 366 are mounted into the ends of the rotor 500 and retained. In addition, permanent magnets 364 are installed and retained in the gate 600. Poles of the magnets are aligned so that the magnetic force generated between the rotor's magnets 366 and the gate's magnets 364 is a repulsive force, forcing the gate 600 down throughout the cycle to control its motion and maintain constant distance. To provide an upward, returning force on the gate 600, additional magnets (not shown) are installed into the bottom of the gate 600 and the bottom of the gate casing 150 to provide an additional repulsive force. The magnetic drive systems are balanced to precisely control the gate's reciprocating motion.

Alternative embodiments may use an alternate pole orientation to provide attractive forces between the gate and rotor on the top portion of the gate and attractive forces between the gate and gate casing on the bottom portion of the gate. In place of the lower magnet system, springs may be used to provide a repulsive force. In each embodiment, electromagnets may be used in place of permanent magnets. In addition, switched reluctance electromagnets may also be utilized. In another embodiment, electromagnets may be used only in the rotor and gate. Their poles may switch at each inflection point of the gate's travel during its reciprocating cycle, allowing them to be used in an attractive and repulsive method.

Alternatively, direct hydraulic or indirect hydraulic (hydropneumatic) can be used to apply motive force/energy to the gate to drive it and position it adequately. Solenoid or other flow control valves can be used to feed and regulate the position and movement of the hydraulic or hydropneumatic elements. Hydraulic force may be converted to mechanical force acting on the gate through the use of a cylinder based or direct hydraulic actuators using membranes/diaphragms.

Figure 25:
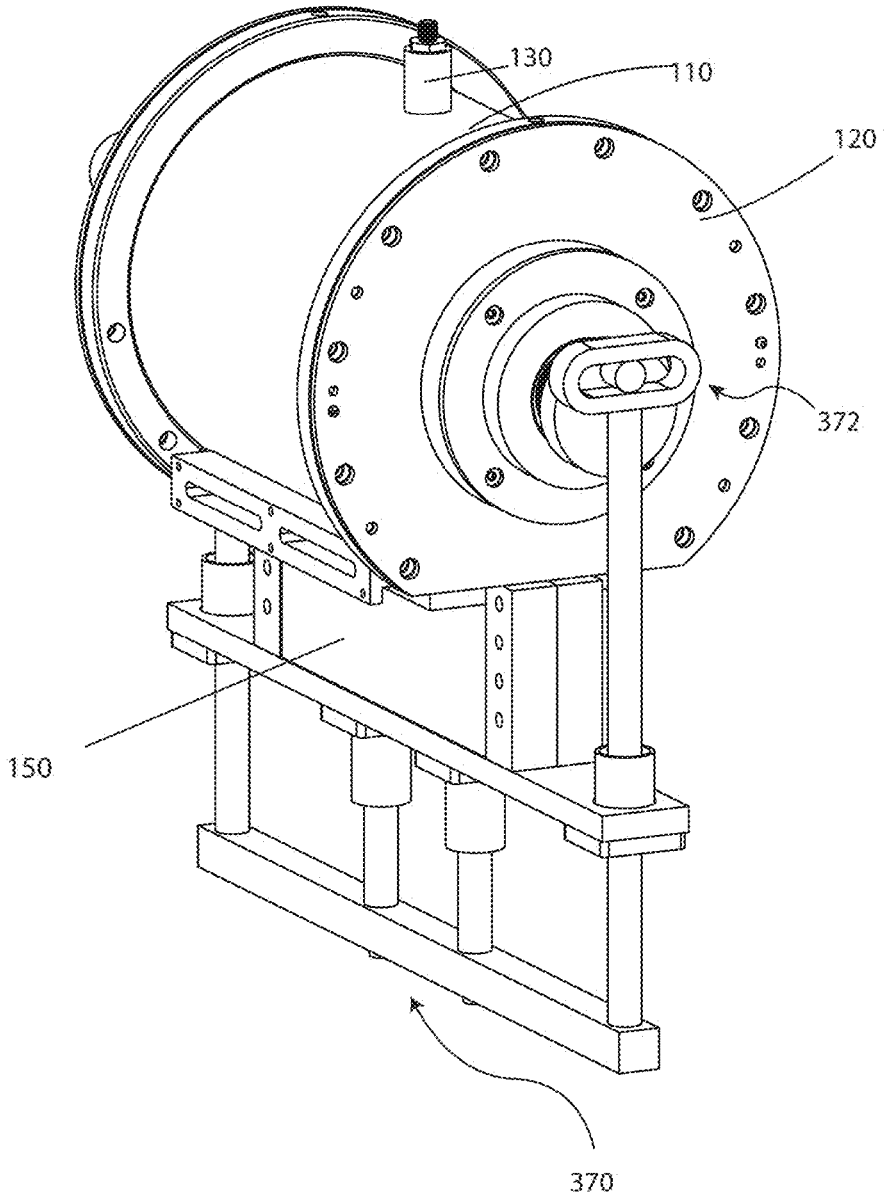
FIG. 25 is perspective view of a rotary compressor with a scotch yoke gate positioning system in accordance with an embodiment of the present invention.

FIG. 25 shows an embodiment using a scotch yoke gate positioning system 370.

Here, a pair of scotch yokes 372 is connected to the drive shaft and the bearing support plate. A roller rotates at a fixed radius with respect to the shaft. The roller follows a slot within the yoke 372, which is constrained to a reciprocating motion. The yoke geometry can be manipulated to a specific shape that will result in desired gate dynamics.

As one of skill in the art would appreciate, these alternative drive mechanisms do not require any particular number of linkages between the drive shaft and the gate. For example, a single spring, belt, linkage bar, or yoke could be used. Depending on the design implementation, more than two such elements could be used.

FIGS. 26A-26F show a compression cycle of an embodiment utilizing a tip seal 620. As the drive shaft 140 turns, the rotor 500 and gate strut 210 push up gate 600 so that it is timed with the rotor 500. As the rotor 500 turns clockwise, the gate 600 rises up until the rotor 500 is in the 12 o'clock position shown in FIG. 26C. As the rotor 500 continues to turn, the gate 600 moves downward until it is back at the 6 o'clock position in FIG. 26F. The gate 600 separates the portion of the cylinder that is not taken up by rotor 500 into two components: an intake component 412 and a compression component 414. In one embodiment, tip seal 620 may not be centered within the gate 600, but may instead be shifted towards one side so as to minimize the area on the top of the gate on which pressure may exert a downwards force on the gate. This may also have the effect of minimizing the clearance volume of the system. In another embodiment, the end of the tip seal 620 proximate to the rotor 500 may be rounded, so as to accommodate the varying contact angle that will be encountered as the tip seal 620 contacts the rotor 500 at different points in its rotation.

Figure 26C:
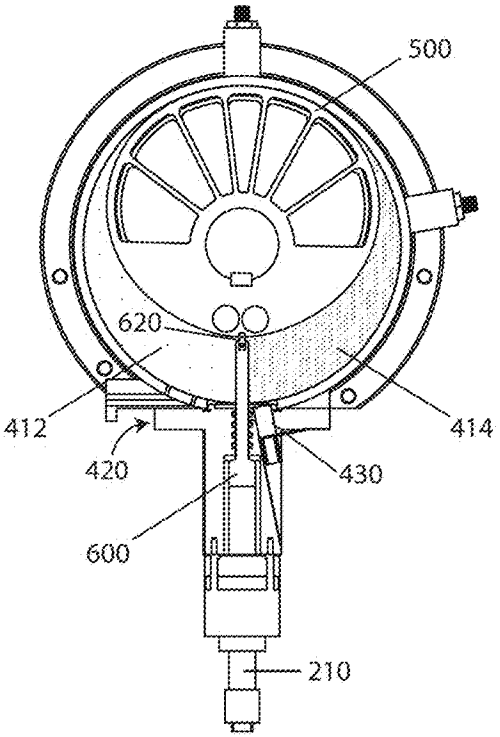
FIGS. 26A-F are cross-sectional views of the inside of an embodiment of a rotary compressor with a contacting tip seal in a compression cycle in accordance with an embodiment of the present invention.
Figure 26B:
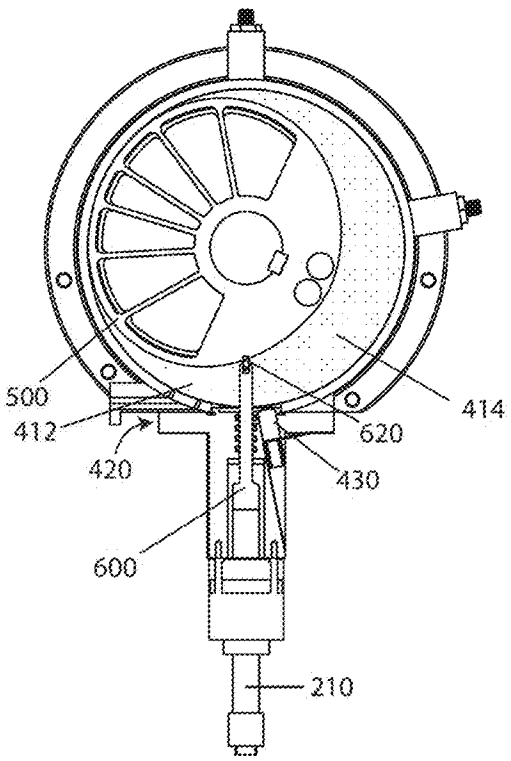
Figure 26A:
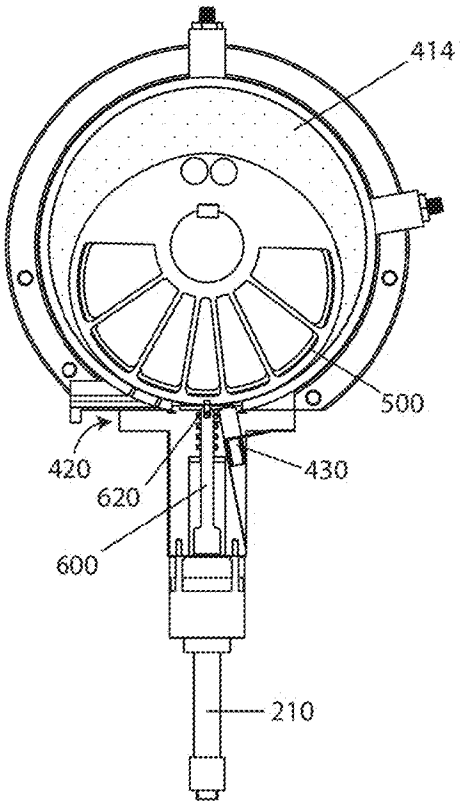
Figure 26F:
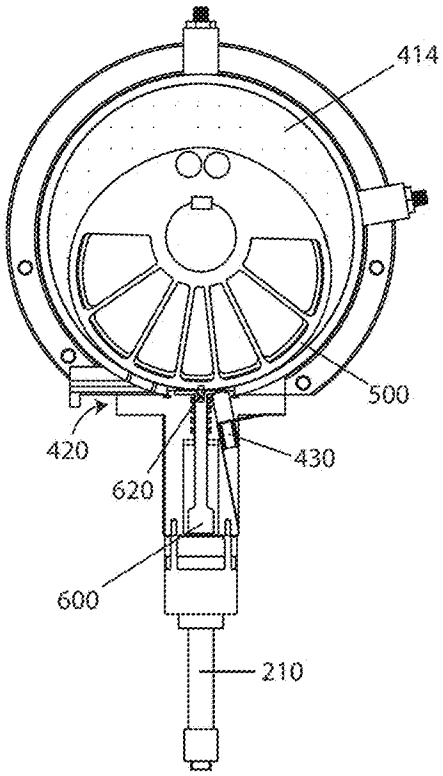
Figure 26E:
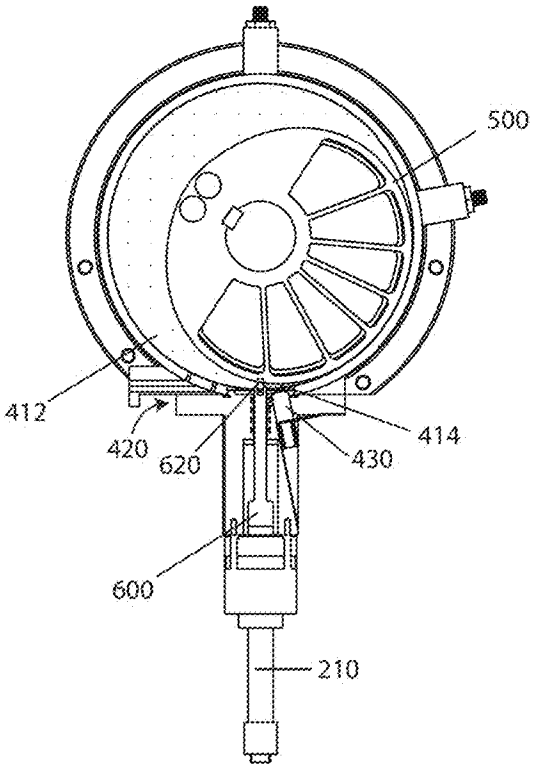
Figure 26D:
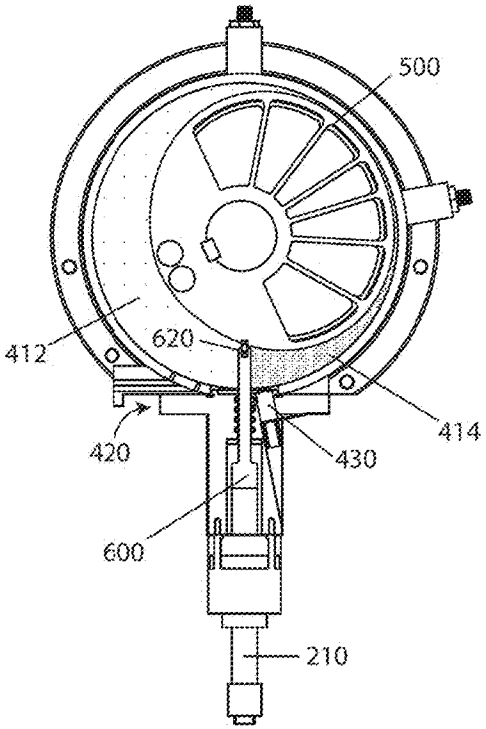
Figure 27C:
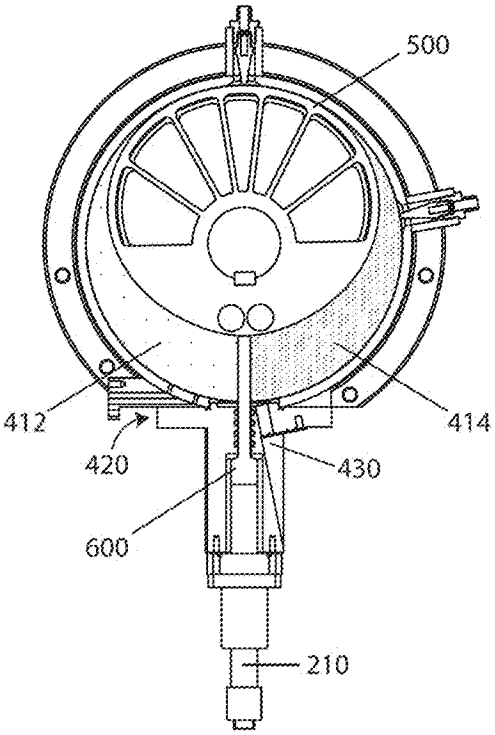
FIGS. 27A-F are cross-sectional views of the inside of an embodiment of a rotary compressor without a contacting tip seal in a compression cycle in accordance with another embodiment of the present invention.
Figure 27B:
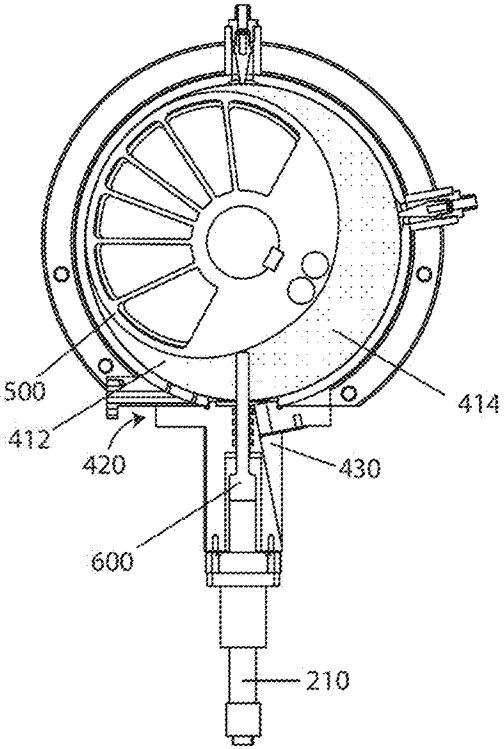
Figure 27A:
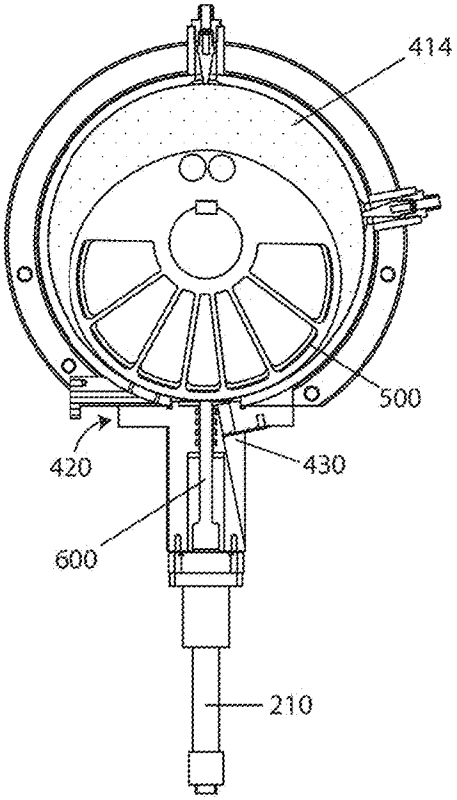
Figure 27F:
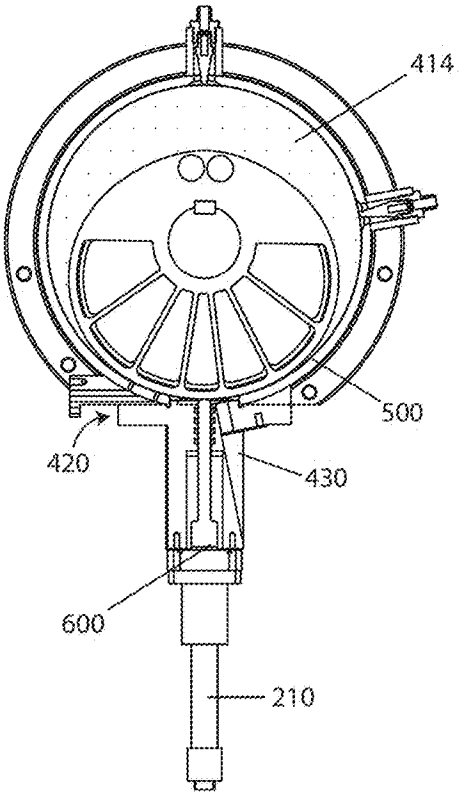
Figure 27E:
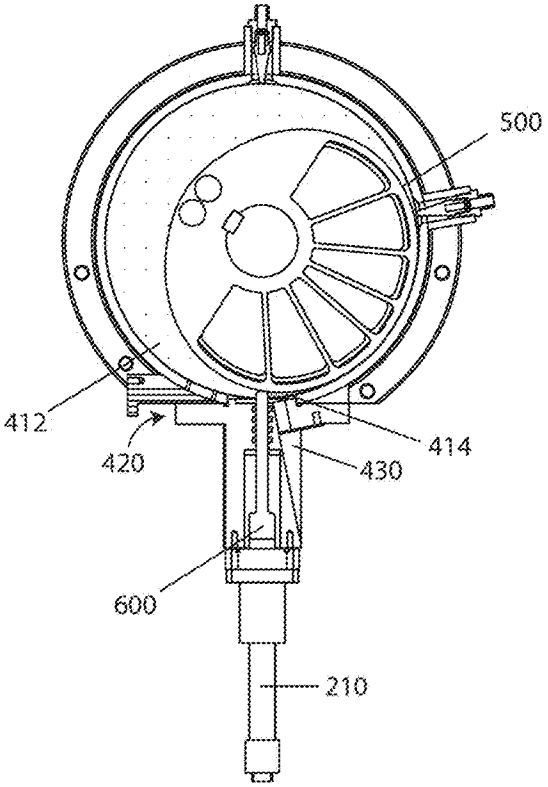
Figure 27D:
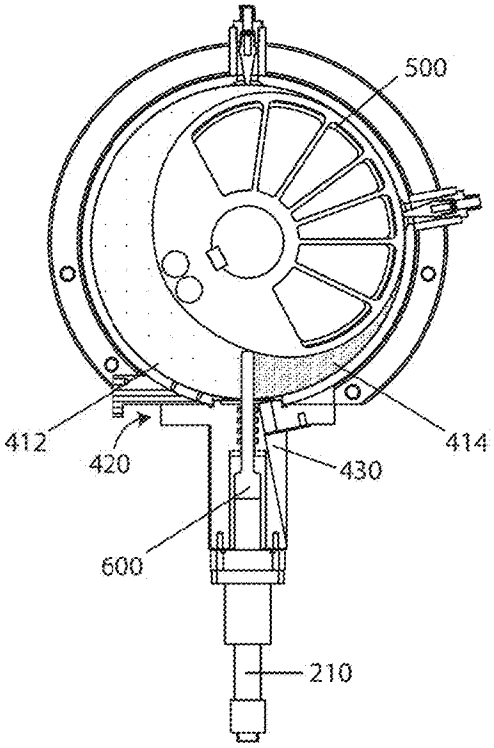

FIGS. 26A-F depict steady state operation. Accordingly, in FIG. 26A, where the rotor 500 is in the 6 o'clock position, the compression volume 414, which constitutes a subset of the rotor casing volume 410, already has received fluid. In FIG. 26B, the rotor 500 has turned clockwise and gate 600 has risen so that the tip seal 620 makes contact with the rotor 500 to separate the intake volume 412, which also constitutes a subset of the rotor casing volume 410, from the compression volume 414. Embodiments using the roller tip 650 discussed below instead of tip seal 620 would operate similarly. As the rotor 500 turns, as shown further in FIGS. 26C-E, the intake volume 412 increases, thereby drawing in more fluid from inlet 420, while the compression volume 414 decreases. As the volume of the compression volume 414 decreases, the pressure increases. The pressurized fluid is then expelled by way of an outlet 430. At a point in the compression cycle when a desired high pressure is reached, the outlet valve opens and the high pressure fluid can leave the compression volume 414. In this embodiment, the valve outputs both the compressed gas and the liquid injected into the compression chamber.

FIGS. 27A-27F show an embodiment in which the gate 600 does not use a tip seal. Instead, the gate 600 is timed to be proximate to the rotor 500 as it turns. The close proximity of the gate 600 to the rotor 500 leaves only a very small path for high pressure fluid to escape. Close proximity in conjunction with the presence of liquid (due to the liquid injectors 136 or an injector placed in the gate itself) allow the gate 600 to effectively create an intake fluid component 412 and a compression component 414. Embodiments incorporating notches 640 would operate similarly.

FIG. 28 shows a cross-sectional perspective view of the rotor casing 400, the rotor 500, and the gate 600. The inlet port 420 shows the path that gas can enter. The outlet 430 is comprised of several holes that serve as outlet ports 435 that lead to outlet valves 440. The gate casing 150 consists of an inlet side 152 and an outlet side 154. A return pressure path (not shown) may be connected to the inlet side 152 of the gate casing 150 and the inlet port 420 to ensure that there is no back pressure build up against gate 600 due to leakage through the gate seals. As one of ordinary skill in the art would appreciate, it is desirable to achieve a hermetic seal, although perfect hermetic sealing is not necessary.

In alternate embodiments, the outlet ports 435 may be located in the rotor casing 400 instead of the gate casing 150. They may be located at a variety of different locations within the rotor casing. The outlet valves 440 may be located closer to the compression chamber, effectively minimizing the volume of the outlet ports 430, to minimize the clearance volume related to these outlet ports. A valve cartridge may be used which houses one or more outlet valves 440 and connects directly to the rotor casing 400 or gate casing 150 to align the outlet valves 440 with outlet ports 435. This may allow for ease of installing and removing the outlet valves 440.

Figure 29:
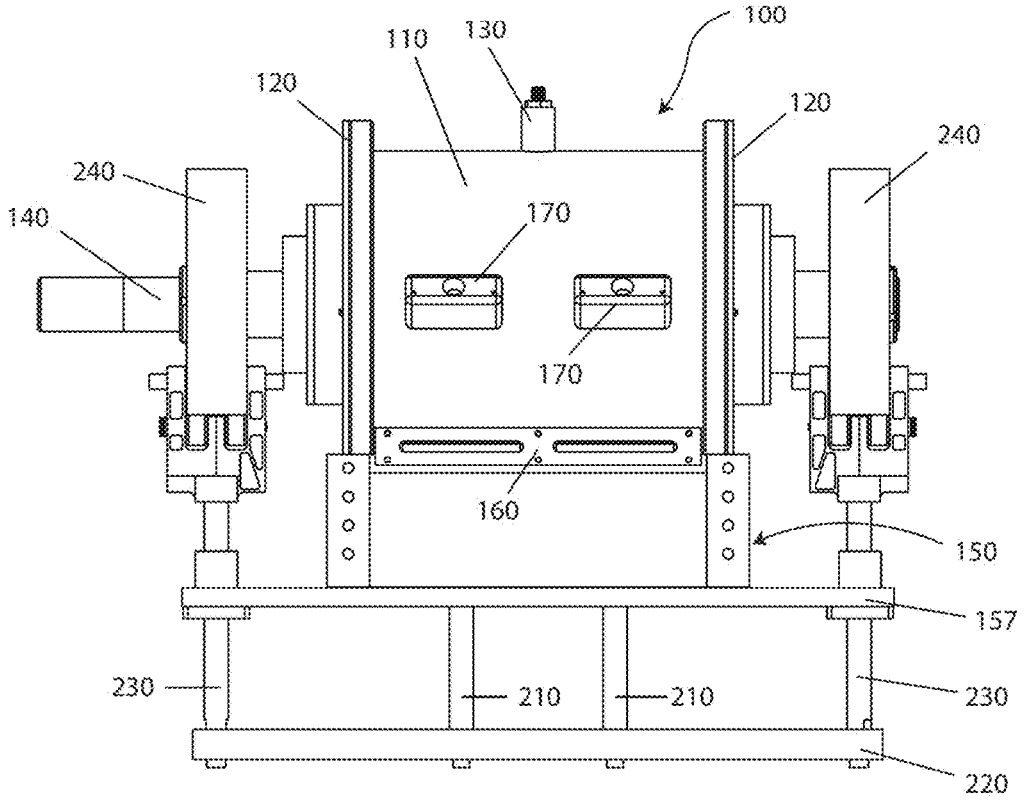
FIG. 29 is a left-side view of an additional liquid injectors embodiment of the present invention.

FIG. 29 shows an alternative embodiment in which flat spray liquid injector housings 170 are located on the main casing 110 at approximately the 3 o'clock position. These injectors can be used to inject liquid directly onto the inlet side of the gate 600, ensuring that it does not reach high temperatures. These injectors also help to provide a coating of liquid on the rotor 500, helping to seal the compressor.

Figure 30:
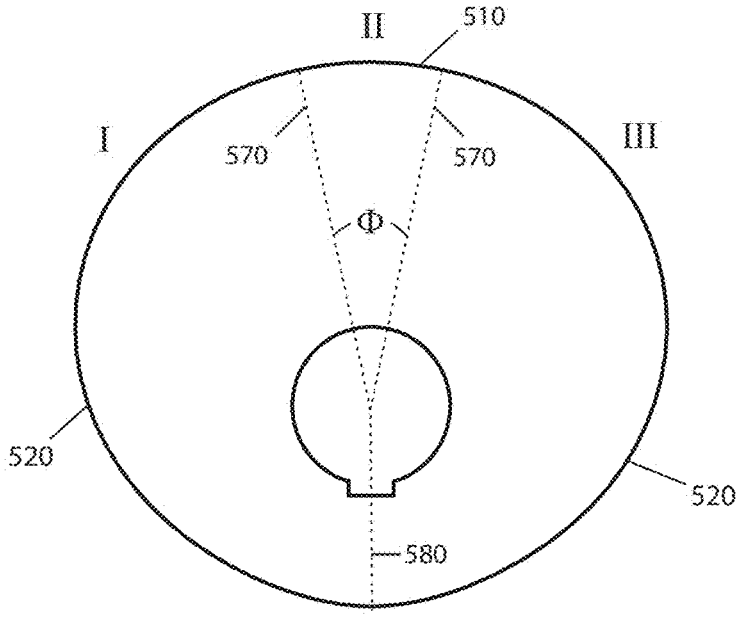
FIG. 30 is a cross-section view of a rotor design in accordance with an embodiment of the present invention.

As discussed above, the preferred embodiments utilize a rotor that concentrically rotates within a rotor casing. In the preferred embodiment, the rotor 500 is a right cylinder with a non-circular cross-section that runs the length of the main casing 110. FIG. 30 shows a cross-sectional view of the sealing and non-sealing portions of the rotor 500. The profile of the rotor 500 is comprised of three sections. The radii in sections I and III are defined by a cycloidal curve. This curve also represents the rise and fall of the gate and defines an optimum acceleration profile for the gate. Other embodiments may use different curve functions to define the radius such as a double harmonic function. Section II employs a constant radius 570, which corresponds to the maximum radius of the rotor. The minimum radius 580 is located at the intersection of sections I and III, at the bottom of rotor 500. In a preferred embodiment, Φ is 23.8 degrees. In alternative embodiments, other angles may be utilized depending on the desired size of the compressor, the desired acceleration of the gate, and desired sealing area.

The radii of the rotor 500 in the preferred embodiment can be calculated using the following functions:

$$r(t) = \begin{cases} r_I = r_{min} + h\left[\frac{t_I}{T} + \sin\left(\frac{2\pi t_I}{T}\right)\right] \\ r_{II} = r_{max} \\ r_{III} = r_{min} + h\left[\frac{t_{III}}{T} + \sin\left(\frac{2\pi t_{III}}{T}\right)\right] \end{cases}$$

In a preferred embodiment, the rotor 500 is symmetrical along one axis. It may generally resemble a cross-sectional egg shape. The rotor 500 includes a hole 530 in which the drive shaft 140 and a key 540 may be mounted. The rotor 500 has a sealing section 510, which is the outer surface of the rotor 500 corresponding to section II, and a non-sealing section 520, which is the outer surface of the rotor 500 corresponding to sections I and III. The sections I and III have a smaller radius than sections II creating a compression volume. The sealing portion 510 is shaped to correspond to the curvature of the rotor casing 400, thereby creating a dwell seal that effectively minimizes communication between the outlet 430 and inlet 420. Physical contact is not required for the dwell seal. Instead, it is sufficient to create a tortuous path that minimizes the amount of fluid that can pass through. In a preferred embodiment, the gap between the rotor and the casing in this embodiment is less than 0.008 inches. As one of ordinary skill in the art would appreciate, this gap may be altered depending on tolerances, both in machining the rotor 500 and rotor housing 400, temperature, material properties, and other specific application requirements.

Additionally, as discussed below, liquid is injected into the compression chamber. By becoming entrained in the gap between the sealing portion 510 and the rotor casing 400, the liquid can increase the effectiveness of the dwell seal.

Figure 31A:
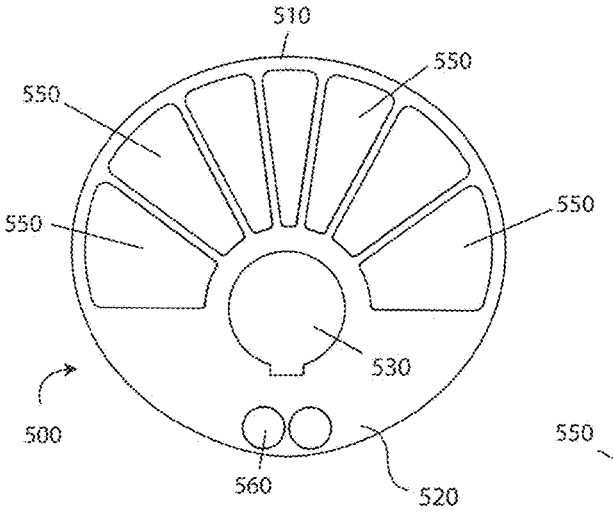
FIGS. 31A-D are cross-sectional views of rotor designs in accordance with various embodiments of the present invention.

As shown in FIG. 31A, the rotor 500 is balanced with cut out shapes and counterweights. Holes, some of which are marked as 550, lighten the rotor 500. These lightening holes may be filled with a low density material to ensure that liquid cannot encroach into the rotor interior. Alternatively, caps may be placed on the ends of rotor 500 to seal the lightening holes. Counterweights, one of which is labeled as 560, are made of a denser material than the remainder of the rotor 500. The shapes of the counterweights can vary and do not need to be cylindrical.

The rotor design provides several advantages. As shown in the embodiment of FIG. 31A, the rotor 500 includes 7 cutout holes 550 on one side and two counterweights 560 on the other side to allow the center of mass to match the center of rotation. An opening 530 includes space for the drive shaft and a key. This weight distribution is designed to achieve balanced, concentric motion. The number and location of cutouts and counterweights may be changed depending on structural integrity, weight distribution, and balanced rotation parameters. In various embodiments, cutouts and/or counterweights or neither may be used required to achieve balanced rotor rotation.

The cross-sectional shape of the rotor 500 allows for concentric rotation about the drive shaft's axis of rotation, a dwell seal 510 portion, and open space on the non-sealing side for increased gas volume for compression. Concentric rotation provides for rotation about the drive shaft's principal axis of rotation and thus smoother motion and reduced noise.

Figure 31B:
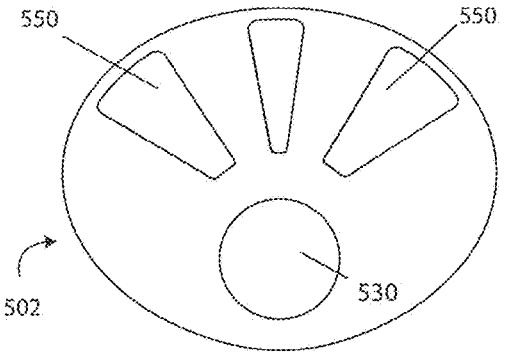
Figure 31C:
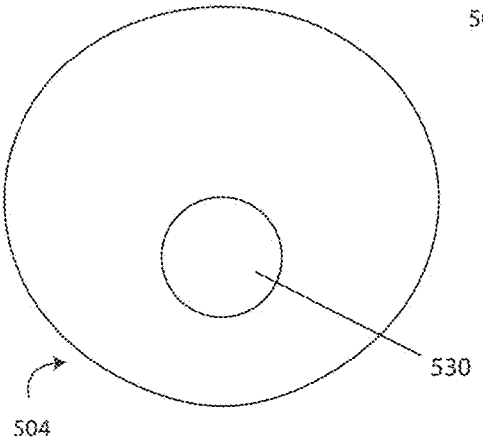
Figure 31D:
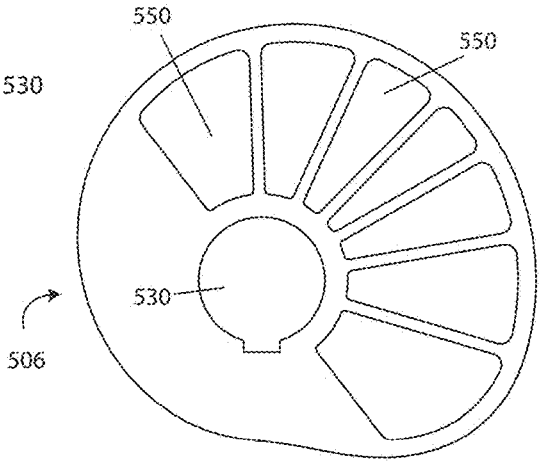

An alternative rotor design 502 is shown in FIG. 31B. In this embodiment, a different arc of curvature is implemented utilizing three holes 550 and a circular opening 530. Another alternative design 504 is shown in FIG. 31C. Here, a solid rotor shape is used and a larger hole 530 (for a larger drive shaft) is implemented. Yet another alternative rotor design 506 is shown in FIG. 31D incorporating an asymmetrical shape, which would smooth the volume reduction curve, allowing for increased time for heat transfer to occur at higher pressures. Alternative rotor shapes may be implemented for different curvatures or needs for increased volume in the compression chamber.

The rotor surface may be smooth in embodiments with contacting tip seals to minimize wear on the tip seal. In alternative embodiments, it may be advantageous to put surface texture on the rotor to create turbulence that may improve the performance of non-contacting seals. In other embodiments, the rotor casing's interior cylindrical wall may further be textured to produce additional turbulence, both for sealing and heat transfer benefits. This texturing could be achieved through machining of the parts or by utilizing a surface coating. Another method of achieving the texture would be through blasting with a waterj et, sandblast, or similar device to create an irregular surface.

The main casing 110 may further utilize a removable cylinder liner. This liner may feature microsurfacing to induce turbulence for the benefits noted above. The liner may also act as a wear surface to increase the reliability of the rotor and casing. The removable liner could be replaced at regular intervals as part of a recommended maintenance schedule. The rotor may also include a liner. Sacrifical or wear-in coatings may be used on the rotor 500 or rotor casing 400 to correct for manufacturing defects in ensuring the preferred gap is maintained along the sealing portion 510 of the rotor 500.

The exterior of the main casing 110 may also be modified to meet application specific parameters. For example, in subsea applications, the casing may require to be significantly thickened to withstand exterior pressure, or placed within a secondary pressure vessel. Other applications may benefit from the exterior of the casing having a rectangular or square profile to facilitate mounting exterior objects or stacking multiple compressors. Liquid may be circulated in the casing interior to achieve additional heat transfer or to equalize pressure in the case of subsea applications for example.

Figure 32A:
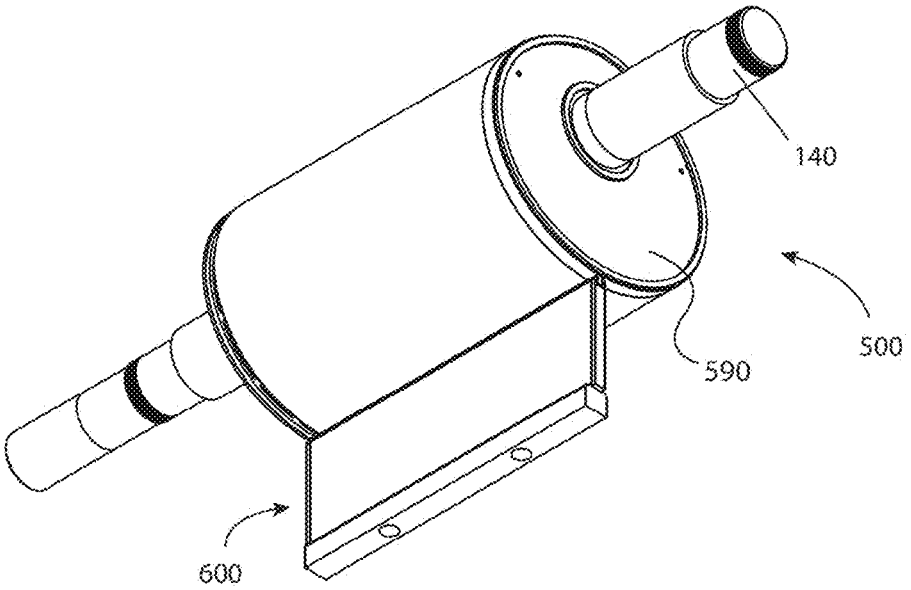
FIGS. 32A and B are perspective and right-side views of a drive shaft, rotor, and gate in accordance with an embodiment of the present invention.
Figure 32B:
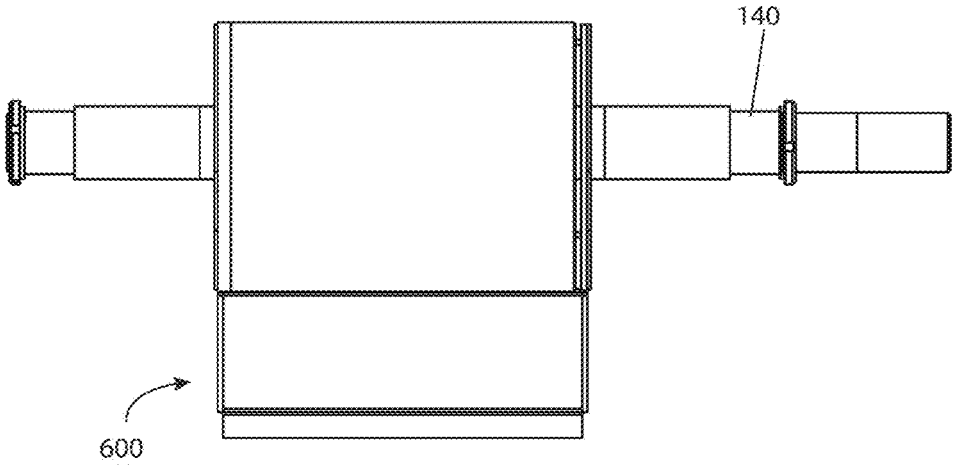
Figure 33:
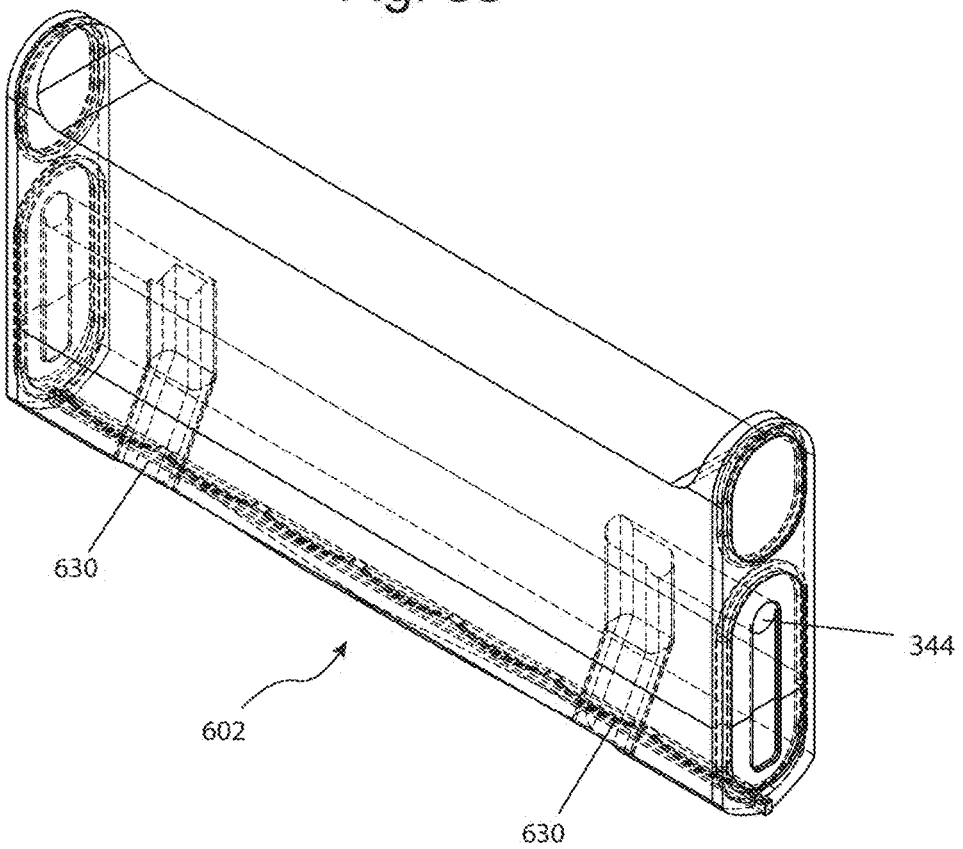
FIG. 33 is a perspective view of a gate with exhaust ports in accordance with an embodiment of the present invention.

As shown in FIGS. 32A and B, the combination of the rotor 500 (here depicted with rotor end caps 590), the gate 600, and drive shaft 140, provide for a more efficient manner of compressing fluids in a cylinder. The gate is aligned along the length of the rotor to separate and define the inlet portion and compression portion as the rotor turns.

The drive shaft 140 is mounted to endplates 120 in the preferred embodiment using one spherical roller bearing in each endplate 120. More than one bearing may be used in each endplate 120, in order to increase total load capacity. A grease pump (not shown) is used to provide lubrication to the bearings. Various types of other bearings may be utilized depending on application specific parameters, including roller bearings, ball bearings, needle bearings, conical bearings, cylindrical bearings, journal bearings, etc. Different lubrication systems using grease, oil, or other lubricants may also be used. Further, dry lubrication systems or materials may be used. Additionally, applications in which dynamic imbalance may occur may benefit from multi-bearing arrangements to support stray axial loads.

Operation of gates in accordance with embodiments of the present invention are shown in FIGS. 8, 17, 22, 24B, 26A-F, 27A-F, 28, 32A-B, and 33-36. As shown in FIGS. 26A-F and 27A-F, gate 600 creates a pressure boundary between an intake volume 412 and a compression volume 414. The intake volume 412 is in communication with the inlet 420. The compression volume 414 is in communication with the outlet 430. Resembling a reciprocating, rectangular piston, the gate 600 rises and falls in time with the turning of the rotor 500.

The gate 600 may include an optional tip seal 620 that makes contact with the rotor 500, providing an interface between the rotor 500 and the gate 600. Tip seal 620 consists of a strip of material at the tip of the gate 600 that rides against rotor 500. The tip seal 620 could be made of different materials, including polymers, graphite, and metal, and could take a variety of geometries, such as a curved, flat, or angled surface. The tip seal 620 may be backed by pressurized fluid or a spring force provided by springs or elastomers. This provides a return force to keep the tip seal 620 in sealing contact with the rotor 500.

Figure 35:
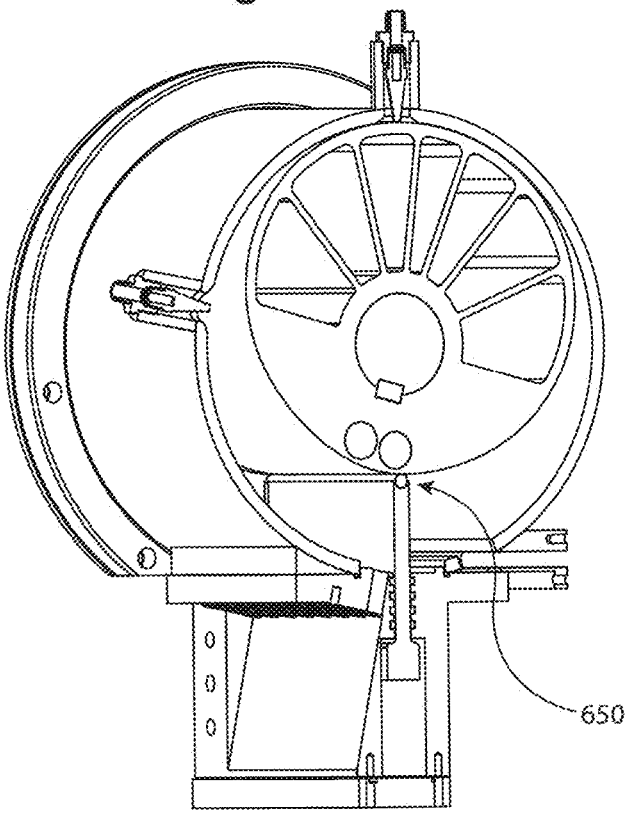
FIG. 35 is a cross-sectional, perspective view a gate with a rolling tip in accordance with an embodiment of the present invention.

Different types of contacting tips may be used with the gate 600. As shown in FIG. 35, a roller tip 650 may be used. The roller tip 650 rotates as it makes contact with the turning rotor 500. Also, tips of differing strengths may be used. For example, a tip seal 620 or roller tip 650 may be made of softer metal that would gradually wear down before the rotor 500 surfaces would wear.

Alternatively, a non-contacting seal may be used. Accordingly, the tip seal may be omitted. In these embodiments, the topmost portion of the gate 600 is placed proximate, but not necessarily in contact with, the rotor 500 as it turns. The amount of allowable gap may be adjusted depending on application parameters.

Figure 34A:
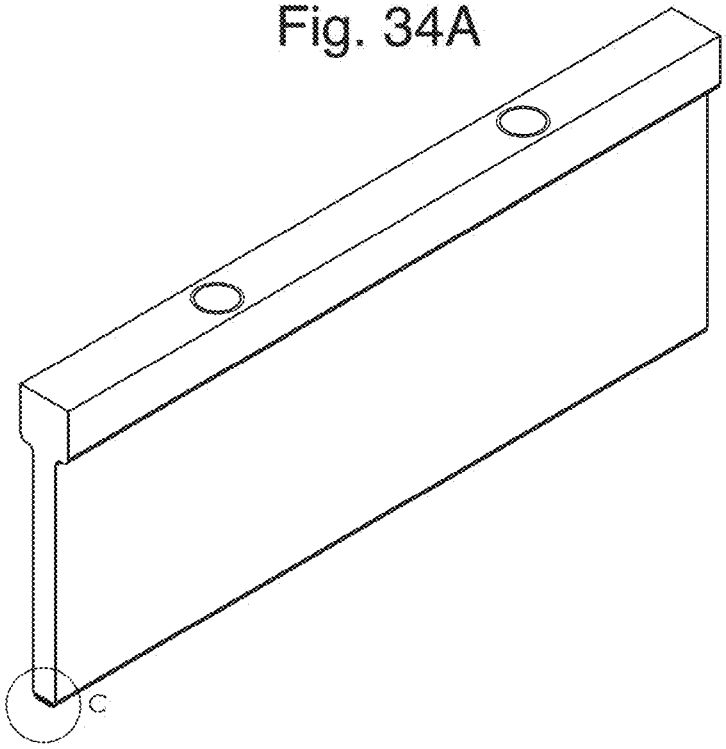
FIGS. 34A and B are a perspective view and magnified view of a gate with notches, respectively, in accordance with an embodiment of the present invention.
Figure 34B:
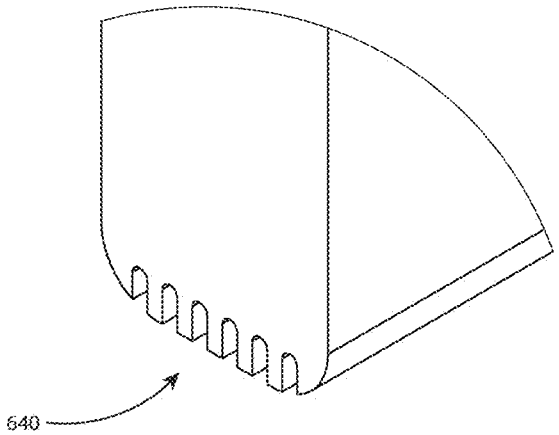

As shown in FIGS. 34A and 34B, in an embodiment in which the tip of the gate 600 does not contact the rotor 500, the tip may include notches 640 that serve to keep gas pocketed against the tip of the gate 600. The entrained fluid, in either gas or liquid form, assists in providing a non-contacting seal. As one of ordinary skill in the art would appreciate, the number and size of the notches is a matter of design choice dependent on the compressor specifications.

Figure 36:
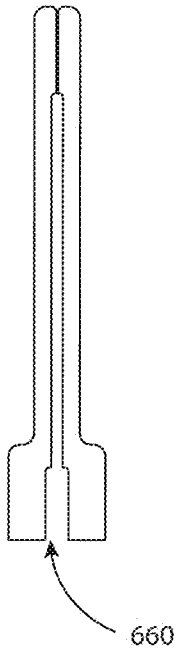
FIG. 36 is a cross-sectional front view of a gate with a liquid injection channel in accordance with an embodiment of the present invention.

Alternatively, liquid may be injected from the gate itself. As shown in FIG. 36, a cross-sectional view of a portion of a gate, one or more channels 660 from which a fluid may pass may be built into the gate. In one such embodiment, a liquid can pass through a plurality of channels 660 to form a liquid seal between the topmost portion of the gate 600 and the rotor 500 as it turns. In another embodiment, residual compressed fluid may be inserted through one or more channels 660. Further still, the gate 600 may be shaped to match the curvature of portions of the rotor 500 to minimize the gap between the gate 600 and the rotor 500.

Preferred embodiments enclose the gate in a gate casing. As shown in FIGS. 8 and 17, the gate 600 is encompassed by the gate casing 150, including notches, one of which is shown as item 158. The notches hold the gate seals, which ensure that the compressed fluid will not release from the compression volume 414 through the interface between gate 600 and gate casing 150 as gate 600 moves up and down. The gate seals may be made of various materials, including polymers, graphite or metal. A variety of different geometries may be used for these seals. Various embodiments could utilize different notch geometries, including ones in which the notches may pass through the gate casing, in part or in full.

In alternate embodiments, the seals could be placed on the gate 600 instead of within the gate casing 150. The seals would form a ring around the gate 600 and move with the gate relative to the casing 150, maintaining a seal against the interior of the gate casing 150. The location of the seals may be chosen such that the center of pressure on the gate 600 is located on the portion of the gate 600 inside of the gate casing 150, thus reducing or eliminating the effect of a cantilevered force on the portion of the gate 600 extending into the rotor casing 400. This may help eliminate a line contact between the gate 600 and gate casing 150 and instead provide a surface contact, allowing for reduced friction and wear. One or more wear plates may be used on the gate 600 to contact the gate casing 150. The location of the seals and wear plates may be optimized to ensure proper distribution of forces across the wear plates.

The seals may use energizing forces provided by springs or elastomers with the assembly of the gate casing 150 inducing compression on the seals. Pressurized fluid may also be used to energize the seals.

The gate 600 is shown with gate struts 210 connected to the end of the gate. In various embodiments, the gate 600 may be hollowed out such that the gate struts 210 can connect to the gate 600 closer to its tip. This may reduce the amount of thermal expansion encountered in the gate 600. A hollow gate also reduces the weight of the moving assembly and allows oil or other lubricants and coolants to be splashed into the interior of the gate to maintain a cooler temperature. The relative location of where the gate struts 210 connect to the gate 600 and where the gate seals are located may be optimized such that the deflection modes of the gate 600 and gate struts 210 are equal, allowing the gate 600 to remain parallel to the interior wall of the gate casing 150 when it deflects due to pressure, as opposed to rotating from the pressure force. Remaining parallel may help to distribute the load between the gate 600 and gate casing 150 to reduce friction and wear.

A rotor face seal may also be placed on the rotor 500 to provide for an interface between the rotor 500 and the endplates 120. An outer rotor face seal is placed along the exterior edge of the rotor 500, preventing fluid from escaping past the end of the rotor 500. A secondary inner rotor face seal is placed on the rotor face at a smaller radius to prevent any fluid that escapes past the outer rotor face seal from escaping the compressor entirely. This seal may use the same or other materials as the gate seal. Various geometries may be used to optimize the effectiveness of the seals. These seals may use energizing forces provided by springs, elastomers or pressurized fluid. Lubrication may be provided to these rotor face seals by injecting oil or other lubricant through ports in the endplates 120.

Along with the seals discussed herein, the surfaces those seals contact, known as counter-surfaces, may also be considered. In various embodiments, the surface finish of the counter-surface may be sufficiently smooth to minimize friction and wear between the surfaces. In other embodiments, the surface finish may be roughened or given a pattern such as cross-hatching to promote retention of lubricant or turbulence of leaking fluids. The counter-surface may be composed of a harder material than the seal to ensure the seal wears faster than the counter-surface, or the seal may be composed of a harder material than the counter-surface to ensure the counter-surface wears faster than the seal. The desired physical properties of the counter-surface (surface roughness, hardness, etc.) may be achieved through material selection, material finishing techniques such as quenching, tempering, or work hardening, or selection and application of coatings that achieve the desired characteristics. Final manufacturing processes, such as surface grinding, may be performed before or after coatings are applied. In various embodiments, the counter-surface material may be steel or stainless steel. The material may be hardened via quenching or tempering. A coating may be applied, which could be chrome, titanium nitride, silicon carbide, or other materials.

Minimizing the possibility of fluids leaking to the exterior of the main housing 100 is desirable. Various seals, such as gaskets and o-rings, are used to seal external connections between parts. For example, in a preferred embodiment, a double o-ring seal is used between the main casing 110 and endplates 120. Further seals are utilized around the drive shaft 140 to prevent leakage of any fluids making it past the rotor face seals. A lip seal is used to seal the drive shaft 140 where it passes through the endplates 120. In various embodiments, multiple seals may be used along the drive shaft 140 with small gaps between them to locate vent lines and hydraulic packings to reduce or eliminate gas leakage exterior to the compression chamber. Other forms of seals could also be used, such as mechanical or labyrinth seals.

It is desirable to achieve near isothermal compression. To provide cooling during the compression process, liquid injection is used. In preferred embodiments, the liquid is atomized to provide increased surface area for heat absorption. In other embodiments, different spray applications or other means of injecting liquids may be used.

Liquid injection is used to cool the fluid as it is compressed, increasing the efficiency of the compression process. Cooling allows most of the input energy to be used for compression rather than heat generation in the gas. The liquid has dramatically superior heat absorption characteristics compared to gas, allowing the liquid to absorb heat and minimize temperature increase of the working fluid, achieving near isothermal compression. As shown in FIGS. 8 and 17, liquid injector assemblies 130 are attached to the main casing 110. Liquid injector housings 132 include an adapter for the liquid source 134 (if it is not included with the nozzle) and a nozzle 136. Liquid is injected by way of a nozzle 136 directly into the rotor casing volume 410.

The amount and timing of liquid injection may be controlled by a variety of implements including a computer-based controller capable of measuring the liquid drainage rate, liquid levels in the chamber, and/or any rotational resistance due to liquid accumulation through a variety of sensors. Valves or solenoids may be used in conjunction with the nozzles to selectively control injection timing. Variable orifice control may also be used to regulate the amount of liquid injection and other characteristics.

Analytical and experimental results are used to optimize the number, location, and spray direction of the injectors 136. These injectors 136 may be located in the periphery of the cylinder. Liquid injection may also occur through the rotor or gate. The current embodiment of the design has two nozzles located at 12 o'clock and 10 o'clock. Different application parameters will also influence preferred nozzle arrays.

Because the heat capacity of liquids is typically much higher than gases, the heat is primarily absorbed by the liquid, keeping gas temperatures lower than they would be in the absence of such liquid injection.

When a fluid is compressed, the pressure times the volume raised to a polytropic exponent remains constant throughout the cycle, as seen in the following equation:

$$P*V^n=\text{Constant}$$

In polytropic compression, two special cases represent the opposing sides of the compression spectrum. On the high end, adiabatic compression is defined by a polytropic constant of n=1.4 for air, or n=1.28 for methane. Adiabatic compression is characterized by the complete absence of cooling of the working fluid (isentropic compression is a subset of adiabatic compression in which the process is reversible). This means that as the volume of the fluid is reduced, the pressure and temperature each rise accordingly. It is an inefficient process due to the exorbitant amount of energy wasted in the generation of heat in the fluid, which often needs to be cooled down again later. Despite being an inefficient process, most conventional compression technology, including reciprocating piston and centrifugal type compressors are essentially adiabatic. The other special case is isothermal compression, where n=1. It is an ideal compression cycle in which all heat generated in the fluid is transmitted to the environment, maintaining a constant temperature in the working fluid. Although it represents an unachievable perfect case, isothermal compression is useful in that it provides a lower limit to the amount of energy required to compress a fluid.

Figure 37:
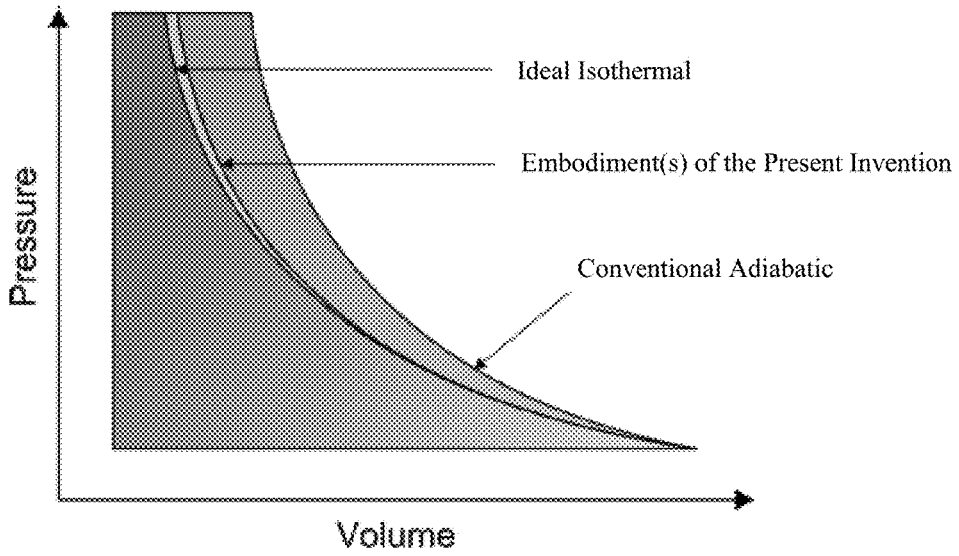
FIG. 37 is a graph of the pressure-volume curve achieved by a compressor according to one or more embodiments of the present invention relative to adiabatic and isothermal compression.

FIG. 37 shows a sample pressure-volume (P-V) curve comparing several different compression processes. The isothermal curve shows the theoretically ideal process. The adiabatic curve represents an adiabatic compression cycle, which is what most conventional compressor technologies follow. Since the area under the P-V curve represents the amount of work required for compression, approaching the isothermal curve means that less work is needed for compression. A model of one or more compressors according to various embodiments of the present invention is also shown, nearly achieving as good of results as the isothermal process. According to various embodiments, the above-discussed coolant injection facilitates the near isothermal compression through absorption of heat by the coolant. Not only does this near-isothermal compression process require less energy, at the end of the cycle gas temperatures are much lower than those encountered with traditional compressors. According to various embodiments, such a reduction in compressed working fluid temperature eliminates the use of or reduces the size of expensive and efficiency-robbing after-coolers.

Embodiments of the present invention achieve these near-isothermal results through the above-discussed injection of liquid coolant. Compression efficiency is improved according to one or more embodiments because the working fluid is cooled by injecting liquid directly into the chamber during the compression cycle. According to various embodiments, the liquid is injected directly into the area of the compression chamber where the gas is undergoing compression.

Rapid heat transfer between the working fluid and the coolant directly at the point of compression may facilitate high pressure ratios. That leads to several aspects of various embodiments of the present invention that may be modified to improve the heat transfer and raise the pressure ratio.

One consideration is the heat capacity of the liquid coolant. The basic heat transfer equation is as follows:

$$Q=mc_p\Delta T$$

where Q is the heat, m is mass,

ΔT is change in temperature, and $c_p$ is the specific heat.

The higher the specific heat of the coolant, the more heat transfer that will occur.

Choosing a coolant is sometimes more complicated than simply choosing a liquid with the highest heat capacity possible. Other factors, such as cost, availability, toxicity, compatibility with working fluid, and others can also be considered. In addition, other characteristics of the fluid, such as viscosity, density, and surface tension affect things like droplet formation which, as will be discussed below, also affect cooling performance.

According to various embodiments, water is used as the cooling liquid for air compression. For methane compression, various liquid hydrocarbons may be effective coolants, as well as triethylene glycol.

Another consideration is the relative velocity of coolant to the working fluid. Movement of the coolant relative to the working fluid at the location of compression of the working fluid (which is the point of heat generation) enhances heat transfer from the working fluid to the coolant. For example, injecting coolant at the inlet of a compressor such that the coolant is moving with the working fluid by the time compression occurs and heat is generated will cool less effectively than if the coolant is injected in a direction perpendicular to or counter to the flow of the working fluid adjacent the location of liquid coolant injection. FIGS. 38A-38D show a schematic of the sequential compression cycle in a compressor according to an embodiment of the invention. The dotted arrows in FIG. 38C show the injection locations, directions, and timing used according to various embodiments of the present invention to enhance the cooling performance of the system.

Figure 38A:
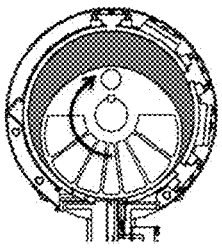
FIGS. 38A, 38B, 38C, and 38D show the sequential compression cycle and liquid coolant injection locations, directions, and timing according to one or more embodiments of the invention.
Figure 38B:
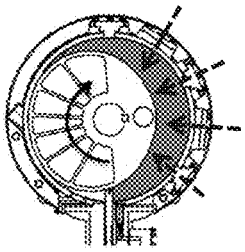
Figure 38C:
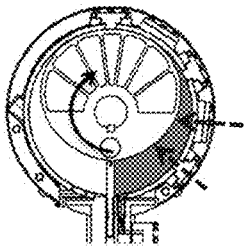
Figure 38D:
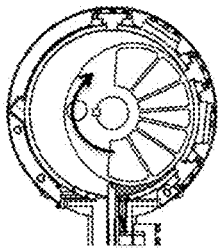

As shown in FIG. 38A, the compression stroke begins with a maximum working fluid volume (shown in gray) within the compression chamber. In the illustrated embodiment, the beginning of the compression stroke occurs when the rotor is at the 6 o'clock position (in an embodiment in which the gate is disposed at 6 o'clock with the inlet on the left of the gate and the outlet on the right of the gate as shown in FIGS. 38A-38D). In FIG. 38B, compression has started, the rotor is at the 9 o'clock position, and cooling liquid is injected into the compression chamber. In FIG. 38C, about 50% of the compression stroke has occurred, and the rotor is disposed at the 12 o'clock position. FIG. 38D illustrates a position (3 o'clock) in which the compression stroke is nearly completed (e.g., about 95% complete). Compression is ultimately completed when the rotor returns to the position shown in FIG. 38A.

As shown in FIGS. 38B and 38C, dotted arrows illustrate the timing, location, and direction of the coolant injection.

According to various embodiments, coolant injection occurs during only part of the compression cycle. For example, in each compression cycle/stroke, the coolant injection may begin at or after the first 10, 20, 30, 40, 50, 60 and/or 70% of the compression stroke/cycle (the stroke/cycle being measured in terms of volumetric compression). According to various embodiments, the coolant injection may end at each nozzle shortly before the rotor sweeps past the nozzle (e.g., resulting in sequential ending of the injection at each nozzle (clockwise as illustrated in FIG. 38)). According to various alternative embodiments, coolant injection occurs continuously throughout the compression cycle, regardless of the rotor position.

As shown in FIGS. 38B and 38C, the nozzles inject the liquid coolant into the chamber perpendicular to the sweeping direction of the rotor (i.e., toward the rotor's axis of rotation, in the inward radial direction relative to the rotor's axis of rotation). However, according to alternative embodiments, the direction of injection may be oriented so as to aim more upstream (e.g., at an acute angle relative to the radial direction such that the coolant is injected in a partially counter-flow direction relative to the sweeping direction of the rotor). According to various embodiments, the acute angle may be anywhere between 0 and 90 degrees toward the upstream direction relative to the radial line extending from the rotor's axis of rotation to the injector nozzle. Such an acute angle may further increase the velocity of the coolant relative to the surrounding working fluid, thereby further enhancing the heat transfer.

A further consideration is the location of the coolant injection, which is defined by the location at which the nozzles inject coolant into the compression chamber. As shown in FIGS. 38B and 38C, coolant injection nozzles are disposed at about 1, 2, 3, and 4 o'clock. However, additional and/or alternative locations may be chosen without deviating from the scope of the present invention. According to various embodiments, the location of injection is positioned within the compression volume (shown in gray in FIG. 38) that exists during the compressor's highest rate of compression (in terms of Avolume/time or Avolume/degree-of-rotor-rotation, which may or may not coincide). In the embodiment illustrated in FIG. 38, the highest rate of compression occurs around where the rotor is rotating from the 12 o'clock position shown in FIG. 38C to the 3 o'clock position shown in FIG. 38D. This location is dependent on the compression mechanism being employed and in various embodiments of the invention may vary.

As one skilled in the art could appreciate, the number and location of the nozzles may be selected based on a variety of factors. The number of nozzles may be as few as 1 or as many as 256 or more. According to various embodiments, the compressor includes (a) at least 1, 2, 3, 4, 5, 6, 7, 8, 9, 10, 15, 20, 30, 40, 50, 75, 100, 125, 150, 175, 200, 225, and/or 250 nozzles, (b) less than 400, 300, 275, 250, 225, 200, 175, 150, 125, 100, 75, 50, 40, 30, 20, 15, and/or 10 nozzles, (c) between 1 and 400 nozzles, and/or (d) any range of nozzles bounded by such numbers of any ranges therebetween. According to various embodiments, liquid coolant injection may be avoided altogether such that no nozzles are used. Along with varying the location along the angle of the rotor casing, a different number of nozzles may be installed at various locations along the length of the rotor casing. In certain embodiments, the same number of nozzles will be placed along the length of the casing at various angles. In other embodiments, nozzles may be scattered/staggered at different locations along the casing's length such that a nozzle at one angle may not have another nozzle at exactly the same location along the length at other angles. In various embodiments, a manifold may be used in which one or more nozzle is installed that connects directly to the rotor casing, simplifying the installation of multiple nozzles and the connection of liquid lines to those nozzles.

Coolant droplet size is a further consideration. Because the rate of heat transfer is linearly proportional to the surface area of liquid across which heat transfer can occur, the creation of smaller droplets via the above-discussed atomizing nozzles improves cooling by increasing the liquid surface area and allowing heat transfer to occur more quickly. Reducing the diameter of droplets of coolant in half (for a given mass) increases the surface area by a factor of two and thus improves the rate of heat transfer by a factor of 2. In addition, for small droplets the rate of convection typically far exceeds the rate of conduction, effectively creating a constant temperature across the droplet and removing any temperature gradients. This may result in the full mass of liquid being used to cool the gas, as opposed to larger droplets where some mass at the center of the droplet may not contribute to the cooling effect. Based on that evidence, it appears advantageous to inject as small of droplets as possible. However, droplets that are too small, when injected into the high density, high turbulence region as shown in FIGS. 38B and 38C, run the risk of being swept up by the working fluid and not continuing to move through the working fluid and maintain high relative velocity. Small droplets may also evaporate and lead to deposition of solids on the compressor's interior surfaces. Other extraneous factors also affect droplet size decisions, such as power losses of the coolant being forced through the nozzle and amount of liquid that the compressor can handle internally.

According to various embodiments, average droplet sizes of between 50 and 500 microns, between 50 and 300 microns, between 100 and 150 microns, and/or any ranges within those ranges, may be fairly effective.

The mass of the coolant liquid is a further consideration. As evidenced by the heat equation shown above, more mass (which is proportional to volume) of coolant will result in more heat transfer. However, the mass of coolant injected may be balanced against the amount of liquid that the compressor can accommodate, as well as extraneous power losses required to handle the higher mass of coolant. According to various embodiments, between 1 and 100 gallons per minute (gpm), between 3 and 40 gpm, between 5 and 25 gpm, between 7 and 10 gpm, and/or any ranges therebetween may provide an effective mass flow rate (averaged throughout the compression stroke despite the non-continuous injection according to various embodiments). According to various embodiments, the volumetric flow rate of liquid coolant into the compression chamber may be at least 1, 2, 3, 4, 5, 6, 7, 8, 9, and/or 10 gpm. According to various embodiments, flow rate of liquid coolant into the compression chamber may be less than 100, 80, 60, 50, 40, 30, 25, 20, 15, and/or 10 gpm.

The nozzle array may be designed for a high flow rate of greater than 1, 2, 3, 4, 5, 6, 7, 8, 9, 10, and/or 15 gallons per minute and be capable of extremely small droplet sizes of less than 500 and/or 150 microns or less at a low differential pressure of less than 400, 300, 200, and/or 100 psi. Two exemplary nozzles are Spraying Systems Co. Part Number: 1/4HHSJ-SS12007 and Bex Spray Nozzles Part Number: 1/4YS12007. Other non-limiting nozzles that may be suitable for use in various embodiments include Spraying Systems Co. Part Number 1/4LN-SS14 and 1/4LN-SS8. The preferred flow rate and droplet size ranges will vary with application parameters. Alternative nozzle styles may also be used. For example, one embodiment may use microperforations in the cylinder through which to inject liquid, counting on the small size of the holes to create sufficiently small droplets. Other embodiments may include various off the shelf or custom designed nozzles which, when combined into an array, meet the injection requirements necessary for a given application.

According to various embodiments, one, several, and/or all of the above-discussed considerations, and/or additional/alternative external considerations may be balanced to optimize the compressor's performance. Although particular examples are provided, different compressor designs and applications may result in different values being selected.

According to various embodiments, the coolant injection timing, location, and/or direction, and/or other factors, and/or the higher efficiency of the compressor facilitates higher pressure ratios. As used herein, the pressure ratio is defined by a ratio of (1) the absolute inlet pressure of the source working fluid coming into the compression chamber (upstream pressure) to (2) the absolute outlet pressure of the compressed working fluid being expelled from the compression chamber (downstream pressure downstream from the outlet valve). As a result, the pressure ratio of the compressor is a function of the downstream vessel (pipeline, tank, etc.) into which the working fluid is being expelled. Compressors according to various embodiments of the present invention would have a 1:1 pressure ratio if the working fluid is being taken from and expelled into the ambient environment (e.g., 14.7 psia/14.7 psia). Similarly, the pressure ratio would be about 26:1 (385 psia/14.7 psia) according to various embodiments of the invention if the working fluid is taken from ambient (14.7 psia upstream pressure) and expelled into a vessel at 385 psia (downstream pressure).

According to various embodiments, the compressor has a pressure ratio of (1) at least 3:1, 4:1, 5:1, 6:1, 8:1, 10:1, 15:1, 20:1, 25:1, 30:1, 35:1, and/or 40:1 or higher, (2) less than or equal to 200:1, 150:1, 125:1, 100:1, 90:1, 80:1, 70:1, 60:1, 50:1, 45:1, 40:1, 35:1, and/or 30:1, and (3) any and all combinations of such upper and lower ratios (e.g., between 10:1 and 200:1, between 15:1 and 100:1, between 15:1 and 80:1, between 15:1 and 50:1, etc.).

According to various embodiments, lower pressure ratios (e.g., between 3:1 and 15:1) may be used for working fluids with higher liquid content (e.g., with a liquid volume fraction at the compressor's inlet port of at least 0.5, 1, 2, 3, 4, 5, 6, 7, 8, 9, 10, 15, 20, 25, 30, 35, 40, 50, 60, 70, 75, 80, 85, 90, 91, 92, 93, 94, 95, 96, 97, 98, and/or 99%). Conversely, according to various embodiments, higher pressure ratios (e.g., above 15:1) may be used for working fluids with lower liquid content relative to gas content. However, wetter gases may nonetheless be compressed at higher pressure ratios and drier gases may be compressed at lower pressure ratios without deviating from the scope of the present invention.

Various embodiments of the invention are suitable for alternative operation using a variety of different operational parameters. For example, a single compressor according to one or more embodiments may be suitable to efficiently compress working fluids having drastically different liquid volume fractions and at different pressure ratios. For example, a compressor according to one or more embodiments is suitable for alternatively (1) compressing a working fluid with a liquid volume fraction of between 10 and 50 percent at a pressure ratio of between 3:1 and 15:1, and (2) compressing a working fluid with a liquid volume fraction of less than 10 percent at a pressure ratio of at least 15:1, 20:1, 30:1, and/or 40:1.

According to various embodiments, the compressor efficiently and cost-effectively compresses both wet and dry gas using a high pressure ratio.

According to various embodiments, the compressor is capable of and runs at commercially viable speeds (e.g., between 450 and 1800 rpm). According to various embodiments, the compressor runs at a speed of (a) at least 350, 400, 450, 500, 550, 600, and/or 650 rpm, (b) less than or equal to 3000, 2500, 2000, 1800, 1700, 1600, 1500, 1400, 1300, 1200, 1100, 1050, 1000, 950, 900, 850, and/or 800 rpm, and/or (c) between 350 and 300 rpm, 450-1800 rpm, and/or any ranges within these non-limiting upper and lower limits. According to various embodiments, the compressor is continuously operated at one or more of these speeds for at least 0.5, 1, 5, 10, 15, 20, 30, 60, 90, 100, 150, 200, 250 300, 350, 400, 450, and/or 500 minutes and/or at least 10, 20, 24, 48, 72, 100, 200, 300, 400, and/or 500 hours.

According to various embodiments, the outlet pressure of the compressed fluid is (1) at least 200, 225, 250, 275, 300, 325, 350, 375, 400, 425, 450, 475, 500, 600, 700, 800, 900, 1000, 1250, 1500, 2000, 3000, 4000, and/or 5000 psig, (2) less than 6000, 5500, 5000, 4000, 3000, 2500, 2250, 2000, 1750, 1500, 1250, 1100, 1000, 900, 800, 700, 600 and/or 500 psig, (3) between 200 and 6000 psig, between 200 and 5000 psig, and/or (4) within any range between the upper and lower pressures described above.

According to various embodiments, the inlet pressure is ambient pressure in the environment surrounding the compressor (e.g., 1 atm, 14.7 psia). Alternatively, the inlet pressure could be close to a vacuum (near 0 psia), or anywhere therebetween. According to alternative embodiments, the inlet pressure may be (1) at least −14.5, −10, −5, 0, 5, 10, 25, 50, 100, 150, 200, 250, 300, 350, 400, 450, 500, 550, 600, 700, 800, 900, 1000, 1100, 1200, 1300, 1400, and/or 1500 psig, (2) less than or equal to 3000, 2000, 1900, 1800, 1700, 1600, 1500, 1400, 1300, 1200, 1100, 1000, 900, 800, 700, 600, 500, 400, and/or 350, and/or (3) between −14.5 and 3000 psig, between 0 and 1500 psig, and/or within any range bounded by any combination of the upper and lower numbers and/or any nested range within such ranges.

According to various embodiments, the outlet temperature of the working fluid when the working fluid is expelled from the compression chamber exceeds the inlet temperature of the working fluid when the working fluid enters the compression chamber by (a) less than 700, 650, 600, 550, 500, 450, 400, 375 350, 325, 300, 275, 250, 225, 200, 175, 150, 140, 130, 120, 110, 100, 90, 80, 70, 60, 50, 40, 30, and/or 20 degrees C., (b) at least −10, 0, 10, and/or 20 degrees C., and/or (c) any combination of ranges between any two of these upper and lower numbers, including any range within such ranges.

According to various embodiments, the outlet temperature of the working fluid is (a) less than 700, 650, 600, 550, 500, 450, 400, 375, 350, 325, 300, 275, 250, 225, 200, 175, 150, 140, 130, 120, 110, 100, 90, 80, 70, 60, 50, 40, 30, and/or 20 degrees C., (b) at least −10, 0, 10, 20, 30, 40, and/or 50 degrees C., and/or (c) any combination of ranges between any two of these upper and lower numbers, including any range within such ranges.

The outlet temperature and/or temperature increase may be a function of the working fluid. For example, the outlet temperature and temperature increase may be lower for some working fluids (e.g., methane) than for other working fluids (e.g., air).

According to various embodiments, the temperature increase is correlated to the pressure ratio. According to various embodiments, the temperature increase is less than 200 degrees C. for a pressure ratio of 20:1 or less (or between 15:1 and 20:1), and the temperature increase is less than 300 degrees C. for a pressure ratio of between 20:1 and 30:1.

According to various embodiments, the pressure ratio is between 3:1 and 15:1 for a working fluid with an inlet liquid volume fraction of over 5%, and the pressure ratio is between 15:1 and 40:1 for a working fluid with an inlet liquid volume fraction of between 1 and 20%. According to various embodiments, the pressure ratio is above 15:1 while the outlet pressure is above 250 psig, while the temperature increase is less than 200 degrees C. According to various embodiments, the pressure ratio is above 25:1 while the outlet pressure is above 250 psig and the temperature increase is less than 300 degrees C. According to various embodiments, the pressure ratio is above 15:1 while the outlet pressure is above 250 psig and the compressor speed is over 450 rpm.

According to various embodiments, any combination of the different ranges of different parameters discussed herein (e.g., pressure ratio, inlet temperature, outlet temperature, temperature change, inlet pressure, outlet pressure, pressure change, compressor speed, coolant injection rate, etc.) may be combined according to various embodiments of the invention. According to one or more embodiments, the pressure ratio is anywhere between 3:1 and 200:1 while the operating compressor speed is anywhere between 350 and 3000 rpm while the outlet pressure is between 200 and 6000 psig while the inlet pressure is between 0 and 3000 psig while the outlet temperature is between −10 and 650 degrees C. while the outlet temperature exceeds the inlet temperature by between 0 and 650 degrees C. while the liquid volume fraction of the working fluid at the compressor inlet is between 1% and 50%.

According to one or more embodiments, air is compressed from ambient pressure (14.7 psia) to 385 psia, a pressure ratio of 26:1, at speeds of 700 rpm with outlet temperatures remaining below 100 degrees C. Similar compression in an adiabatic environment would reach temperatures of nearly 480 degrees C.

The operating speed of the illustrated compressor is stated in terms of rpm because the illustrated compressor is a rotary compressor. However, other types of compressors may be used in alternative embodiments of the invention. As those familiar in the art appreciate, the RPM term also applies to other types of compressors, including piston compressors whose strokes are linked to RPM via their crankshaft.

Numerous cooling liquids may be used. For example, water, triethylene glycol, and various types of oils and other hydrocarbons may be used. Ethylene glycol, propylene glycol, methanol or other alcohols in case phase change characteristics are desired may be used. Refrigerants such as ammonia and others may also be used. Further, various additives may be combined with the cooling liquid to achieve desired characteristics. Along with the heat transfer and heat absorption properties of the liquid helping to cool the compression process, vaporization of the liquid may also be utilized in some embodiments of the design to take advantage of the large cooling effect due to phase change.

The effect of liquid coalescence is also addressed in the preferred embodiments. Liquid accumulation can provide resistance against the compressing mechanism, eventually resulting in hydrolock in which all motion of the compressor is stopped, causing potentially irreparable harm. As is shown in the embodiments of FIGS. 8 and 17, the inlet 420 and outlet 430 are located at the bottom of the rotor casing 400 on opposite sides of the gate 600, thus providing an efficient location for both intake of fluid to be compressed and exhausting of compressed fluid and the injected liquid. A valve is not necessary at the inlet 420. The inclusion of a dwell seal allows the inlet 420 to be an open port, simplifying the system and reducing inefficiencies associated with inlet valves. However, if desirable, an inlet valve could also be incorporated. Additional features may be added at the inlet to induce turbulence to provide enhanced thermal transfer and other benefits. Hardened materials may be used at the inlet and other locations of the compressor to protect against cavitation when liquid/gas mixtures enter into choke and other cavitation-inducing conditions.

Alternative embodiments may include an inlet located at positions other than shown in the figures. Additionally, multiple inlets may be located along the periphery of the cylinder. These could be utilized in isolation or combination to accommodate inlet streams of varying pressures and flow rates. The inlet ports can also be enlarged or moved, either automatically or manually, to vary the displacement of the compressor.

In these embodiments, multi-phase compression is utilized, thus the outlet system allows for the passage of both gas and liquid. Placement of outlet 430 near the bottom of the rotor casing 400 provides for a drain for the liquid. This minimizes the risk of hydrolock found in other liquid injection compressors. A small clearance volume allows any liquids that remain within the chamber to be accommodated. Gravity assists in collecting and eliminating the excess liquid, preventing liquid accumulation over subsequent cycles. Additionally, the sweeping motion of the rotor helps to ensure that most liquid is removed from the compressor during each compression cycle by guiding the liquid toward the outlet(s) and out of the compression chamber.

Compressed gas and liquid can be separated downstream from the compressor. As discussed below, liquid coolant can then be cooled and recirculated through the compressor.

Various of these features enable compressors according to various embodiments to effectively compress multi-phase fluids (e.g., a fluid that includes gas and liquid components (sometimes referred to as "wet gas")) without pre-compression separation of the gas and liquid phase components of the working fluid. As used herein, multi-phase fluids have liquid volume fractions at the compressor inlet port of (a) at least 0.5, 1, 2, 3, 4, 5, 6, 7, 8, 9, 10, 15, 20, 25, 30, 35, 40, 50, 60, 70, 75, 80, 85, 90, 91, 92, 93, 94, 95, 96, 97, 98, 99, and/or 99.5%, (b) less than or equal to 99.5, 99, 98, 97, 96, 95, 94, 93, 92, 91, 90, 85, 80, 75, 70, 60, 50, 40, 35, 30, 25, 20, 15, 10, 9, 8, 7, 6, 5, 4, 3, 2, 1, and/or 0.5%, (c) between 0.5 and 99.5%, and/or (d) within any range bounded by these upper and lower values.

Outlet valves allow gas and liquid (i.e., from the wet gas and/or liquid coolant) to flow out of the compressor once the desired pressure within the compression chamber is reached. The outlet valves may increase or maximize the effective orifice area. Due to the presence of liquid in the working fluid, valves that minimize or eliminate changes in direction for the outflowing working fluid are desirable, but not required. This prevents the hammering effect of liquids as they change direction. Additionally, it is desirable to minimize clearance volume. Unused valve openings may be plugged in some applications to further minimize clearance volume. According to various embodiments, these features improve the wet gas capabilities of the compressor as well as the compressor's ability to utilize in-chamber liquid coolant.

Reed valves may be desirable as outlet valves. As one of ordinary skill in the art would appreciate, other types of valves known or as yet unknown may be utilized. Hoerbiger type R, CO, and Reed valves may be acceptable. Additionally, CT, HDS, CE, CM or Poppet valves may be considered. Other embodiments may use valves in other locations in the casing that allow gas to exit once the gas has reached a given pressure. In such embodiments, various styles of valves may be used. Passive or directly-actuated valves may be used and valve controllers may also be implemented.

In the presently preferred embodiments, the outlet valves are located near the bottom of the casing and serve to allow exhausting of liquid and compressed gas from the high pressure portion. In other embodiments, it may be useful to provide additional outlet valves located along periphery of main casing in locations other than near the bottom. Some embodiments may also benefit from outlets placed on the endplates. In still other embodiments, it may be desirable to separate the outlet valves into two types of valves—one predominately for high pressured gas, the other for liquid drainage. In these embodiments, the two or more types of valves may be located near each other, or in different locations.

The coolant liquid can be removed from the gas stream, cooled, and recirculated back into the compressor in a closed loop system. By placing the injector nozzles at locations in the compression chamber that do not see the full pressure of the system, the recirculation system may omit an additional pump (and subsequent efficiency loss) to deliver the atomized droplets. However, according to alternative embodiments, a pump is utilized to recirculate the liquid back into the compression chamber via the injector nozzles. Moreover, the injector nozzles may be disposed at locations in the compression chamber that see the full pressure of the system without deviating from the scope of the present invention.

One or more embodiments simplify heat recovery because most or all of the heat load is in the cooling liquid. According to various embodiments, heat is not removed from the compressed gas downstream of the compressor. The cooling liquid may cooled via an active cooling process (e.g., refrigeration and heat exchangers) downstream from the compressor. However, according to various embodiments, heat may additionally be recovered from the compressed gas (e.g., via heat exchangers) without deviating from the scope of the present invention.

As shown in FIGS. 8 and 17, the sealing portion 510 of the rotor effectively precludes fluid communication between the outlet and inlet ports by way of the creation of a dwell seal. The interface between the rotor 500 and gate 600 further precludes fluid communication between the outlet and inlet ports through use of a non-contacting seal or tip seal 620. In this way, the compressor is able to prevent any return and venting of fluid even when running at low speeds. Existing rotary compressors, when running at low speeds, have a leakage path from the outlet to the inlet and thus depend on the speed of rotation to minimize venting/leakage losses through this flowpath.

The high pressure working fluid exerts a large horizontal force on the gate 600. Despite the rigidity of the gate struts 210, this force will cause the gate 600 to bend and press against the inlet side of the gate casing 152. Specialized coatings that are very hard and have low coefficients of friction can coat both surfaces to minimize friction and wear from the sliding of the gate 600 against the gate casing 152. A fluid bearing can also be utilized. Alternatively, pegs (not shown) can extend from the side of the gate 600 into gate casing 150 to help support the gate 600 against this horizontal force. Material may also be removed from the non-pressure side of gate 600 in a non-symmetrical manner to allow more space for the gate 600 to bend before interfering with the gate casing 150.

The large horizontal forces encountered by the gate may also require additional considerations to reduce sliding friction of the gate's reciprocating motion. Various types of lubricants, such as greases or oils may be used. These lubricants may further be pressurized to help resist the force pressing the gate against the gate casing. Components may also provide a passive source of lubrication for sliding parts via lubricant-impregnated or self-lubricating materials. In the absence of, or in conjunction with, lubrication, replaceable wear elements may be used on sliding parts to ensure reliable operation contingent on adherence to maintenance schedules. These wear elements may also be used to precisely position the gate within the gate casing. As one of ordinary skill in the art would appreciate, replaceable wear elements may also be utilized on various other wear surfaces within the compressor.

The compressor structure may be comprised of materials such as aluminum, carbon steel, stainless steel, titanium, tungsten, or brass. Materials may be chosen based on corrosion resistance, strength, density, and cost. Seals may be comprised of polymers, such as PTFE, HDPE, PEEK™, acetal copolymer, etc., graphite, cast iron, carbon steel, stainless steel, or ceramics. Other materials known or unknown may be utilized. Coatings may also be used to enhance material properties.

As one of ordinary skill in the art can appreciate, various techniques may be utilized to manufacture and assemble the invention that may affect specific features of the design. For example, the main casing 110 may be manufactured using a casting process. In this scenario, the nozzle housings 132, gate casing 150, or other components may be formed in singularity with the main casing 110. Similarly, the rotor 500 and drive shaft 140 may be built as a single piece, either due to strength requirements or chosen manufacturing technique.

Further benefits may be achieved by utilizing elements exterior to the compressor envelope. A flywheel may be added to the drive shaft 140 to smooth the torque curve encountered during the rotation. A flywheel or other exterior shaft attachment may also be used to help achieve balanced rotation. Applications requiring multiple compressors may combine multiple compressors on a single drive shaft with rotors mounted out of phase to also achieve a smoothened torque curve. A bell housing or other shaft coupling may be used to attach the drive shaft to a driving force such as engine or electric motor to minimize effects of misalignment and increase torque transfer efficiency. Accessory components such as pumps or generators may be driven by the drive shaft using belts, direct couplings, gears, or other transmission mechanisms. Timing gears or belts may further be utilized to synchronize accessory components where appropriate.

After exiting the valves the mix of liquid and gases may be separated through any of the following methods or a combination thereof: 1. Interception through the use of a mesh, vanes, intertwined fibers; 2. Inertial impaction against a surface; 3. Coalescence against other larger injected droplets; 4. Passing through a liquid curtain; 5. Bubbling through a liquid reservoir; 6. Brownian motion to aid in coalescence; 7. Change in direction; 8. Centrifugal motion for coalescence into walls and other structures; 9. Inertia change by rapid deceleration; and 10. Dehydration through the use of adsorbents or absorbents.

At the outlet of the compressor, a pulsation chamber may consist of cylindrical bottles or other cavities and elements, may be combined with any of the aforementioned separation methods to achieve pulsation dampening and attenuation as well as primary or final liquid coalescence. Other methods of separating the liquid and gases may be used as well.

The presently preferred embodiments could be modified to operate as an expander. Further, although descriptions have been used to describe the top and bottom and other directions, the orientation of the elements (e.g. the gate 600 at the bottom of the rotor casing 400) should not be interpreted as limitations on the present invention.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

It is therefore intended that the foregoing detailed description be regarded as illustrative rather than limiting, and that it be understood that it is the following claims, including all equivalents, that are intended to define the spirit and scope of this invention. To the extent that "at least one" is used to highlight the possibility of a plurality of elements that may satisfy a claim element, this should not be interpreted as requiring "a" to mean singular only. "A" or "an" element may still be satisfied by a plurality of elements unless otherwise stated.

The invention claimed is:

1. A positive displacement compressor, comprising:

a rotor casing that includes a compression chamber with a first end, a second end, and an inner curved surface;

a shaft located axially in the compression chamber;

a non-circular rotor mounted for rotation with the shaft relative to the rotor casing, the non-circular rotor having a sealing portion, the sealing portion having a curved surface that corresponds with the inner curved surface of the compression chamber, and a non-sealing portion;

a gate having a first end and a second end, and being operable to move relative to the rotor casing to locate the first end proximate to the rotor as the rotor rotates.

2. The positive displacement compressor of claim 1, further comprising at least one liquid injection nozzle located to provide injected fluids into the compression chamber, wherein the at least one liquid injection nozzle is configured to provide an atomized liquid spray.

3. The positive displacement compressor of claim 1, further comprising at least one liquid injector positioned to inject liquid into an area within the compression chamber where compression occurs during operation of the compressor.

4. The positive displacement compressor of claim 1, further comprising at least one liquid injector connected with the rotor casing to inject liquids into the compression chamber.

5. The positive displacement compressor of claim 1, wherein:

the rotor has a first end and a second end aligned horizontally;

the gate is located at the bottom of the compression chamber and is operable to move up and down;

an inlet is located on the rotor casing on one side of the gate; and an outlet port is located on the rotor casing on the opposite side of the gate.

6. The positive displacement compressor of claim 1, wherein the compressor is configured to be oriented such that the rotor rotates about a horizontal axis during operation of the compressor.

7. The positive displacement compressor of claim 1, further comprising a gate positioning system operable to locate the first end of the gate proximate to the non-circular rotor as the rotor turns.

8. The positive displacement compressor of claim 7, wherein a portion of the gate positioning system is disposed outside of the compression chamber.

9. The positive displacement compressor of claim 7, wherein the gate positioning system comprises at least one cam that drives the gate positioning system.

10. The positive displacement compressor of claim 9, wherein the cam is disposed outside of the compression chamber.

11. The positive displacement compressor of claim 9, wherein the gate positioning system comprises:

at least one cam follower connected to the at least one cam; and a gate support arm connecting the gate to the cam follower such that movement of the at least one cam follower causes movement of the gate.

12. The positive displacement compressor of claim 11, wherein the gate positioning system comprises means for urging the cam follower to maintain contact with the cam.

13. The positive displacement compressor of claim 1, wherein the rotor includes at least one hole or counterweight that aids in balancing the rotor.

14. The positive displacement compressor of claim 1, wherein the shaft comprises a drive shaft, and wherein the rotor is rigidly mounted to the drive shaft for rotation with the drive shaft relative to the rotor casing.

15. The positive displacement compressor of claim 1, wherein:

the rotor casing has an inlet port and an outlet port, the compressor comprises at least one liquid injector connected with the rotor casing to inject liquids into the compression chamber, the gate separates an inlet volume within the compression chamber and a compression volume within the compression chamber, the inlet port is configured to enable suction in of working fluid, and the outlet port is configured to enable expulsion of both liquid and gas.

16. The positive displacement compressor of claim 15, wherein:

the outlet port is located near the cross-sectional bottom of the compression chamber, the compressor further comprises at least one outlet valve in fluid communication with the compression chamber, and the outlet valve is configured to allow for the expulsion of liquid and gas.

17. The compressor of claim 1, wherein the sealing portion forms a dwell seal with the inner curved surface of the compression chamber.

* * * * *